US007731047B2

(12) United States Patent
Ishimitsu

(10) Patent No.: US 7,731,047 B2
(45) Date of Patent: Jun. 8, 2010

(54) RECLOSABLE CONTAINER LID WITH SLIDING ELEMENT

(75) Inventor: Masahiko Ishimitsu, Tokyo (JP)

(73) Assignee: Solo Cup Operating Corporation, Lake Forest, IL (US)

( * ) Notice: Subject to any disclaimer, the term of this patent is extended or adjusted under 35 U.S.C. 154(b) by 381 days.

(21) Appl. No.: 10/954,827

(22) Filed: Sep. 30, 2004

(65) Prior Publication Data

US 2005/0127075 A1 Jun. 16, 2005

Related U.S. Application Data

(63) Continuation-in-part of application No. 10/622,374, filed on Jul. 18, 2003, now Pat. No. 7,246,715, which is a continuation-in-part of application No. 09/923,763, filed on Aug. 6, 2001, now Pat. No. 6,732,875.

(51) Int. Cl.
*B65D 51/18* (2006.01)
*A47G 19/22* (2006.01)

(52) U.S. Cl. ..... 220/254.4; 220/254.7; 220/254.9; 220/713; 220/717; 220/345.2; 220/345.4; 220/715; 220/253; 220/254.3; 220/256.1

(58) Field of Classification Search ... 220/345.1–345.4, 220/253, 254.3, 254.4, 254.7, 254.9, 255, 220/254.1, 713, 715–718, 731, 694, 714, 220/351, 820–822, 824; 40/311, 307; 229/404, 229/906.1; 222/481, 560, 153.01, 559, 505, 222/480

See application file for complete search history.

(56) References Cited

U.S. PATENT DOCUMENTS 1,237,228 A 8/1917 Westover
1,725,393 A 8/1929 Cone
1,752,720 A 4/1930 Bergelson
1,896,976 A 2/1933 Schifferdecker
2,121,554 A 6/1938 Thorn
2,495,806 A 1/1950 Block
2,554,710 A 5/1951 Leccese
3,031,111 A 4/1962 Stull
3,083,861 A 4/1963 Amberg et al.

(Continued)

FOREIGN PATENT DOCUMENTS

CH 393 955 11/1965

(Continued)

OTHER PUBLICATIONS

Photograph of HotJo Ceramic Mug/Lid obtained through market research, Apr. 2000.

(Continued)

*Primary Examiner*—Robin A. Hylton
(74) *Attorney, Agent, or Firm*—Banner & Witcoff, Ltd.

(57) ABSTRACT

A reclosable lid (10) for a container holding a flowable substance has a cover (12) having an opening (28) and a moveable element (850) connected to the cover (12). The moveable element (850) is moveable between at least one open position, wherein the flowable substance may flow through the opening, and at least one closed position, wherein the opening is obstructed. In some embodiments, the lid (10) may include an overlay (250) moveable between at least one open position and at least one closed position.

20 Claims, 45 Drawing Sheets

U.S. PATENT DOCUMENTS 3,188,036 A 6/1965 Sprung
3,193,130 A 7/1965 Miller
3,262,612 A 7/1966 Tabor
3,326,401 A 6/1967 De Long
3,327,905 A 6/1967 Gould
3,459,324 A 8/1969 Miller
3,690,514 A 9/1972 Wilson
3,805,991 A 4/1974 Cheladze et al.
3,874,580 A 4/1975 Weatherhead, III
3,994,411 A 11/1976 Elfelt et al.
4,091,956 A 5/1978 Vecchio
4,138,033 A 2/1979 Payne et al.
4,141,461 A 2/1979 LaChance
4,183,443 A 1/1980 DeParales et al.
4,188,457 A 2/1980 Throp
4,203,527 A 5/1980 LaChance, Sr.
4,253,582 A 3/1981 Shields
4,331,255 A 5/1982 Fournier
4,333,583 A 6/1982 Montemarano
4,345,695 A 8/1982 Galloway et al.
4,347,946 A 9/1982 Nichols
4,350,260 A 9/1982 Prueher
4,361,249 A 11/1982 Tuneski et al.
4,420,092 A 12/1983 Finkelstein
4,441,624 A 4/1984 Sokolowski
4,449,640 A 5/1984 Finkelstein
4,460,103 A 7/1984 Rama et al.
4,478,346 A 10/1984 Spong
4,503,992 A 3/1985 Sitko et al.
4,557,398 A 12/1985 Hambleton et al.
4,570,817 A 2/1986 Hambleton et al.
4,579,245 A 4/1986 Narushko
4,589,569 A 5/1986 Clements
4,598,837 A 7/1986 Kreiseder et al.
4,615,459 A 10/1986 Clements
4,619,372 A 10/1986 McFarland
4,629,088 A 12/1986 Durgin
4,657,139 A 4/1987 Hanifl
4,703,873 A 11/1987 Geren
4,705,197 A 11/1987 Gordon et al.
4,717,039 A * 1/1988 Ayyoubi ..... 220/253
4,718,570 A 1/1988 Diener
4,738,373 A 4/1988 DeParales
4,741,450 A 5/1988 Braude
4,747,511 A 5/1988 Dutt et al.
4,753,365 A 6/1988 Seppala
4,770,325 A 9/1988 Gordon et al.
4,782,975 A 11/1988 Coy
4,790,444 A 12/1988 Terzi
4,792,054 A 12/1988 Weidman
4,796,774 A 1/1989 Nabinger
4,863,051 A 9/1989 Eibner et al.
4,869,389 A 9/1989 Cerrone, Jr.
4,874,103 A 10/1989 Quisenberry et al.
4,898,295 A 2/1990 Kim
4,899,902 A 2/1990 DeMars
4,915,250 A 4/1990 Hayes, Jr.
4,930,654 A 6/1990 Thibeault et al.
4,932,555 A 6/1990 La Barge
4,938,379 A 7/1990 Kellner
4,949,865 A 8/1990 Turner
4,953,743 A 9/1990 Dart et al.
4,966,300 A 10/1990 Coonradt
5,012,061 A 4/1991 Lesser
5,090,584 A 2/1992 Roberts et al.
5,111,961 A 5/1992 Van Melle
5,148,936 A 9/1992 DeGrow
5,167,338 A 12/1992 Kick
5,180,073 A 1/1993 Fay et al.
5,183,172 A 2/1993 Boller
5,193,704 A 3/1993 Kick
5,197,624 A 3/1993 Doddaro
5,205,430 A 4/1993 Valyi
5,294,014 A 3/1994 Wyatt et al.
D346,718 S 5/1994 Timmermans
5,395,006 A 3/1995 Verma
5,398,843 A 3/1995 Warden et al.
5,415,312 A 5/1995 Mueller
5,421,472 A 6/1995 Beckertgis
5,449,085 A 9/1995 Brun, Jr.
5,485,938 A 1/1996 Boersma
5,490,609 A 2/1996 Lane et al.
5,495,941 A 3/1996 Leonard
5,497,920 A 3/1996 Moeller et al.
D368,624 S 4/1996 Forrer
5,503,289 A 4/1996 Fox
5,503,662 A 4/1996 Berger
5,588,561 A 12/1996 Ness
5,613,619 A 3/1997 Van Melle
5,699,927 A 12/1997 Lane et al.
5,706,972 A 1/1998 Sousa
5,718,353 A 2/1998 Kanfer et al.
5,727,707 A 3/1998 Wickland et al.
5,766,660 A 6/1998 Lee et al.
5,775,205 A 7/1998 Melton
5,839,601 A 11/1998 Van Melle
D402,556 S * 12/1998 Frye ..... D9/447
5,866,184 A 2/1999 Gorlich et al.
5,873,298 A 2/1999 Chang
5,911,331 A 6/1999 Boller
5,913,964 A 6/1999 Melton
5,947,319 A 9/1999 Sinski
5,947,323 A 9/1999 Freek et al.
5,954,241 A 9/1999 Huang
5,979,689 A 11/1999 Lansky
5,984,127 A 11/1999 Fenton
5,996,837 A 12/1999 Freek et al.
6,003,711 A 12/1999 Bilewitz
6,010,029 A 1/2000 Wang
6,089,397 A 7/2000 Van Melle
6,095,033 A 8/2000 Melton
6,176,384 B1 1/2001 Voloshin
D437,223 S 2/2001 Coy et al.
6,199,711 B1 3/2001 Lansky
6,216,904 B1 4/2001 Cagan
6,220,470 B1 4/2001 McHenry et al.
6,305,571 B1 10/2001 Chu
6,374,726 B1 4/2002 Melton
6,419,105 B1 7/2002 Bruce et al.
6,578,726 B1 6/2003 Schaefer
6,612,456 B1 9/2003 Hundley et al.
D480,968 S 10/2003 Atkins et al.
6,644,490 B2 11/2003 Clarke
2002/0027139 A1 3/2002 O'Neill
2003/0089713 A1 5/2003 Belt et al.
2003/0089714 A1 5/2003 Dart et al.
2003/0141302 A1 7/2003 Ryan et al.
2005/0242096 A1* 11/2005 Jaghab ..... 220/254.8
2006/0027588 A1* 2/2006 Mackovic-Basic et al. .. 220/795

FOREIGN PATENT DOCUMENTS

DE 18 16 709 A1 2/1970
DE 295 02 654 U1 8/1995
EP 0 160 372 A 11/1985
EP 0336168 A1 * 10/1989
EP 0 383 442 A1 8/1990
GB 1 576 126 A 10/1980
GB 1 600 917 10/1981
GB 2 091 232 A 7/1982
GB 2 182 027 A 5/1987
JP 07-309379 11/1995
JP 10-129706 A 5/1998
JP 2000-159254 6/2000

| | | | |
|---|---|---|---|
| JP | D1232437 | * | 1/2005 |
| WO | WO 99 47429 | | 9/1999 |
| WO | WO 00 51908 | | 9/2000 |

OTHER PUBLICATIONS

Photograph of Starbucks Cup/Lid obtained through market research, Apr. 2000.

Photograph of Super America Cup/Lid obtained through market research, Apr. 2000.

Photograph of Dunkin Donuts Cup/Lid obtained through market research, Apr. 2000.

Berrington, N., *International Search Report*, Sep. 4, 2002, 6 pp., Patent Cooperation Treaty, Rijswijk, Netherlands.

Seven (7) color photographs showing different views of Whirley Thermo Mug/Lid obtained in Feb. 2003.

US 6,003,721, 12/1999, Fleming (withdrawn)

* cited by examiner

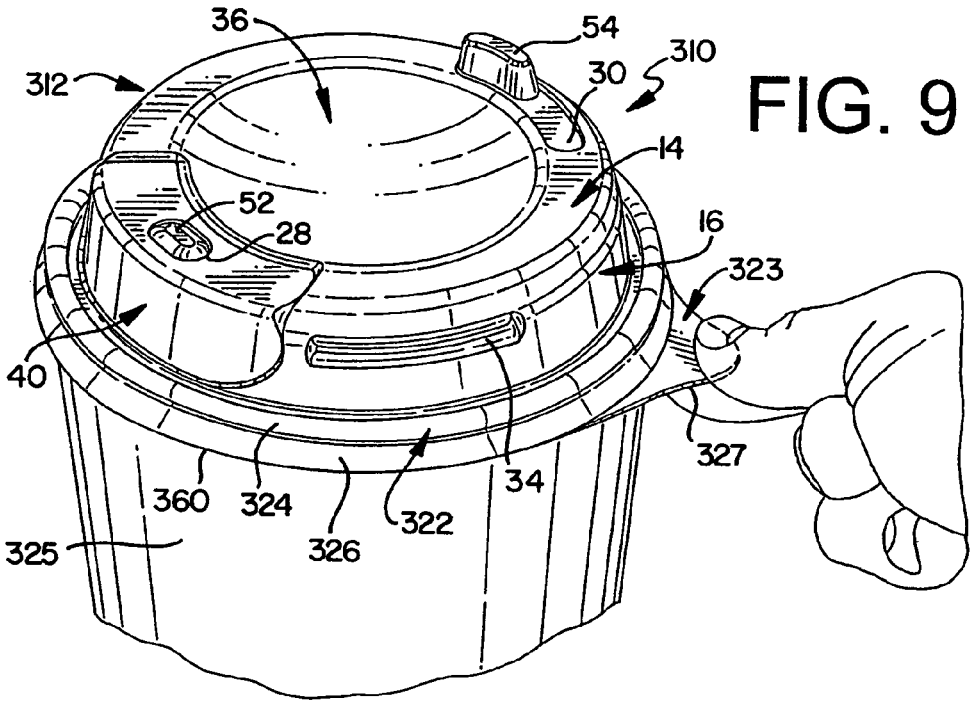
FIG. 9
FIG. 10
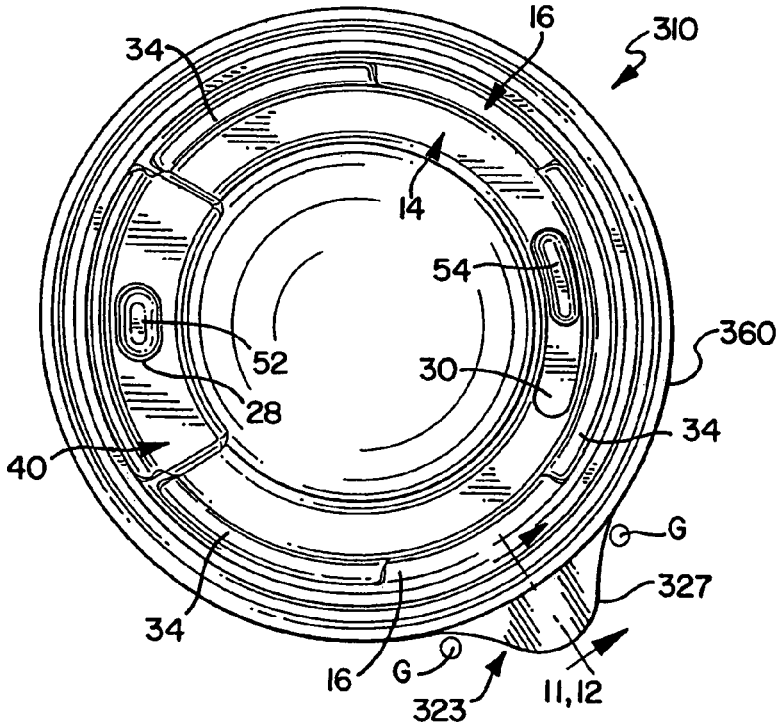

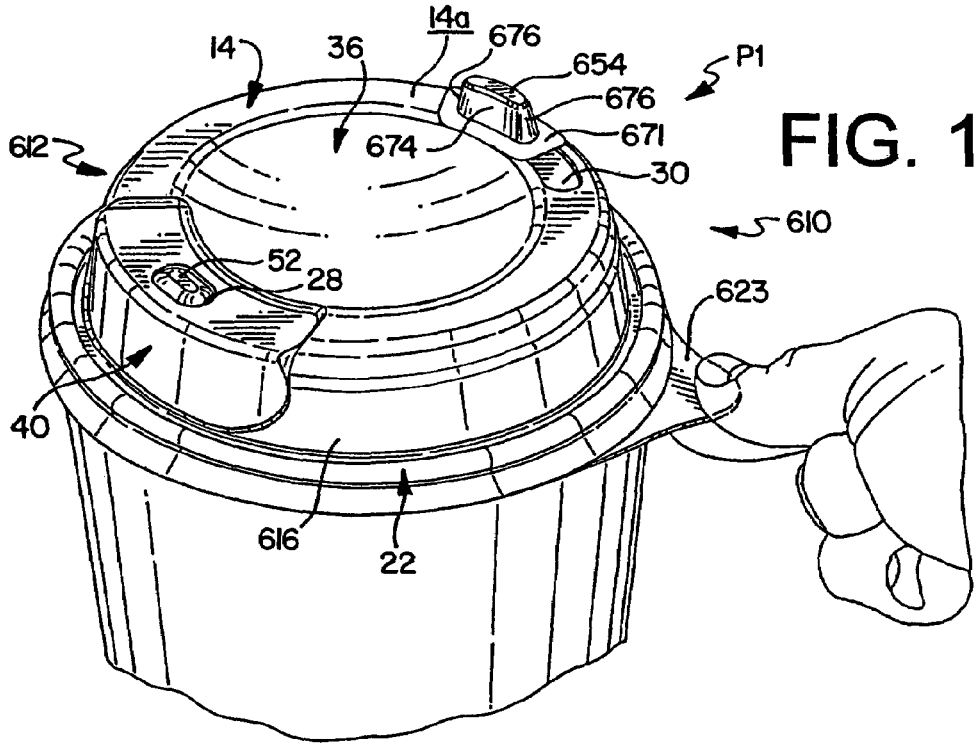
FIG. 17
FIG. 18
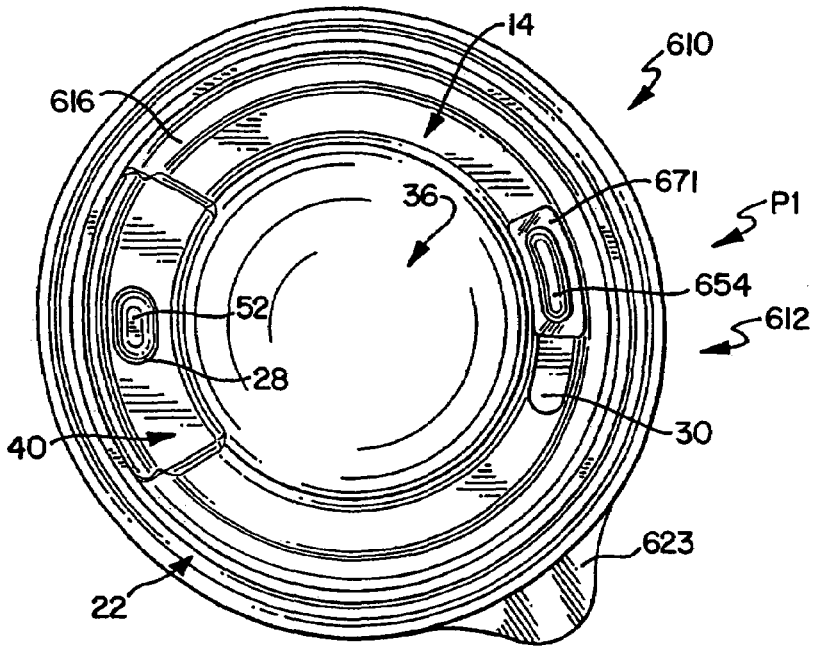

FIG. 21A
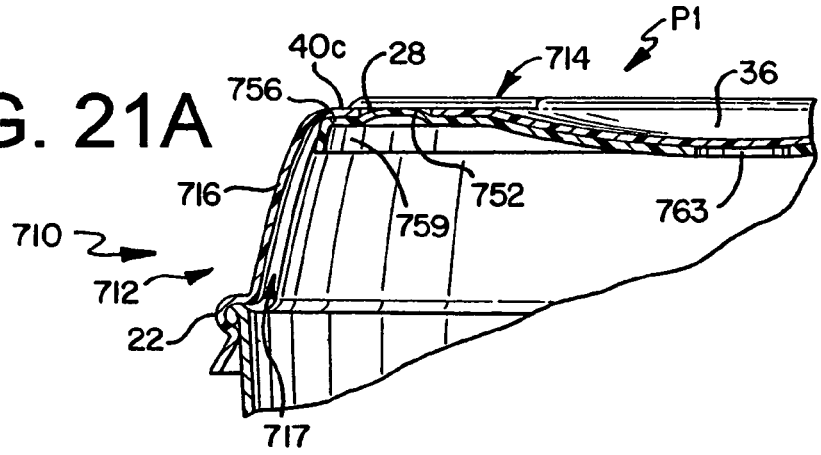
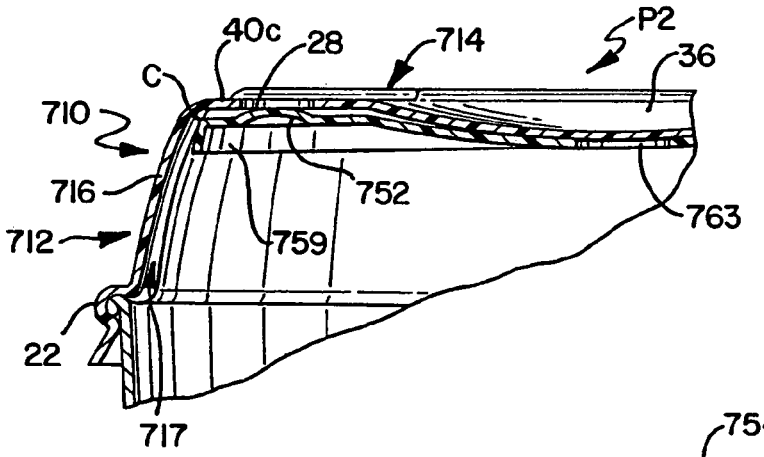
FIG. 21B
FIG. 22
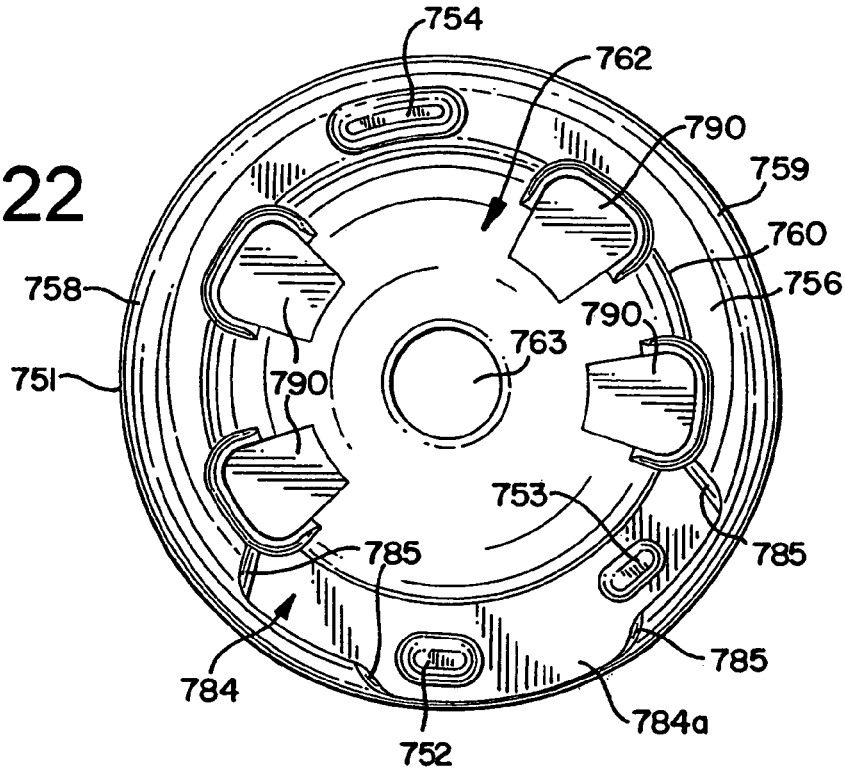

FIG. 34
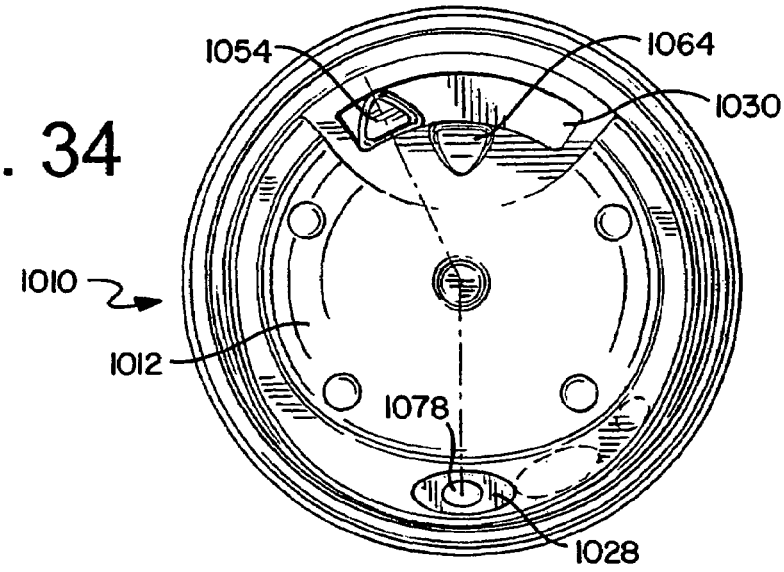
FIG. 35
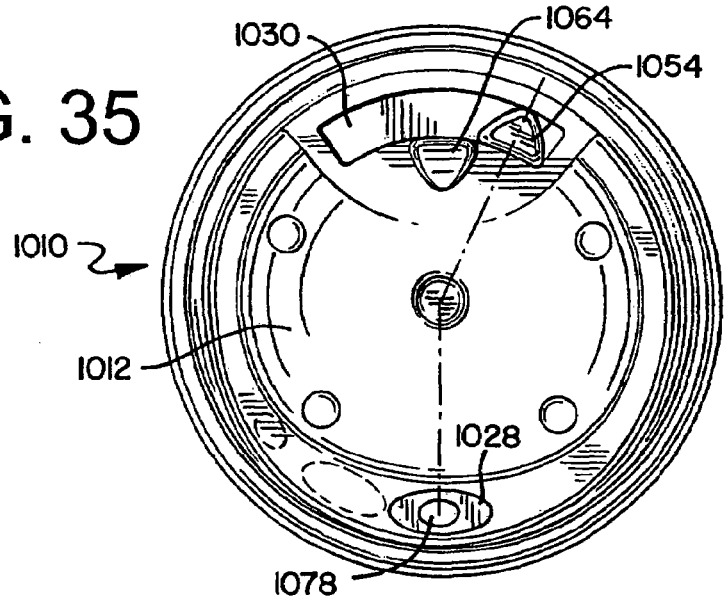
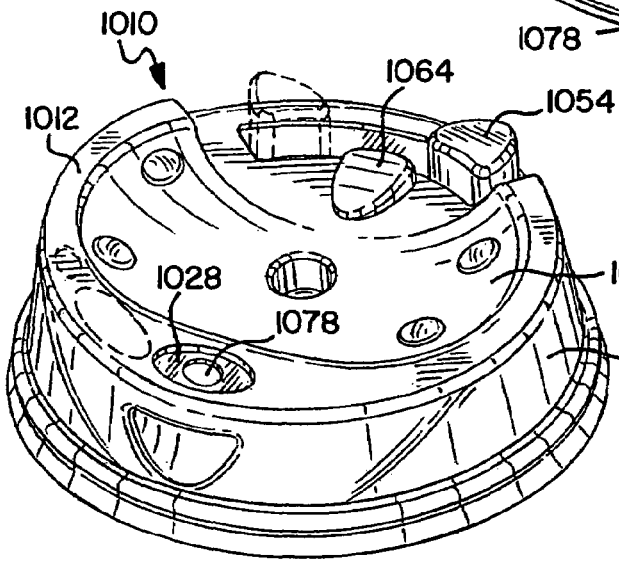
FIG. 36

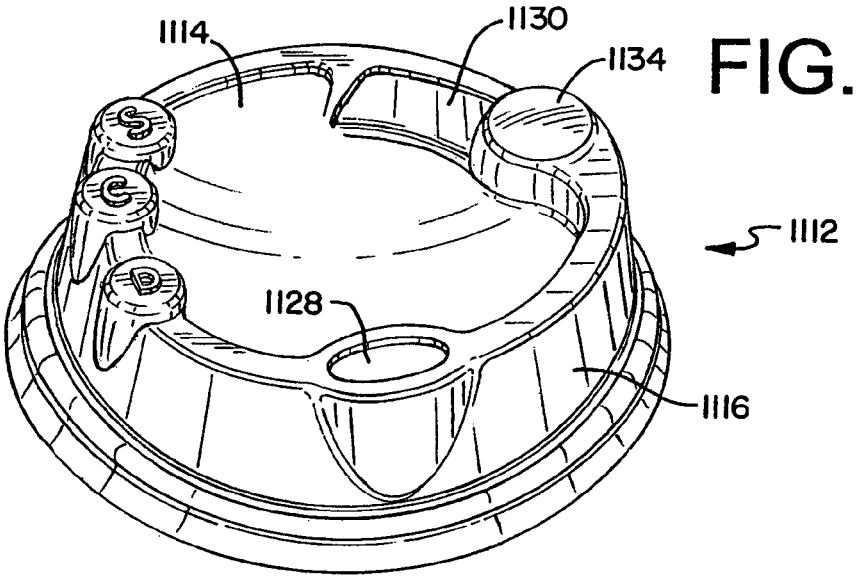
FIG. 39
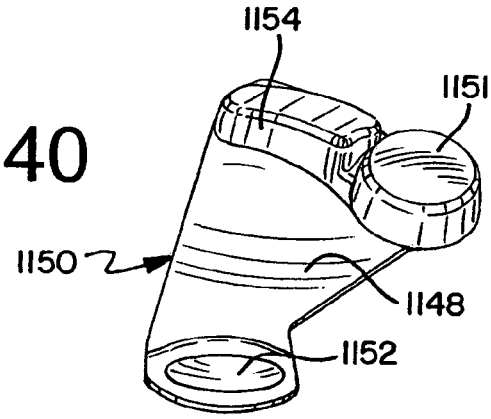
FIG. 40
FIG. 41
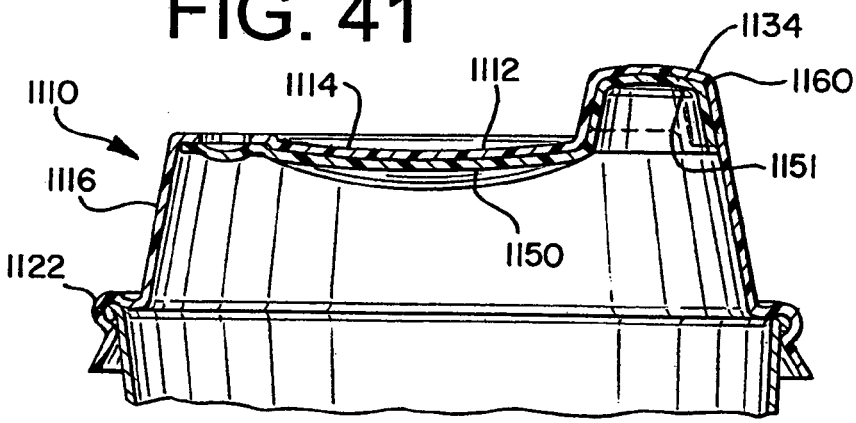

FIG. 50
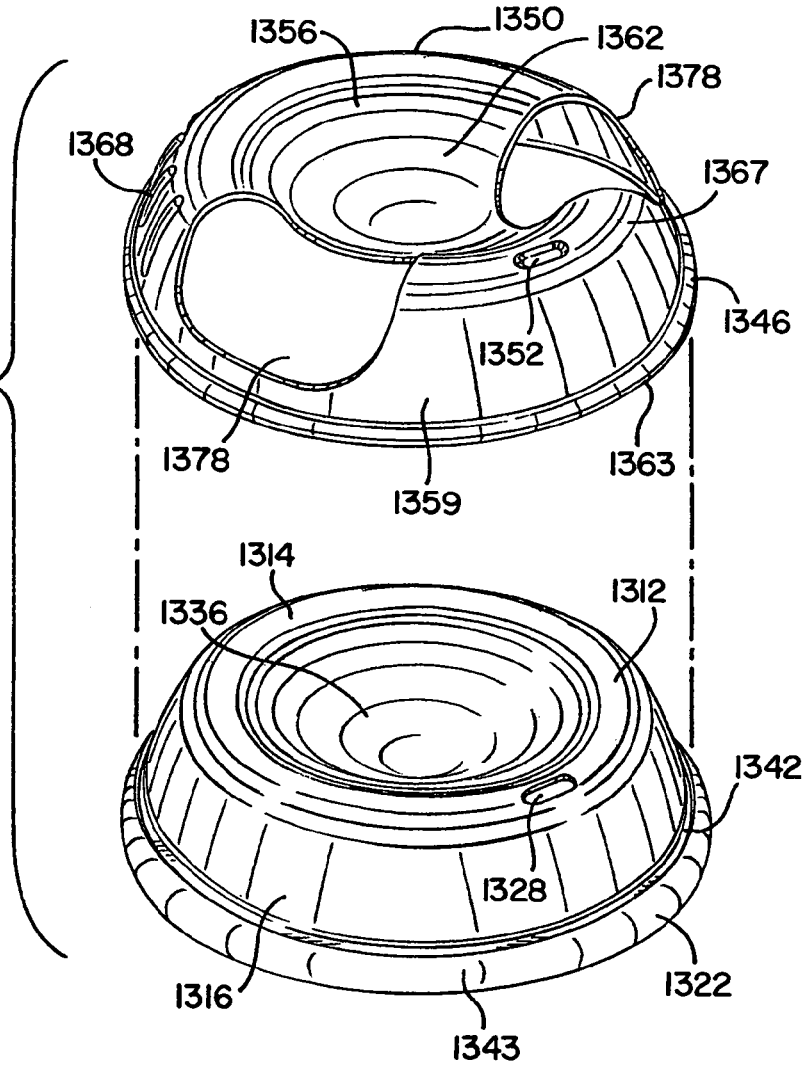
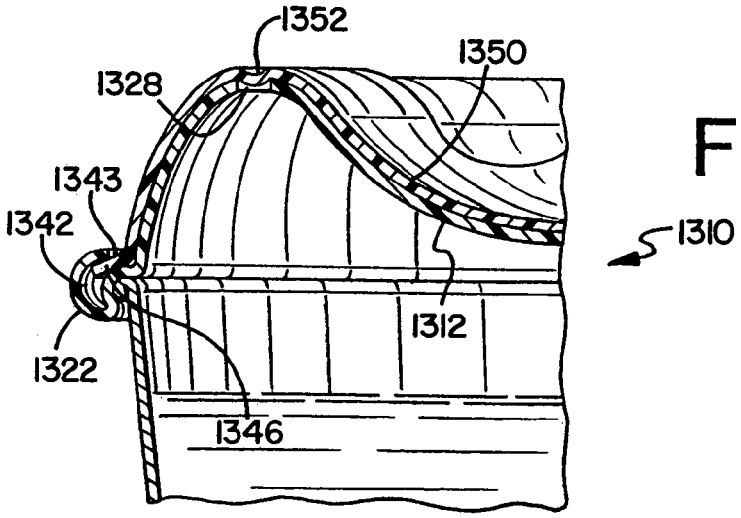
FIG. 51

FIG. 59
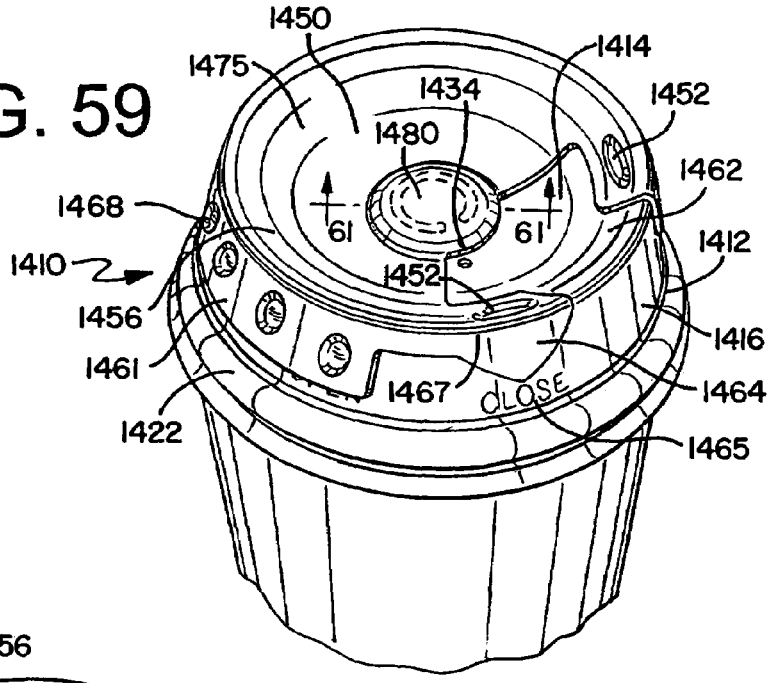
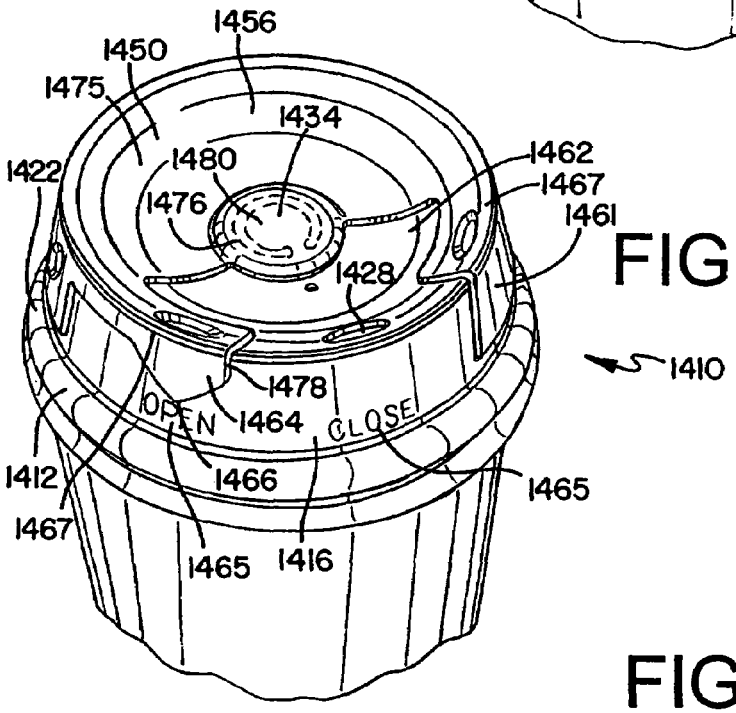
FIG. 60
FIG. 61
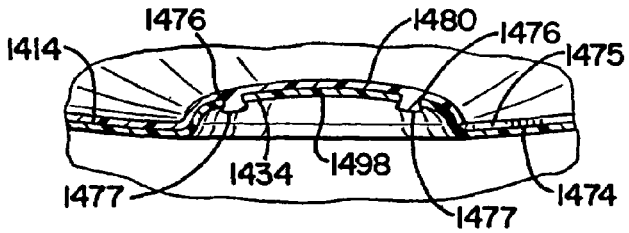

FIG. 69
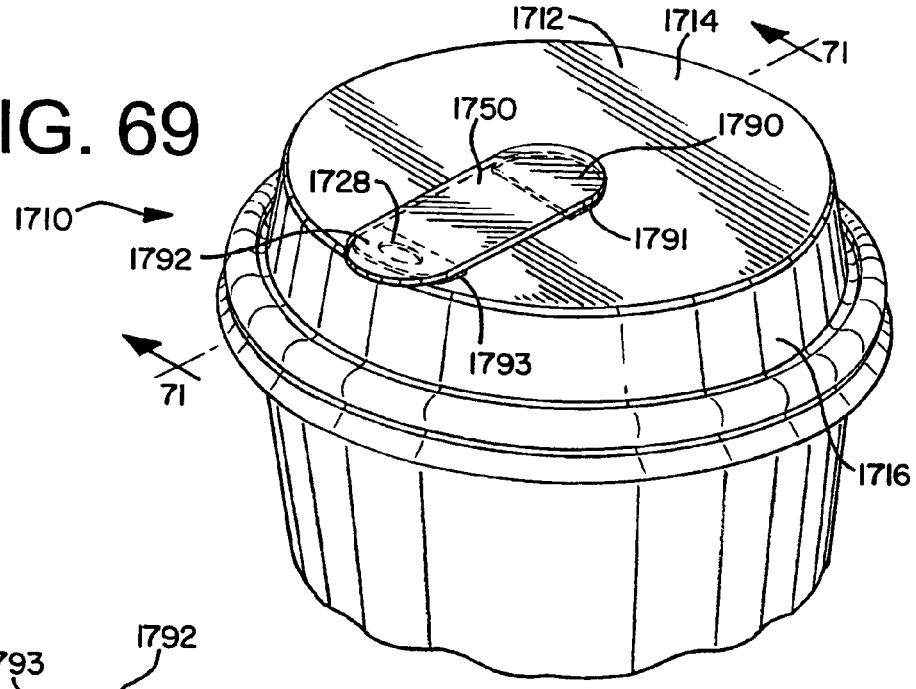
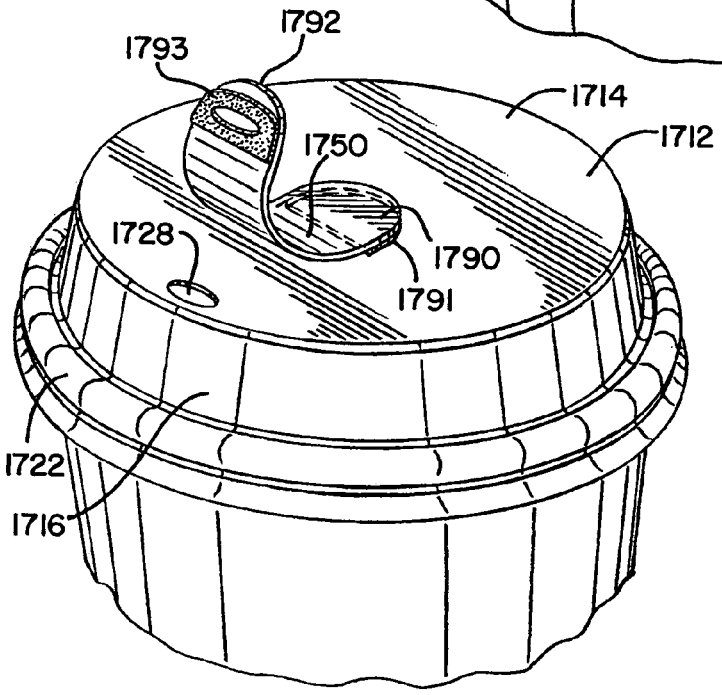
FIG. 70
1710
FIG. 71
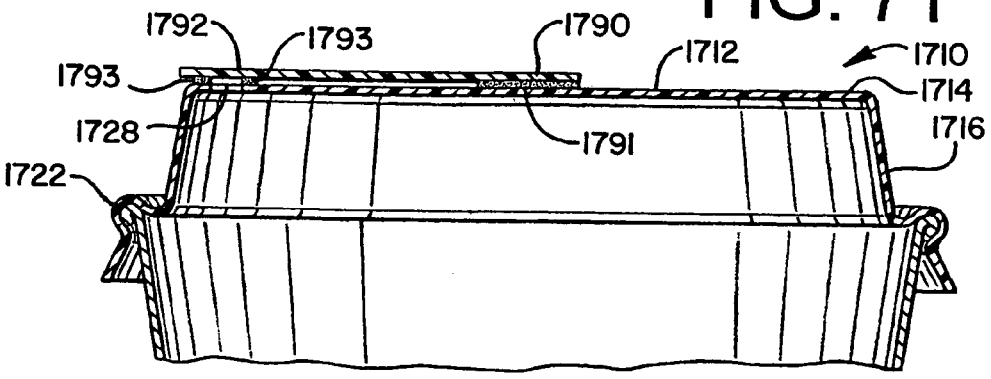

FIG. 72
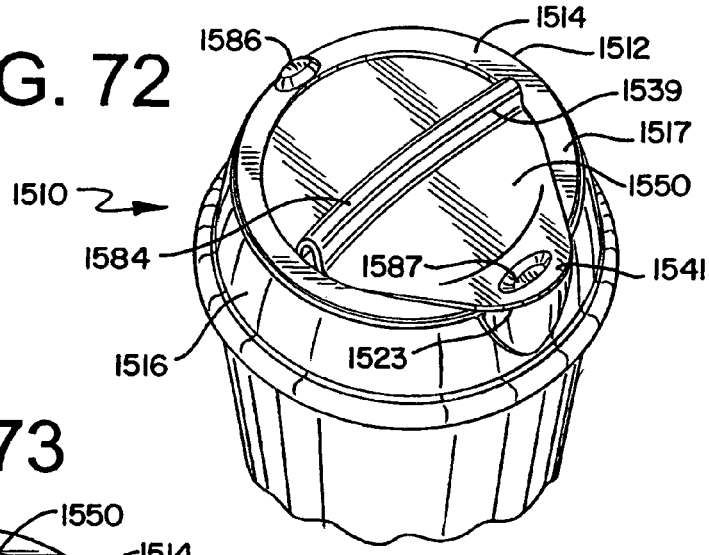
FIG. 73
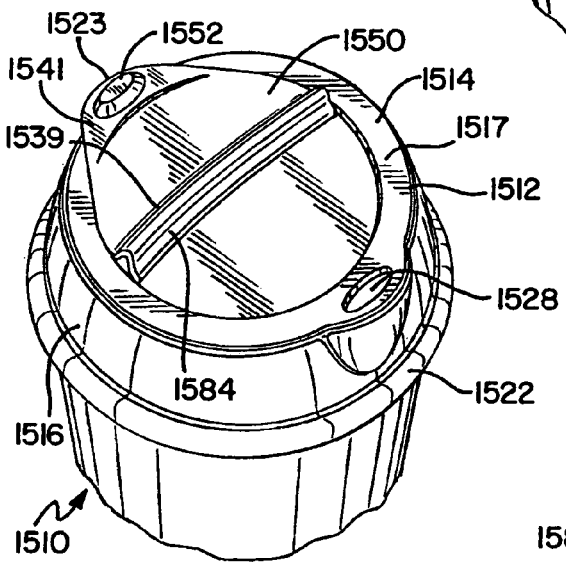
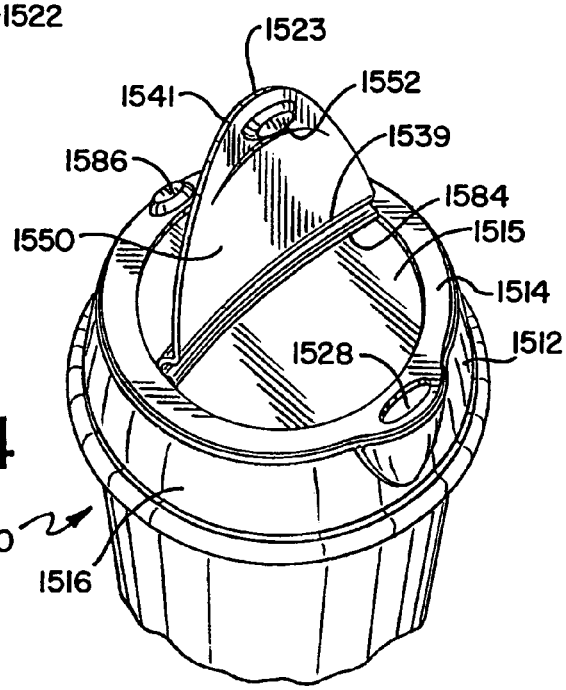
FIG. 74

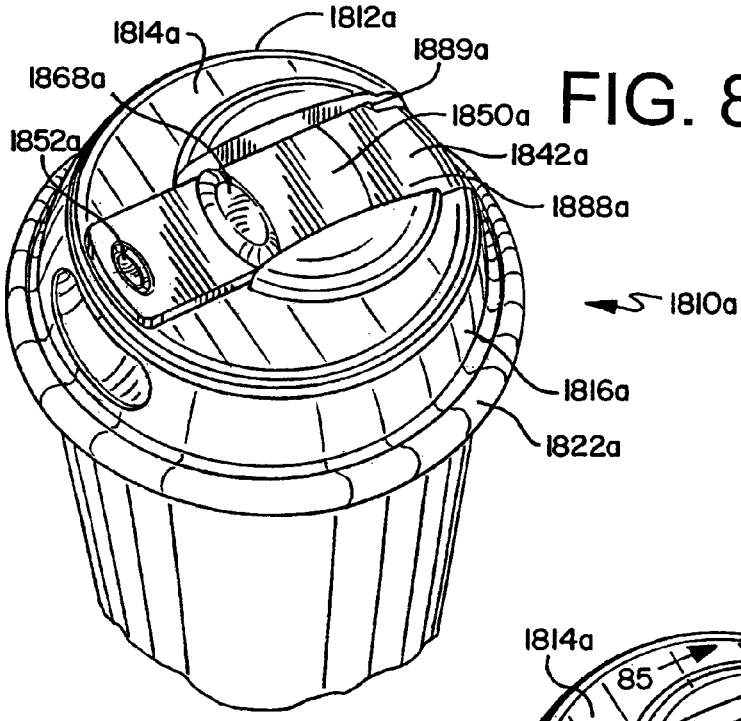
FIG. 83
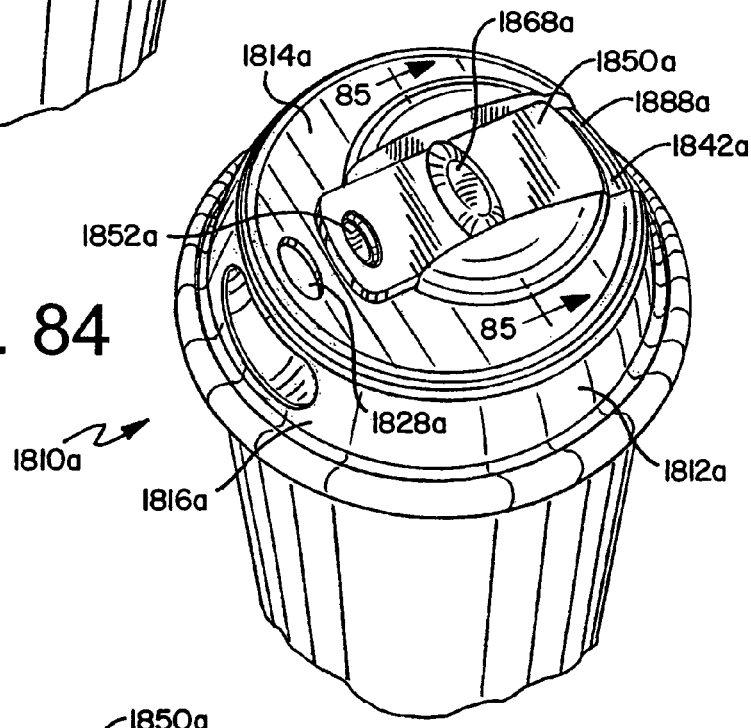
FIG. 84
FIG. 85
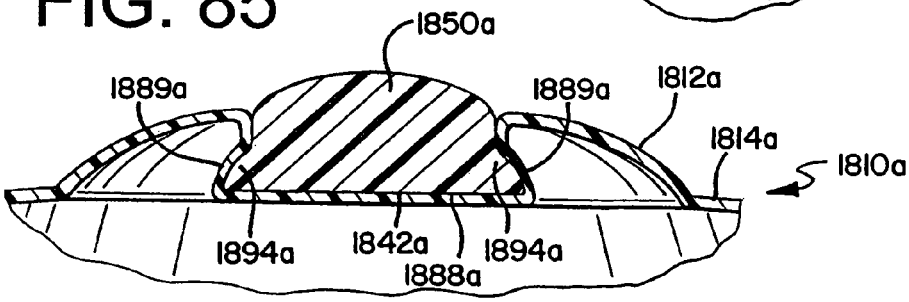

FIG. 86
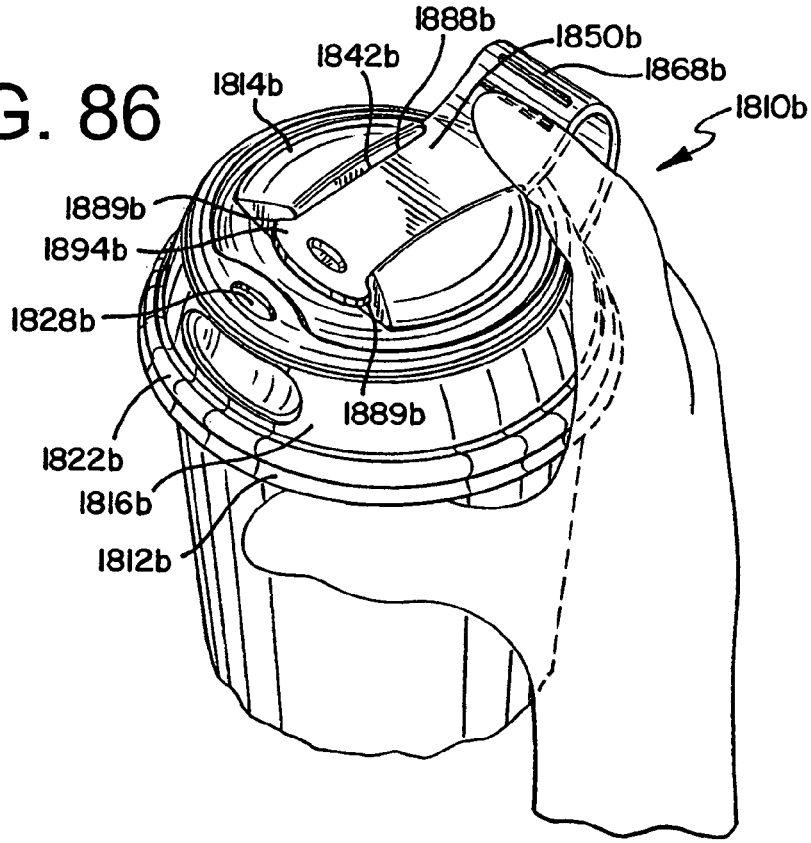
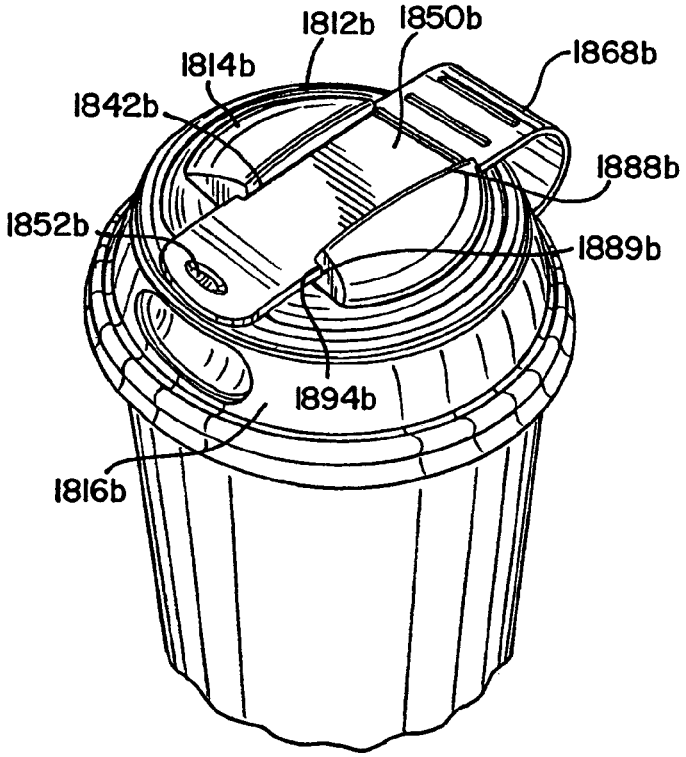
FIG. 87

FIG. 93
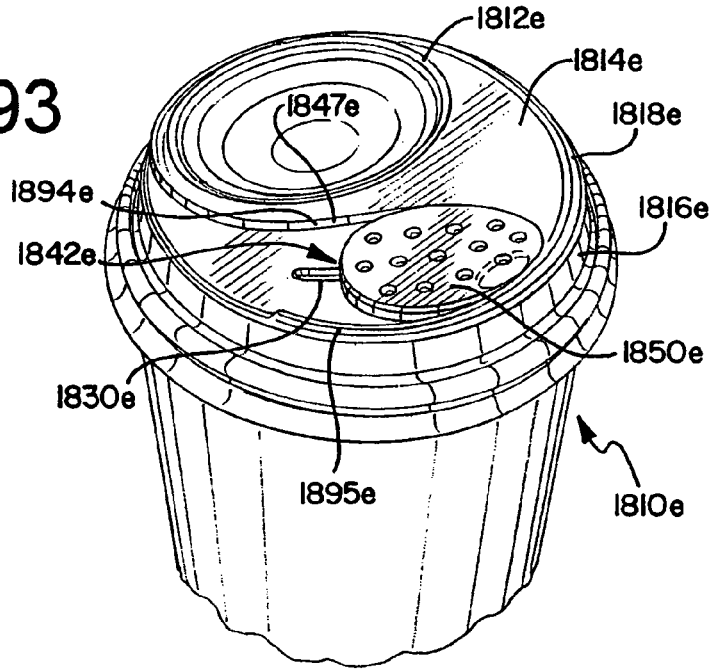
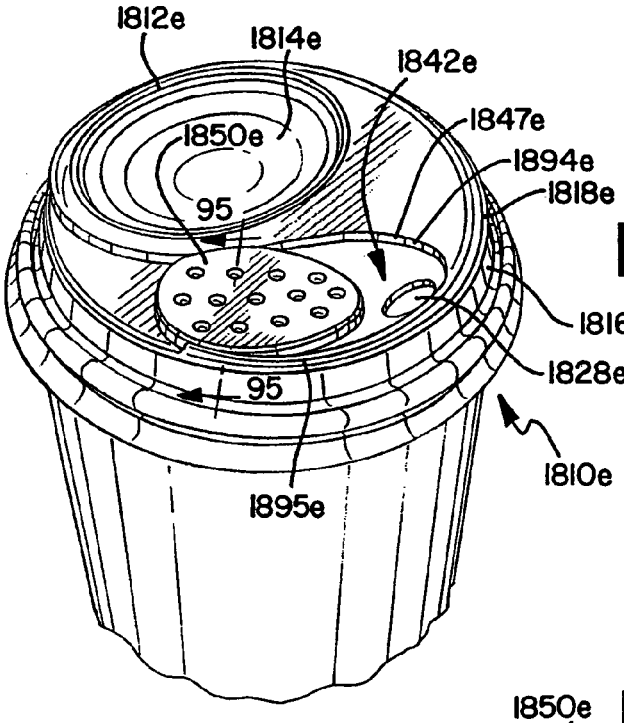
FIG. 94
FIG. 95
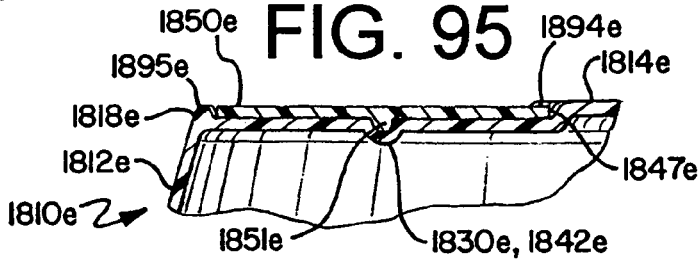

RECLOSABLE CONTAINER LID WITH SLIDING ELEMENT

CROSS-REFERENCE TO RELATED APPLICATIONS

This is a Continuation-in-Part (CIP) Application from application Ser. No. 10/622,374 (filed on Jul. 18, 2003), now U.S. Pat. No. 7,246,715 which is a Continuation-in-Part (CIP) Application from application Ser. No. 09/923,763, (filed on now Aug. 6, 2001), issued as U.S. Pat. No. 6,732,875 on May 11, 2004, which Applications are incorporated by reference and made a part hereof.

FEDERALLY SPONSORED RESEARCH OR DEVELOPMENT

Not applicable.

TECHNICAL FIELD

The present invention relates to a lid for a flowable substance container. More specifically, the present invention relates to a reclosable lid for use with a drink container.

BACKGROUND OF THE INVENTION

Lids for containers are well-known in the beverage container industry. In general terms, lids for single-use or disposable containers have three main components: a top wall or surface, a mounting portion, and an opening. Typically, the mounting portion is adapted to engage an upper rim of the container to seal the lid on the container. The opening is adapted to permit the flow of the container contents through the lid.

Existing lid designs suffer from a number of problems including untimely spillage through the opening due to the lack of a reliable means for sealing the opening. The inability to effectively seal the opening can also result in a significant loss of heat from the container contents through the opening. To address these and other problems, a number of lid designs include a movable cover portion for the opening. However, most existing movable covers lack structural integrity and as a result, do not effectively seal the opening. Also, a number of movable covers are difficult to operate due to their complex design. In addition, a vast majority of movable covers interfere with a user consuming the container contents through the opening.

U.S. Pat. No. 4,579,245 to Narushko provides an example of a container lid with a movable closing flap. The lid has a raised segment that forms a channel, which is adapted to receive the closing flap. The closing flap is a curved piece that must be inserted into the channel. The closing flap is movable between an open position and a closed position. Because the movement of the closing flap is controlled by a series of notches, grooves, tabs and handles located on the channel and the closing flap, the closing flap is difficult to operate and the effectiveness of the lid is compromised.

Another example of a lid having a movable cover for the opening is disclosed in U.S. Pat. No. 4,790,444 to Terzi. There, the hood or lid has an opening formed from a depending spout that is inserted into the container opening. The cover has exterior dimensions equivalent to the lid and is placed over the lid. The cover has an opening that must be aligned with the spout and the lid opening to form the drink passageway. The cover has a plurality of sockets, which when properly aligned, seal the lid opening. The cover is supported on the lid by a series of intricate structures and an annular gasket. Due to its complex array of structures, the lid and cover are difficult to assemble and operate. Furthermore, the array of structures can inhibit the alignment of the lid opening and the cover opening negatively affecting the formation of the drink passageway.

Therefore, there is a definite need for a reclosable container lid that reliably seals the opening. In addition, there is a need for such a lid that is easy to operate and does not interfere with a user consuming the container contents through the opening.

The present invention is provided to solve these and other problems.

SUMMARY OF THE INVENTION

The present invention relates to a reclosable lid for use with a flowable substance container. The lid has a first piece or cover, and a reclosable second piece or disk. The cover has a top wall and a side wall depending from the top wall. The side wall has a mounting portion for connecting the lid on the container. The cover includes an opening in the top wall, the opening adapted to permit the flow of the substance through the lid. The cover further includes a slot located in the top wall and a recessed portion located in both the top wall and the side wall.

The disk has at least one aperture, a post, and a projection. The aperture and the projection are each cooperatively dimensioned with the opening. The aperture is adapted to form a passageway when aligned with the opening. The post is adapted to be received by the slot in the cover. The disk is movable between a first and second position, wherein at least a portion of the projection is received in the opening in the first position and wherein the aperture is aligned with the opening in the second position. The disk has at least one well adapted to facilitate stacking the lids in a vertical configuration.

The cover includes at least one support member having a cavity extending radially inward from the side wall. The cavity of the support member forms a support ledge on an inner surface of the cover that is adapted to provide rotatable support to the disk. The disk is further supported by an internal edge that is formed on the inner surface by the recessed portion, which extends radially inward from the side wall.

The disk is movable between the first and second positions by a user engaging and actuating the post. While the disk is moved between the first and second positions, the disk is rotatably supported by the support ledge and the support edge.

In another preferred embodiment of the invention, the lid includes a cover and an overlay. The cover has a top wall and a side wall depending from the top wall. The side wall has a mounting portion for connecting the lid on the container. The lid includes an opening in the top wall, the opening adapted to permit the flow of the substance through the lid. The lid further includes a recessed portion located in both the top wall and the side wall.

The overlay has a top wall and a side wall depending from the top wall. The side wall has a mounting portion adapted to connect the overlay to the cover. Also, the overlay has a projection in the top wall and at least one aperture. In addition, the overlay has at least one gripping element adapted to facilitate rotational movement of the overlay.

The overlay and the disk are cooperatively dimensioned such that they are in rotational engagement when the overlay is positioned on the disk. The overlay is movable between a first position and a second position, wherein a portion of the projection is received in the opening in the first position and wherein the aperture is aligned with the opening in the overlay in the second position.

The overlay is movable between the first and second positions by a user engaging either the overlay or the gripping element. While the overlay is moved between the first and second positions, the overlay is rotatably supported by the engagement of the mounting portion of the cover and the mounting portion of the overlay.

According to another aspect of the invention, the lid has a tab extending radially outward from a mounting portion of the cover. The tab has a plurality of segments, including at least one sloped or angled segment. Preferably, the tab has curvilinear configuration and is integrally formed with the cover. The tab is adapted to ensure the proper assembly of the lid by fixing the position of the cover with respect to the rotatable element.

According to another aspect of the invention, the lid has a cover adapted to be attached to the container, the cover having a top wall having a generally annular upper level and a generally planar lower level, a side wall depending from the top wall, an opening in the upper level of the top wall, a slot in the lower level of the top wall, a position indicator, and a support member. The lid also has a moveable element rotatably mounted on the support member, the moveable element having an aperture and an actuator accessible through the slot.

According to another aspect of the invention, the lid has a cover adapted to be attached to the container, the cover having an opening, a slot, and a support member. The lid also has a moveable element, having a knob, an appendage, and an actuator accessible through the slot, pivotably mounted on the support member within an interior region of the cover such that the knob is received in the support member.

According to another aspect of the invention, the lid has a cover adapted to be attached to the container, the cover having an opening, a slot, a support member, and a stop. The lid also has a moveable element, having a top wall, a side wall depending from the top wall, an aperture, an actuator comprising a portion of the side wall, and a gripping element. The moveable element is rotatably mounted on the support member such that the actuator is accessible through the slot. The stop constrains rotation of the moveable element. The moveable element is moveable by manipulation of the actuator between a first position wherein the aperture is located to the left of the opening, a second position wherein the aperture is aligned with the opening, and a third position wherein the aperture is located to the right of the opening.

According to another aspect of the invention, the lid may have a position indicator to indicate when the lid is in an open position and a closed position. The position indicator may be located on one of the cover and the moveable element or a combination thereof.

According to another aspect of the invention, the lid has a cover adapted to be attached to the container, the cover having an opening and a track, and an overlay rotatably mounted on the track. The track is preferably an annular cusp and the overlay preferably has an annular flange interlocking with the annular cusp.

According to another aspect of the invention, the lid has a cover adapted to be attached to the container, the cover having a hub and an opening. The lid also has an overlay having a connector, rotatably mounted on the hub. It is understood that the overlay can take various different forms.

According to another aspect of the invention, the lid has a cover adapted to be attached to the container. The cover has a top wall, a side wall, and an opening, and a moveable element tethered to the cover. The moveable element is moveable between a first position wherein the moveable element obstructs the opening, and a second position wherein the moveable element does not obstruct the opening.

According to another aspect of the invention, the lid has a cover having a top wall and a side wall depending from the top wall. The top wall also has a first notch and a second notch. The lid also has a moveable element having a first peg and a second peg. The first peg fits pivotably within the first notch and the second peg fits pivotably within the second notch. The moveable element is pivotable between open and closed positions.

According to another aspect of the invention, the lid has a cover having an opening. The lid also has a moveable element having a first segment permanently attached to the cover by a high-tack adhesive element, and a second segment having a low-tack adhesive element thereon. The moveable element is moveable between a first position wherein the second segment obstructs the opening, and a second position wherein the second segment does not obstruct the opening. The low-tack adhesive element is releasably attached to the cover in the first position.

According to another aspect of the invention, the lid has a cover adapted to be attached to the container. The cover has a track and an opening. A moveable element is slidably mounted on the track. The moveable element is movable by sliding along the track between a first position wherein the moveable element obstructs the opening, and a second position wherein the moveable element does not obstruct the opening.

Other features and advantages of the invention will be apparent from the following specification taken in conjunction with the following drawings.

BRIEF DESCRIPTION OF THE DRAWINGS

FIG. 9 is a perspective view of an alternate embodiment of a lid of the present invention, showing a tab extending from a cover of the lid;

FIG. 10 is top plan view of the lid of FIG. 9;

FIG. 17 is a perspective view of an alternate embodiment of a lid of the present invention;

FIG. 18 is a top plan view of the lid of FIG. 17;

FIG. 21A is a partial cross-sectional view of the lid of FIG. 19 taken along line 21-21, showing the lid in a closed position;

FIG. 21B is a partial cross-sectional view of the lid of FIG. 19 taken along line 21-21, showing the lid in an open position;

FIG. 22 is top plan view of the lid of FIG. 19, showing the rotatable element;

FIG. 34 is a top plan view of the lid of FIG. 29, the lid shown in a first open position;

FIG. 35 is a top plan view of the lid of FIG. 29, the lid shown in a second open position;

FIG. 36 is a perspective view of the lid of FIG. 29, the lid shown in the second open position, with the first open position indicated by broken lines;

FIG. 39 is a perspective view of a cover of the lid of FIG. 37;

FIG. 40 is a perspective view of the moveable element of the lid of FIG. 37;

FIG. 41 is a cross-sectional view of the lid of FIG. 37, taken along lines 41-41 of FIG. 38;

FIG. 50 is an exploded view of a separated cover and overlay of the lid of FIG. 48, with connections between the cover and the overlay shown with broken lines;

FIG. 51 is a partial cross-sectional view of the lid of FIG. 48, taken along lines 51-51 of FIG. 48;

FIG. 59 is a perspective view of an alternate embodiment of the lid of the present invention, the lid shown in a closed position;

FIG. 60 is a perspective view of the lid of FIG. 59, the lid shown in an open position;

FIG. 61 is a partial cross-sectional view of the lid of FIG. 59, taken along lines 61-61 of FIG. 59;

FIG. 69 is a perspective view of an alternate embodiment of the lid of the present invention, the lid shown in a closed position;

FIG. 70 is a perspective view of the lid of FIG. 69, the lid shown in an open position;

FIG. 71 is a partial cross-sectional view of the lid of FIG. 69, taken along lines 71-71 of FIG. 69;

FIG. 72 is a perspective view of an alternate embodiment of the lid of the present invention, the lid shown in a closed position;

FIG. 73 is a perspective view of the lid of FIG. 72, the lid shown in an open position;

FIG. 74 is a perspective view of the lid of FIG. 72, the lid shown in a position half-way between the open position and the closed position;

FIG. 83 is a perspective view of an alternate embodiment of the lid of the present invention, the lid shown in a closed position;

FIG. 84 is a perspective view of the lid of FIG. 83, the lid shown in an open position;

FIG. 85 is a partial cross-section view of the lid of FIG. 83, taken along lines 85-85 in FIG. 84;

FIG. 86 is a perspective view of an alternate embodiment of the lid of the present invention, the lid shown in an open position;

FIG. 87 is a perspective view of the lid of FIG. 86, the lid shown in a closed position;

FIG. 93 is a perspective view of an alternate embodiment of the lid of the present invention, the lid shown in a closed position;

FIG. 94 is a perspective view of the lid of FIG. 93, the lid shown in an open position;

FIG. 95 is a partial cross-section view of the lid of FIG. 93, taken along lines 95-95 of FIG. 94;

DETAILED DESCRIPTION

Figure 1:
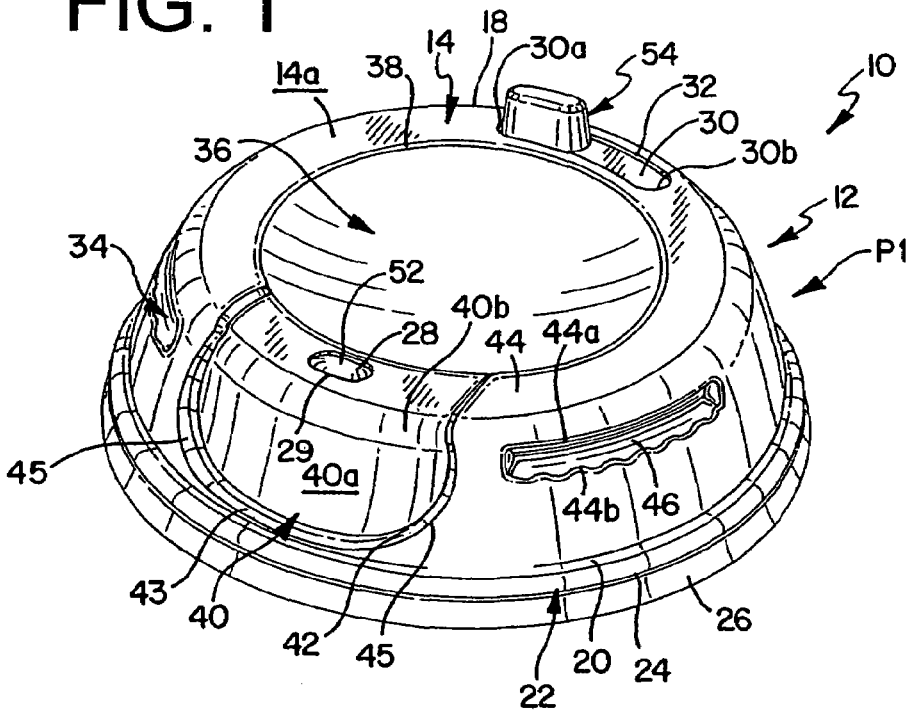
FIG. 1 is a perspective view of a reclosable lid of the present invention, showing a cover.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

A reclosable lid 10 for a container (not shown) of the present invention is illustrated in FIG. 1. The container has a central opening defining a volume that can be used to hold or contain a flowable substance, for example a liquid or a powder. The container and the lid 10 can be of either the disposable or extended use variety. FIG. 1 shows the lid 10 in the closed position wherein the lid 10 is sealed such that the flowable substance cannot flow through the lid 10. The lid 10 generally has a first piece or cover 12, and a movable second piece or disk 50 (positioned underneath cover 12 in FIG. 1).

The cover 12 of the lid 10 is adapted to span the opening in the upper portion of the container that is generally defined by an upper rim or edge of the container. For illustrative purposes, the container could be a coffee cup having an opening defined by the rim of the cup.

The cover 12 has an annular top wall 14 and a side wall 16 depending from a peripheral edge 18 of the top wall 14. Although the top wall 14 is shown as having a generally flat upper surface 14*a*, the upper surface 14*a* can be curved or angled. The side wall 16 has a side wall surface 16*a* and a lower edge 20. The side wall surface 16*a* can be curved or generally flat. The overall shape of the cover 12 is generally frustoconical, however, the cover 12 can have a number of other configurations.

A mounting portion 22 depends from the lower edge 20 of the side wall 16. The mounting portion 22 includes a generally annular flange 24 and a generally annular skirt 26. The mounting portion 22 is adapted for connecting the lid 10 to the container in a manner that seals the lid 10 on the container. Thus, the mounting portion 22 prevents leakage of the container contents between the lid 10 and the container when the lid 10 is positioned on the container. In a preferred embodiment, the mounting portion 22 is integral with the side wall 6.

An aperture or drink opening 28 is located preferably in the top wall 14. Alternatively, the drink opening is located in the side wall 16. The opening 28 is adapted to permit the passage or flow of the flowable contents held by the container through the cover 12. The opening 28 has an edge 29 that defines the shape of the opening 28. Although shown in FIG. 1 as having an obround shape, the opening 28 can have a variety of shapes, including but not limited to circular, square, or rectangular. In the closed lid position shown in FIG. 1, at least a portion of a projection 52 of the disk 50 is received by or positioned in the opening 28. Alternatively, the disk 50 has a generally planar surface that is aligned with a surface of the cover 12 proximate the opening 28 in a surface-to-surface engagement such that the opening 28 is sealed. These aspects will be described below in greater detail.

A slot or channel 30 is located preferably in the top wall 14. The slot 30 has an edge 32 that defines the shape of the slot 30. Although shown in FIG. 1 as having an obround shape, the slot 30 can have a variety of shapes, including but not limited to circular, square, or rectangular. A post 54 extends from the movable disk 50. The slot 30 is adapted to receive at least a portion of the post 54 extending through at least a portion of the slot 30. Described in a different manner, at least a portion of the post 54 extends past the top wall surface 14*a*. This aspect will also be described below in greater detail.

Figure 2:
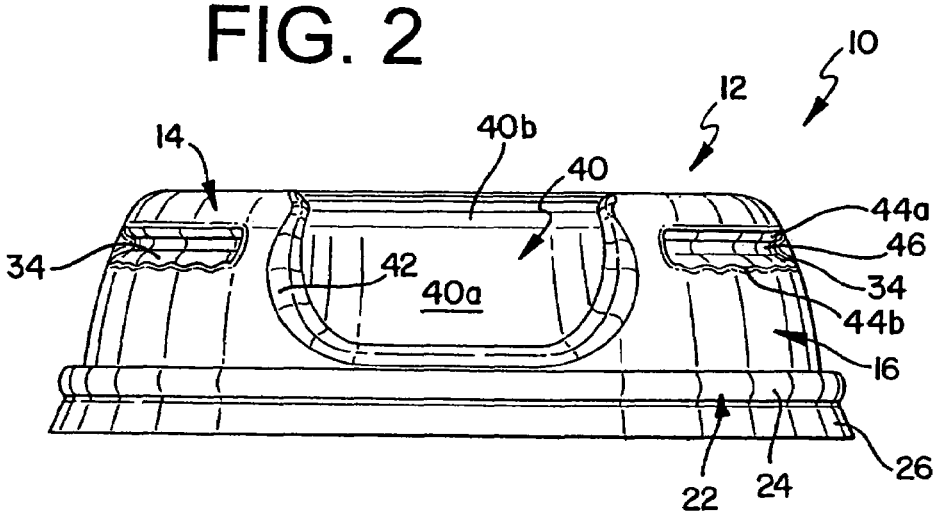
FIG. 2 is an end view of the cover of FIG. 1.

Referring to FIGS. 1 and 2, the cover 12 further comprises at least one support member 34. The support member 34 has a peripheral edge 44 that defines the shape of the support member 34. The peripheral edge 44 has an upper edge 44*a* and a lower edge 44*b*. The peripheral edge 44 can have a variety of shapes, including the linear shape of the upper edge 44*a* and the serrated shape of the lower edge 44*b*. A cavity 46 is recessed from the peripheral edge 44. Described in a different manner, the cavity 46 extends radially inward from the peripheral edge 44. As a result, at least a portion of the support member 34 extends radially inward past an inner surface of the side wall 16. The dimensions and configurations of the support member 34 and the cavity 46 can vary with design parameters, including but not limited to the overall size of the cover 12 and/or the size of the movable second piece 50. The position of the support member 34 can also vary along the height of the side wall 16. For example, the support member 34 can be positioned proximate the peripheral edge 18, or the support member 34 can be positioned closer to the mounting portion 22.

Figure 3:
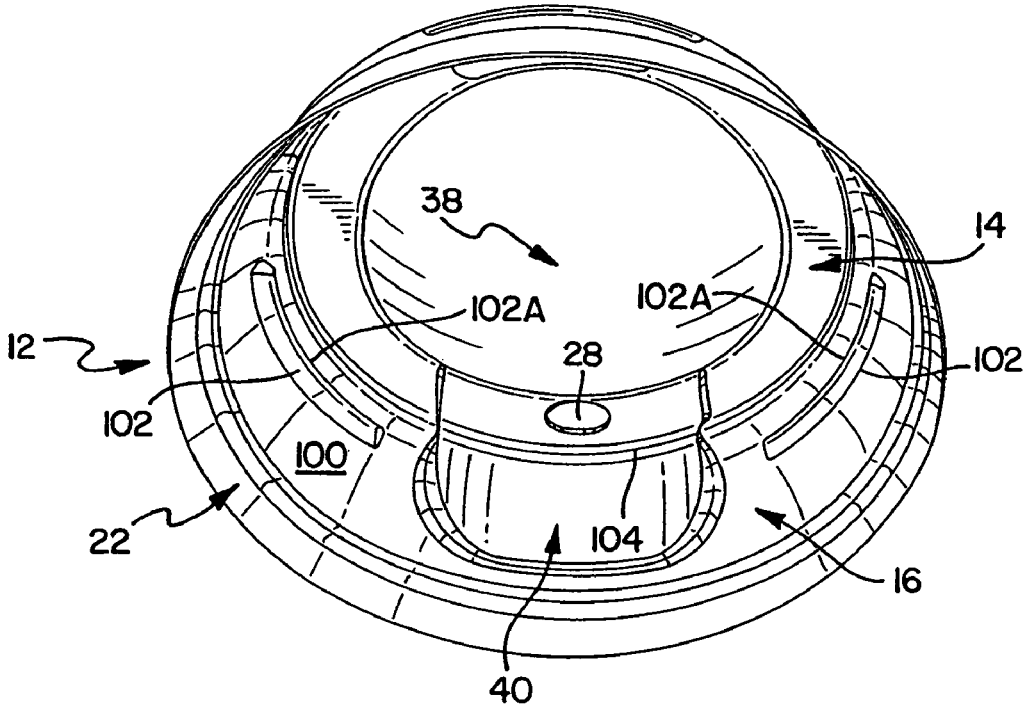
FIG. 3 is a perspective view of an interior cavity of the cover of FIG. 1.

FIG. 3 shows an interior cavity of the lid 12. At least one internal support ledge 102 is positioned on an internal surface 100 of the cover 12. The support ledge 102 is formed from the material defining the cavity 46 of the support member 34 which extends radially inward from the side wall 16. Accordingly, the material that forms the cavity 46 also forms the internal support ledge 102. The support ledge 102 has an upper edge 102*a*. Although shown having an elongated configuration, the dimensions and configurations of the support ledge 102 can vary depending upon the configuration of the support member 34 and the degree to which the support member 34 extends radially inward. The role of the support ledge 102 is fully described below.

As shown in FIG. 1, a center portion 36 is positioned radially inward from an inner edge 38 of the top wall 14. Preferably, the center portion 36 is recessed such that the center portion 36 has a curvilinear configuration when viewed in cross-section. The degree of recess or curvature of the center portion 36 can vary with the design parameters of the lid 10. Alternatively, the center portion 36 is in planar alignment with the top wall 14. In this configuration, the center portion 36 is not recessed.

Referring to FIGS. 1 and 2, the side wall 16 has a recessed portion 40, that is adapted to receive a lip of a person drinking from the container. An edge 42 of recessed portion 40 defines the configuration of the portion 40. In a preferred embodiment, the edge 42 has a generally straight base portion 43 that connects with a generally outwardly curved end segment 45 at each end. The recessed portion 40 is positioned radially inward from the side wall surface 16*a*. Although the recessed portion 40 is shown positioned on both the top wall 14 and the side wall 16, the recessed portion 40 can be limited to either the top wall 14 or the side wall 16. The shape and configuration of the recessed portion 40 can be varied to conform to numerous design parameters. Similarly, the degree of recess of the portion 40 can vary. For example, as shown in FIG. 1, the recessed portion 40 is deeper at base portion 43 and shallower at an end proximate the drink opening 28. Preferably, the recessed portion 40 is positioned about the drink opening 28. The top wall 14 and the side wall 16 cooperate to form a rounded edge 40*b* at the recessed portion 40.

Referring to FIG. 3, an internal support edge 104 is positioned in the internal surface 100 of the cover 12. The internal support edge 104 is formed from the material defining the recessed portion 40 which extends radially inward from the side wall 16. Accordingly, a portion of the material that forms the recessed portion 40 also forms the internal support edge 104. Preferably, the support edge 104 is positioned internal to and coincident with the rounded edge 40*b* of the recessed portion 40. The dimensions and configurations of the support edge 104 can vary depending upon the configuration of the recessed portion 40 and the degree to which the recessed portion 40 extends radially inward. The role of the support edge 104 is fully described below.

Figure 4:
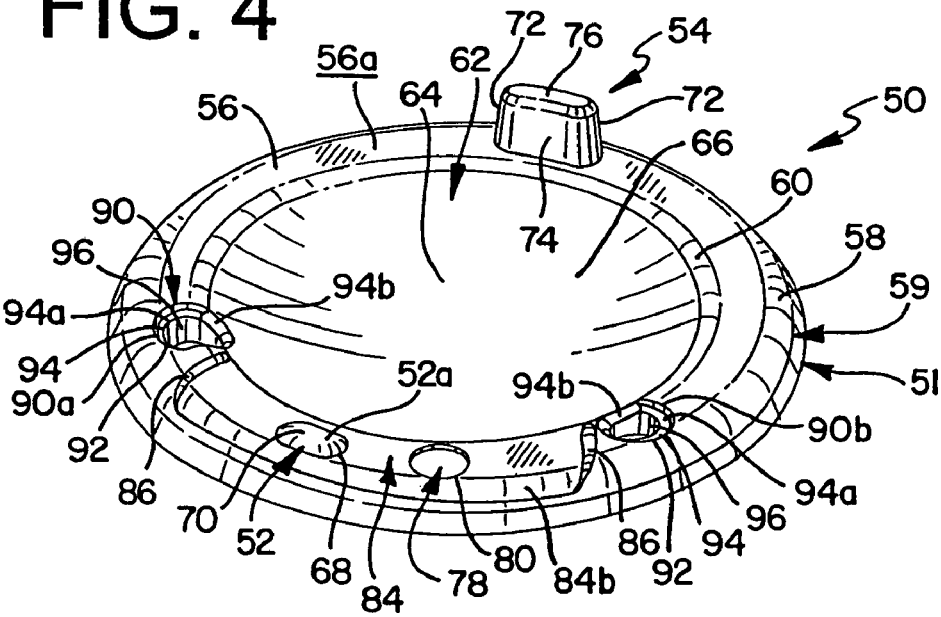
FIG. 4 is a perspective view of a movable disk of the lid of FIG. 1.

FIG. 4 shows the second piece or disk 50. The disk 50 has an outer edge 51 and a top wall 56 with a top wall surface 56*a*. The top wall 56 has an outer shoulder 58 and an inner shoulder 60. A side wall 59 depends from the outer shoulder 58. A center portion 62 extends radially inward from the inner shoulder 60. The center portion 62 comprises an annular side wall 64 and an inner portion 66. Preferably, the center portion 62 is recessed such that the center portion 62 has a curvilinear configuration when viewed in cross-section. The degree of recess or curvature of the center portion 62 can vary with the design parameters of the lid 10. Preferably, the degree of recess of the center portion 62 of the disk 50 is similar to the degree of recess of the center portion 36 of the cover 12. Alternatively, the inner portion 66 can be removed from the center portion 62 to reduce the weight and/or cost of the disk 50. In this configuration, the disk 50 has a ring-shaped configuration.

The projection 52 extends from a portion of the top wall 56. The projection 52 has a peripheral edge 68 that defines the shape of the projection 52. Preferably, the projection 52 is cooperatively dimensioned with the drink opening 28 such that at least a portion of the projection 52 is adapted to be received by or positioned in the opening 28. The projection 52 has a projection surface 52*a* that is preferably sloped or angled to facilitate reception of the projection 52 by the opening 28. When the projection 52 is completely received in the opening 28, the opening 28 is sealed and the lid 10 is in the closed position shown in FIG. 1. In the closed position, a top portion 70 of the projection 52 extends past the recessed portion surface 40*a*.

The post 54 extends from a portion of the top wall 56. As shown in FIG. 4, the post 54 has opposed end walls 72, opposed side walls 74, and a top wall 76. The post 54 can have either a solid or hollow construction depending upon design parameters. At least a portion of the post 54 is received by the slot 30 and extends past the top wall surface 14*a*. Although the configuration and dimensions of the post 54 can vary according to design parameters of the lid 10, the post 54 must retain a configuration that permits it to be received by the slot 30. As shown in FIG. 4, the post 54 has a catenoid shape. The post 54 can have a gripping portion (not shown) that is adapted to facilitate the engagement of a user's fingers with the post 54. The gripping portion can be integral to the post 54 or it can be a separate element fastened to a portion of the post 54. For example, the gripping portion can be a plastic or rubber element fastened to the walls 72, 74.

As shown in FIG. 4, the disk 50 has at least one aperture 78. The aperture 78 has a peripheral edge 80 that defines the shape of the aperture 78. When the aperture 78 is aligned with the drink opening 28, a passageway is formed between the disk 50 and the cover 12 permitting the passage or flow of the flowable substance held by the container through the lid 10. Although the aperture 78 can have a variety of configurations and dimensions, the aperture 78 is preferably cooperatively dimensioned with the drink opening 28. In a preferred embodiment, the aperture 78 is positioned within the disk 50 recessed portion 84 and spaced a distance from the projection 52. In another preferred embodiment, the disk 50 includes two separate apertures 78.

The disk recessed portion 84 is preferably positioned about the projection 52 and the aperture 78. The degree of recess of the portion 84 can vary. An edge 86 of recessed portion 84 defines the configuration of the recessed portion 84. Although the recessed portion 84 is shown positioned on a portion of both the disk side wall 59 and the disk top wall 56, the recessed portion 84 can be limited to either the side wall 59 or the top wall 56. The recessed portion 84 is adapted to be received by an inner surface of the recessed portion 40 of the cover 12 when the disk 50 is positioned proximate the cover 12. Accordingly, the shape and configuration of the recessed portion 84 of the disk 50 is similar to the shape and configuration recessed portion 40 of the cover 12. The top wall 56 and the side wall 59 cooperate to form a rounded edge 84*b* at the recessed portion 84.

As further shown in FIG. 4, the disk 50 has at least one well 90 depending from a portion of the disk 50. The disk 50 has a first well 90*a* and a second well 90*b* in one preferred embodiment. The well 90 can depend from either the top wall 56 or the side wall 59, or therebetween. The well 90 has an outer edge 92 that defines the general shape of the well 90. A shoulder 94 depends from the outer edge 92. The shoulder 94 can have a curvilinear portion 94*a* and a generally linear portion 94*b*. An inner wall 96 depends from the shoulder 94. As shown in FIG. 4, the inner wall 96 has a generally annular configuration resulting in a generally tubular well configuration. However, the well 90 can have a variety of configurations depending upon design parameters. Preferably, the well 90 has a bottom wall (not shown). Alternatively, the bottom wall is omitted, causing the well 90 to have a hollow, tubular configuration.

The first and second wells 90*a*, 90*b* can be positioned at various locations in the disk 50. Preferably, the first and second wells 90*a*, 90*b* are spaced a distance apart. The first well 90*a* and the second well 90*b* have the same dimensions and configurations. The depth or length of the well 90, as measured from a lower surface (not shown) of the disk 50 can vary. Similarly, the number and dimensions of the well 90, including the diameter, can vary with the numerous design parameters.

A drain hole (not shown) can be positioned in the disk 50, preferably in the center portion 62. When the flowable contents, i.e., liquid, accumulate between an interior surface of the cover 12 and the disk 50, the drain hole ensures the drainage of such contents into the container.

Referring to FIG. 1, the disk 50 and the cover 12 are cooperatively dimensioned such that the disk 50 can be positioned within an interior portion of the cover 12 to define an "assembled position." Referring to FIG. 3, in the assembled position, the disk 50 is rotatably supported by at least one support ledge 102 which is formed by the support member 34 extending radially inward as explained above. Specifically, a portion of the edge 51 of the disk 50 rotatably engages the support ledge 102. The disk 50 can be further rotatably supported by the interior edge 104 of the recessed portion 40. Although the cover 12 is shown in one preferred embodiment as having three support members 34 and three corresponding support ledges 102, the number and configuration of the members 34 and the ledges 102 can vary with the design parameters.

In the assembled position, the disk 50 is positioned proximate the cover 12 such that at least a portion of the post 54 is received by and extends through the slot 30. Described in a different manner, the disk 50 is positioned beneath the cover 12 such that the center portion 36 of the cover 12 is proximate the center portion 62 of the disk 50.

In the assembled position, the disk 50 is movable between a first position P1 and a second position P2. In the first position P1, as shown in FIG. 1, the projection 52 is received by the drink opening 28 such that the opening 28 is sealed and the lid 10 is closed. When the opening 28 is sealed, the edge 29 of the opening 28 is in frictional engagement with the projection 52. The top portion 70 of the projection 52 can extend past the edge 29 of the drink opening 28. This seal prevents the flow of the flowable substance in the container through the opening 28, enabling the container and lid 10 to be moved without risking spillage. Also, in the first position P1, the recessed portion 84 of the disk 50 is engaged with the recessed portion 40 of the cover 12. In addition, in the first position P1, the aperture 78 is misaligned or offset from the opening 28. Alternatively, the projection 52 and the opening 28 are in a snap fit engagement wherein each have sufficient structure to enable the snap fit engagement. Other cooperating structures can also be utilized.

In an alternate configuration of the disk 50, the projection 52 is omitted and the disk 50 has a generally planar surface (not shown). In the first position P1, the planar surface of the disk 50 is aligned with the opening 28 in a surface-to-surface engagement such that the opening 28 is sealed.

In the second position P2, a user engages the post 54 to rotate the disk 50 wherein the aperture 78 is aligned with the drink opening 28 to form a passageway between the disk 50 and the cover 12 wherein the lid 10 is open. The passageway permits the passage or flow of the flowable substance held by the container through the lid 10. When the lid 10 is in the second position P2, at least a portion of the edge 80 of the aperture 78 is aligned with at least a portion of the edge 29 of the drink opening 28. Also, in the second position P2, the recessed portion 84 of the disk 50 is misaligned or offset from the recessed portion 40 of the cover 12. In addition, in the second position P2, the projection 52 is misaligned or offset from the opening 28. When the aperture 78 is partially aligned with the drink opening 28, the passageway remains but its dimensions are reduced. When the aperture 78 is completely misaligned with the drink opening 28, the passageway is eliminated. When the aperture 78 is completely misaligned with the drink opening 28 and the projection 52 is completely received in the opening 28, the opening 28 is sealed and the lid 10 is in the first position P1.

When the disk 50 is moved between the first position P1 and the second position P2, a portion of the edge 51 of the disk 50 remains in rotatable engagement with the support ledge 102. Accordingly, the support ledge 102 provides support to the disk 50 such that the disk 50 remains in the assembled position during movement between the first and second positions, P1, P2. When the cover 12 includes a plurality of support ledges 102, a greater portion of the edge 51 of the disk 50 remains in rotatable engagement with the support ledges 102. The edge 104 of the recessed portion 40 provides additional support for the disk 50 as it is moved between the first and second positions P1, P2.

A user can move the disk 50 between the first position P1 and the second position P2 by grasping and actuating or manipulating the post 54 between the first end 30*a* of the slot 30 and the second end 30*b* of the slot 30. Referring to FIG. 1, when the post 54 is proximate the first end 30*a*, the disk 50 is in the first position P1. Conversely, when the post 54 is proximate the second end 30*b*, the disk 50 is in the second position P2. The post 54 can be located in a number of positions between the first and second ends 30*a*, 30*b* and as a result, the projection 52 can be misaligned with the opening 28 to varying degrees.

The disk 50 can be rotated or moved a varying amount depending upon the numerous design parameters of the lid 10, including but not limited to the configuration and dimensions of the post 54 and the slot 30. Thus, the disk 50 assumes a number of positions and those positions depend upon the location of the post 54 relative to the slot 30. The movement of the disk 50 and the post 54 is ultimately constrained by the first and second ends 30*a*, 30*b* of the slot 30.

The lid 10 is adapted to permit a user to move the post 54 between the first and second positions P1, P2 with only one hand. This means that a user can hold the container and manipulate the post 54 with the same hand. This increases the flexibility and the commercial value of the lid 10.

As explained above, the disk 50 can have two separate apertures 78, wherein the apertures 78 are positioned about the projection 52. In this configuration, the disk 50 can be rotated in either a clockwise or counter-clockwise direction to move the disk 50 between the first position P1 and the second position P2. For example, rotating the disk 50 in the clockwise direction brings one aperture 78 into alignment with the opening 28, while rotating the disk in the counter-clockwise direction brings the other aperture 78 into alignment with the opening 28. This feature further increases the flexibility and the commercial value of the lid 10. In such configuration, the length of the slot 30 is increased to allow for counterclockwise rotation of the disk 50 such that both apertures 78 can be aligned with the opening 28.

The lid 10 is adapted to be used without the disk 50. This means that the cover 12 is connected to a container but the disk 50 is omitted. In this configuration, there is no slot 30 and there is no structure to seal the opening 28 in the cover 12 and as a result, the flowable substance held by the container can pass through the lid 10. In this configuration, the recessed portion 40 remains positioned on both the top wall 14 and the side wall 16. However, the drink opening 28 can be positioned in either the top wall 14 or the side wall 16.

The opening 28 can be formed with a range of dimensions. At a minimum, the opening 28 should have dimensions sufficient to permit the passage of the flowable substance held by the container and receive the projection 52. The slot 30 can be formed with a range of dimensions. At a minimum, the slot 30 should have dimensions sufficient to receive and permit the movement of the post 54.

The opening 28 can be located at various positions along the top wall 14 depending upon design parameters. Similarly, the slot 30 can be located at various positions along the top wall 12. The opening 28 and the slot 30 are spaced a distance apart. Preferably, the opening 28 and the slot 30 are opposed on the top wall 12, meaning that they are positioned approximately 180 degrees apart. Alternatively, the post 54 is located on the sidewall 59 of the disk 50, and the slot 30 is cooperatively located on the sidewall 16 of the cover 12. In this configuration, a user moves the lid 10 between the first and second positions P1, P2 by engaging the post 54 that extends through the slot 30 positioned on the side wall 16 of the cover 12.

Although shown as having a generally circular shape, the lid 10, including the mounting portion 22, the flange 24 and the skirt 26, can have numerous configurations. For example, the lid 10 could have a rectangular, square, or oval shape. To ensure a leak-proof seal with the container, the shape of the mounting portion 22 should match the shape of the upper edge of the container so a cooperative sealing engagement can be achieved.

Alternatively, the mounting portion 22 could have a shape similar to the upper edge of the container, yet dissimilar from the shape of the side wall 16 and the top wall 14. For example, the mounting portion 22 could have an annular shape consistent with the container shape and the walls 14, 16 could have a non-annular shape.

Unlike prior art designs, the dimensions and the configuration of the opening 28 are not affected by the engagement and disengagement of the projection 52 as the disk 50 is moved between the first and second positions P1, P2. This attribute allows a user to repeatedly move the disk 50 between the first position and second position. Accordingly, the structural integrity and the durability of the lid 10 are increased.

The well 90 is adapted to aid in the storage and/or stacking of the disk 50 prior to the disk 50 and cover 12 being placed in the assembled position. Specifically, the well 90 is adapted to ensure that multiple disks 50 remain stacked in a stable vertical configuration prior to assembly of the lid 10. A portion of the well 90 of a first disk 50 engages a portion of well 90 of an adjacent second disk 50 positioned below the first disk 50. Accordingly, the well 90 should have a depth or length sufficient to permit it to engage a portion of the well 90 of the second disk 50. In an alternative configuration, the well 90 can be randomly placed wherein the well 90 of the first disk would rest on the top wall 56 of the second disk 50.

The well 90 is further adapted to aid in the storage and/or stacking of the assembled lid 10. Specifically, the well 90 is adapted to ensure that multiple lids 10 remain stacked in a stable vertical configuration. A portion of the well 90 of a first lid 10 engages a portion of an adjacent cover 12 of a second lid 10 positioned below the first lid 10. Accordingly, the well 90 should have a depth or length sufficient to permit it to engage a portion of the cover 12. The engagement of the well 90 with a portion of the cover 12 stabilizes the first and second lids 10 in their vertical position. The engagement of the well 90 with a portion of the cover 12 prevents the first and second lids 10 from becoming destabilized and/or misaligned.

The lid 10 can be formed by a variety of manufacturing processes, such as injection molding or a thermoforming operation, preferably vacuum forming and/or pressure forming. The cover 12 is preferably formed from plastic, however, other lightweight materials can be used to form the cover 12. After the manufacturing process has been completed, the drink opening 28 and the slot 30 may be formed in the cover 12 with a punch and die.

Preferably, the disk 50 is formed from the same material used to form the cover 12. However, the disk 50 can be formed from other lightweight materials. After the manufacturing process has been completed, the aperture 78 may be formed in the disk 50 with a punch and die.

The lid 10 can include a color-based system for indicating the status of the lid 10. Under the color-based system, a portion of the lid 10 would display a first color, e.g., red, when the lid 10 is closed in the first position P1. Similarly, a portion of the lid 10 would display a second color, e.g., green, when the lid 10 is open in the second position P2. The first and second colors would be displayed in a visible portion of the lid 10 such that a user of the lid 10 could readily ascertain the status of the lid 10. Referring to FIGS. 1 and 4, the first color is positioned on the disk 50 to the right of the post 54 and the second color is positioned on the disk 50 to the left of the post 54. Accordingly, when the lid 10 is in the closed position P1 shown in FIG. 1, the first color is visible through the slot 30. Conversely, when the lid 10 is in the open position P2, the second color is visible through the slot 30. In this manner, a user can verify the status of the lid 10 by simply looking at the color indicator displayed through the slot 30. As a result, the utility and marketability of the lid 10 is increased.

In an alternate color-based system configuration, the first color is positioned on the projection 52 wherein it is visible when the lid 10 is in the closed position P1. The second color is positioned on the edge 80 about the aperture 78 wherein it is visible when the lid 10 is in the open position P2. In this manner, a user can verify the status of the lid 10 by simply looking at the color indicator displayed in the opening 28.

Figure 5:
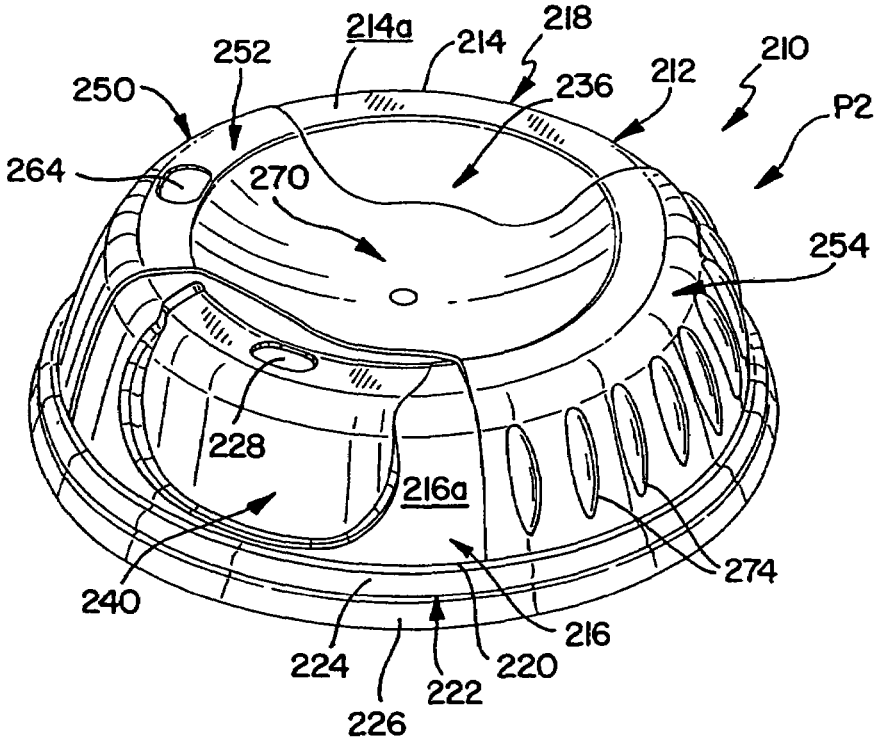
FIG. 5 is a perspective view of an alternate embodiment of a lid of the present invention, showing the lid in an open position.

FIGS. 5-8 disclose another preferred embodiment of the lid of the present invention. As shown in FIG. 5, the reclosable lid 210 generally includes a first piece or cover 212, and a movable second piece or overlay 250. FIG. 5 shows the lid 210 in the open position wherein the flowable substance can flow or pass through the lid 210 via opening 228.

Figure 6:
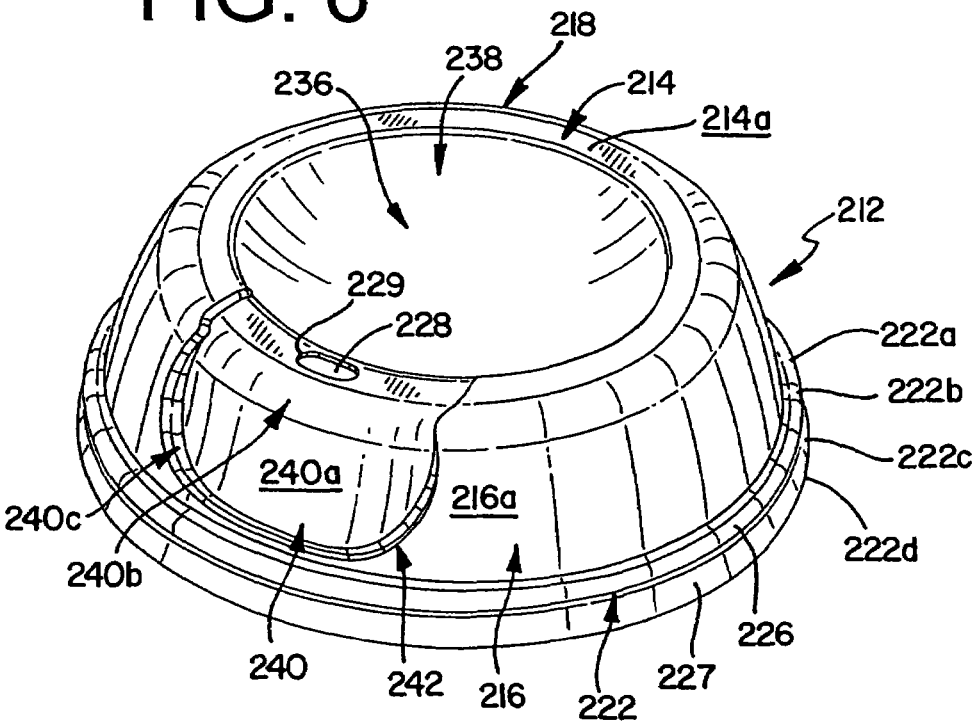
FIG. 6 is a perspective view of a cover of the lid of FIG. 5.

Referring to FIGS. 5 and 6, the cover 212 is adapted to span the opening in the upper portion of the container (not shown) that is generally defined by an upper rim or edge of the container. The cover 212 has an annular top wall 214 and a side wall 216 depending from an outer or peripheral edge 218 of the top wall 214. Although the top wall 214 is shown as having a generally flat upper surface 214*a*, the upper surface 214*a* can be curved or angled. The side wall 216 has a side wall surface 216*a* and a lower edge 220. The side wall surface 216*a* can be curved, angled, or generally flat. The overall shape of the cover 212 is generally frustoconical, however, the cover 212 can have a number of other configurations.

A mounting portion 222 depends from the lower edge 220 of the side wall 218. The mounting portion 222 includes a generally annular flange 224 and a generally annular skirt 226. The mounting portion 222 is adapted for connecting the lid 210 to the container in a manner that seals the lid 210 on the container. Thus, the mounting portion 222 prevents leakage of the container contents between the lid 210 and the container when the lid 210 is positioned on the container. In a preferred embodiment, the mounting portion 222 is integral with the side wall 16.

An aperture or drink opening 228 is located preferably in the top wall 216. Alternatively, the drink opening 228 is located in the side wall 216. The opening 228 is adapted to permit the passage or flow of the flowable contents held by the container through the cover 212. The opening 228 has an edge 229 that defines the shape of the opening 228. Although shown in FIG. 6 as having an obround shape, the opening 228 can have a variety of shapes, including but not limited to circular, square, or rectangular.

The opening 228 can be formed with a range of dimensions. At a minimum, the opening 228 should have dimensions sufficient to permit the passage of the flowable substance held by the container. The opening 228 can be located at various positions along the top wall 214 depending upon design parameters.

As shown in FIG. 6, a center portion 236 is positioned radially inward from an inner edge 238 of the top wall 214. Preferably, the center portion 236 is recessed such that the center portion 236 has a curvilinear configuration when viewed in cross-section. Described in a different manner, the center portion 236 has a concave shape when the portion 236 is viewed from a point above the lid 210. The degree of recess or curvature of the center portion 236 can vary with the design parameters of the lid 210.

Referring to FIGS. 5 and 6, the side wall 216 has a recessed portion 240 that is adapted to receive a lip of a person drinking from the container. An edge 242 of recessed portion 240 defines the configuration of the portion 240. The recessed portion 240 and the recessed surface 240*a* are positioned radially inward from the side wall surface 216*a*. Although the recessed portion 240 is shown positioned on both the top wall 214 and the side wall 216, the recessed portion 240 can be limited to either the top wall 214 or the side wall 216. The shape and configuration of the recessed portion 240 can be varied to conform to numerous design parameters. Similarly, the degree of recess of the portion 240 can vary. Preferably, the recessed portion 240 is positioned about the drink opening 228. The top wall 214 and the side wall 216 cooperate to form a rounded edge 240*b* at the recessed portion 240.

Figure 7:
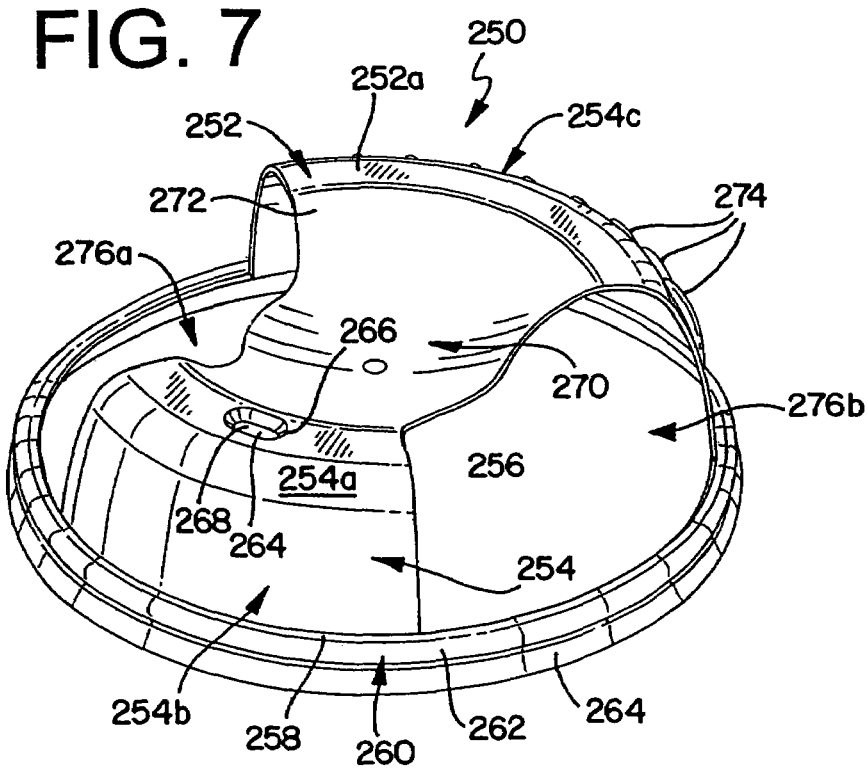
FIG. 7 is a perspective view of an overlay of the lid of FIG. 5.

As shown in FIGS. 5 and 7, the overlay 250 is a discontinuous structure adapted to be positioned about the cover 212. The overlay has a top wall 252 and a side wall 254 depending from an outer or peripheral edge 256 of the top wall 252. Although the top wall 252 is shown as having a generally flat upper surface 252*a*, the upper surface 252*a* can be curved or angled. The side wall 254 has a side wall surface 254*a* and a lower edge 258. The side wall surface 254*a* can be curved, angled or generally flat.

A mounting portion 260 depends from the lower edge 258 of the side wall 254. The mounting portion 260 includes a generally annular flange 262 and a generally annular skirt 264. The mounting portion 260 is adapted for rotatably connecting the overlay 250 to the mounting portion 222 of the cover 212 such that the overlay 250 and the cover 212 are in rotatable engagement. The mounting portions 222, 260 are cooperatively dimensioned such that the overlay 250 can be positioned about the cover 212 wherein the overlay 250 can be rotatably moved with respect to the cover 212. The mounting portions 222, 260 have a generally annular configuration. Alternatively, the mounting portions 222, 260 could have a configuration with angular or linear segments.

Preferably the mounting portions 222, 260 have a continuous configuration, as shown in FIGS. 5-8. Alternatively, the mounting portions 222, 260 have a discontinuous configuration, meaning that the portions 222, 260 have material removed that results in a notched configuration.

As shown in FIG. 7, the overlay 250 has a projection 264 that is located preferably in the top wall 252. Alternatively, when the drink opening 228 is positioned in the side wall 216 of the cover 212, the projection 264 is cooperatively positioned in the side wall 254 of the overlay 250. The projection 264 depends from a lower or inner surface (not shown) of the top wall 252. The projection 264 has a peripheral edge 266 that defines the shape of the projection 264. Preferably, the projection 264 is cooperatively dimensioned with the drink opening 228 such that at least a portion of the projection 264 is adapted to be received by or positioned in the opening 228. When the projection 264 is completely received in the opening 228, the opening 228 is sealed and the lid 210 is in the closed position shown in FIG. 8. In the closed position, a bottom wall 268 of the projection 264 extends past the top wall surface 214*a*.

As further shown in FIG. 7, a center portion 270 is positioned radially inward from an inner edge 272 of the top wall 252. Preferably, the center portion 270 is recessed such that the center portion 270 has a curvilinear configuration when viewed in cross-section. Described in a different manner, the center portion 270 has a concave shape when the portion 270 is viewed from a point above the lid 210. The degree of recess or curvature of the center portion 270 can vary with the design parameters of the lid 210. Alternatively, the center portion 270 is in planar alignment with the top wall 252. In this configuration, the center portion 270 is not recessed.

The overlay 250 has at least one gripping element 274 positioned on a portion of the side wall 254. The gripping element 274 is adapted to facilitate rotational movement of the overlay 250. Accordingly, a user engages the element 274 to aid in the rotation of the overlay 250. Although shown as having a generally elongated configuration, the element 274 can have a wide range of configurations and dimensions. In addition, the gripping element 274 can be positioned on the side wall 254, the top wall 252 or on a portion of both the side wall 254 and the top wall 252. Alternatively, the gripping element 274 is positioned on a portion of the mounting portion 260. The gripping element 274 can be integral to the overlay 250 or it can be a separate element fastened to a portion of the overlay 250. For example, the gripping portion can be a plastic or rubber element fastened to the overlay 250.

The overlay 250 can have alternate structures for facilitating movement of the overlay 250. For example, the overlay 250 could have a post or a ring extending from a portion of the overlay 250, each adapted for a user to engage and rotate the overlay 250.

Figure 8:
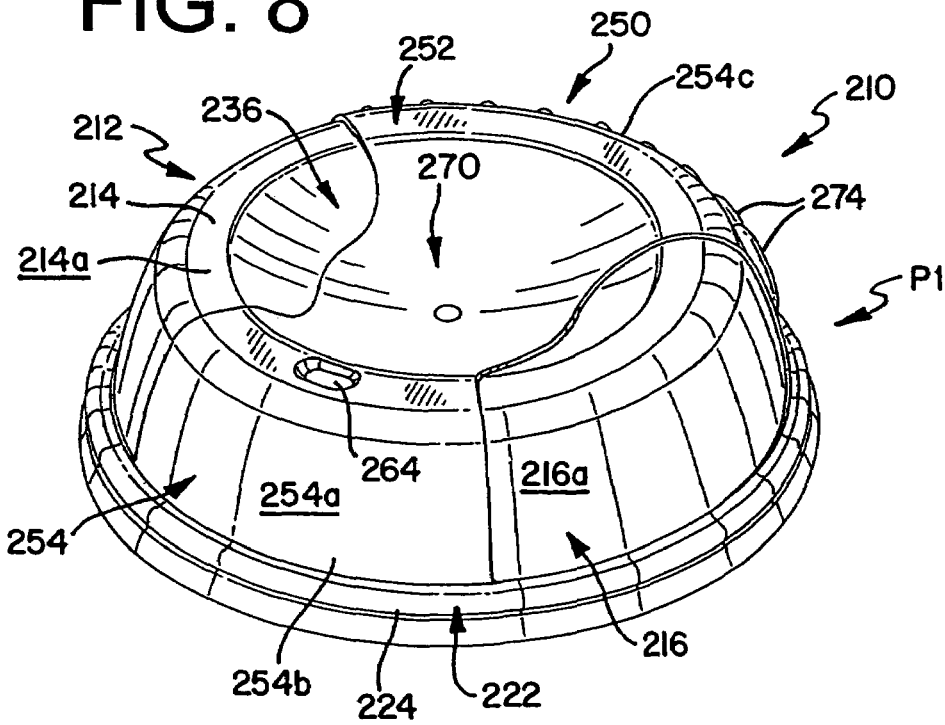
FIG. 8 is a perspective view of the lid of FIG. 5, showing the lid in a closed position.

As shown in FIGS. 5, 7 and 8, and as explained above, the overlay 250 has a discontinuous structure, meaning that neither the top wall 252 nor the side wall 254 are continuous along the circumference of the cover 250. As a result, the overlay has a first side wall portion 254*b* and a second side wall portion 254*c*. When the projection 264 is located in a portion of the top wall 252, the projection 264 is positioned proximate either of the side wall portion 254*b* or the second side wall portion 254*c*. Preferably, the gripping element 274 is positioned on the other of the wall portion 254*b* or the second side wall portion 254*c*. Alternatively, the gripping element 274 is positioned on the side wall portion 254*b*, 254*c* proximate the projection 264.

Due to its discontinuous configuration, the overlay 250 has an aperture 276. In one preferred embodiment, the overlay 250 has two aperture 276 wherein the portion of the overlay 250 above the mounting portion 262 has a generally hourglass shape. The configuration and dimensions of the aperture 276 can vary greatly with the design parameters of the lid 210. Referring to FIG. 7, the overlay 250 has two separate apertures 276*a*, 276*b*. Each of the apertures 276*a,b* span a portion of the side wall 254, the top wall 252 and the center portion 270. Alternatively, the apertures 276*a*, 276*b* span only a portion of the side wall 254 and the top wall 252.

As shown in FIG. 5, the aperture 276 is adapted to permit the passage or flow of the flowable contents held by the container through the opening 228 when the aperture is generally positioned about the opening 228. Described in another manner, when the aperture 276 is aligned with the opening 228, the flowable contents can pass through the opening 228. Therefore, the aperture 276 should have a minimum configuration sufficient to permit the passage of the flowable contents through the aperture 228.

The cover 212 and the overlay 250 each have a generally thin-wall construction. However, the wall thickness of the cover 212 and the overlay 250 can vary depending upon the design parameters, including the structural integrity of the lid 210.

Referring to FIGS. 5 and 8, the overlay 250 and the cover 212 are cooperatively dimensioned such that the overlay 250 can be positioned on the cover 212 to define an "assembled position." In the assembled position, the overlay 250 is rotatably supported by the engagement of its mounting portion 260 and the mounting portion 222 of the cover 212. Specifically, a lower surface of the mounting portion 260 engages an upper surface of the mounting portion 222. Accordingly, the mounting portion 260 and the mounting portion 222 are cooperatively dimensioned such that the overlay 250 can be rotated with respect to the cover 212, where the cover 212 is generally fixed to the container.

In addition, the overlay 250 can be rotatably supported by the engagement of its center portion 270 and the center portion 236 of the cover 212. Specifically, a lower surface of the center portion 270 engages an upper surface of the center portion 236. Accordingly, the center portion 270 is cooperatively dimensioned with the center portion 236 of the cover 212. Alternatively, the lid 210 can be configured to have a clearance between the center portions 236, 270 such that the center portions 236, 270 are not in engagement. In this configuration, the overlay 250 rotatably engages the cover 212 by the engagement of the mounting portions 222, 260.

Alternatively, the overlay 250 can be rotatably supported by the engagement of its top wall 252 with the top wall 214 of the cover 212. Accordingly, the top wall 252 is cooperatively dimensioned with the top wall 214 of the cover 212. In another alternative, the overlay 250 can be rotatably supported by the engagement of its side wall 254 with the side wall 216 of the cover 212. Accordingly, the side wall 254 is cooperatively dimensioned with the side wall 216 of the cover 212.

In the assembled position, the overlay 250 is movable between a first position P1 and a second position P2. In the first position P1, shown in FIG. 8, the projection 264 is received by the drink opening 228 such that the opening 228 is sealed wherein the lid 210 is closed. When the opening 228 is sealed, the edge 229 of the opening 228 is in frictional engagement with the projection 264. A bottom portion (not shown) of the projection 264 can extend past the edge 229 of the drink opening 228. This seal prevents the flow of the flowable substance in the container through the opening 228, enabling the container and lid 210 to be moved without risking spillage. Also, in the first position P1, the aperture 276 is misaligned or offset from the opening 228. Alternatively, the projection 264 and the opening 228 are in a snap fit engagement wherein each have sufficient structure to enable the snap fit engagement. Other cooperating sealing structures can also be utilized.

In the second position P2, shown in FIG. 5, a user rotates the overlay 250 wherein the aperture 276 is aligned with the drink opening 228 to form a passageway between the overlay 250 and the cover 212. In the second position P2, the lid 210 is open. The passageway permits the passage or flow of the flowable substance held by the container through the lid 210. When the lid 210 is in the second position P2, at least a portion of the aperture 276 is aligned with at least a portion of the edge 229 of the drink opening 228. Also, in the second position P2, at least a portion of the recessed portion 240 of the cover 212 is aligned with the aperture 276. In addition, in the second position P2, the projection 264 is misaligned or offset from the opening 228. When the aperture 276 is partially aligned with the drink opening 228, the passageway remains but its dimensions are reduced.

When the overlay 250 is moved between the first position P1 and the second position P2, the mounting portion 260 of the overlay 250 remains in rotatable engagement with at the mounting portion 222 of the cover 212. Accordingly, the mounting portions 222, 260 provide support to the overlay 250 such that the overlay 250 remains in the assembled position during movement between the first and second positions, P1, P2.

When the overlay 250 is moved between the first position P1 and the second position P2, the center portion 270 of the overlay 250 remains in rotatable engagement with the center portion 236 of the cover 212. Accordingly, the center portions 236, 270 provide an additional amount of support to the overlay 250 such that the overlay 250 remains in the assembled position during movement between the first and second positions, P1, P2.

A user can move the overlay 250 between the first position P1 and the second position P2 by grasping and manipulating a portion of the overlay 250, for example, the side wall 254, the top wall 252 or the mounting portion 260. Alternatively, when so configured, the user can move the overlay 250 between the first and second positions P1, P2 by engaging the gripping element 274.

The overlay 250 can be rotated or moved a varying amount depending upon the numerous design parameters of the lid 210, including but not limited to the configuration and dimensions of the side wall 254, the mounting portion 260, the projection 264 and the aperture 276. Thus, the overlay 250 can assume a number of positions with respect to the cover 212. The lid 210 is adapted to permit a user to move the overlay 250 between the first and second positions P1, P2 with only one hand. This means that a user can hold the container and manipulate the overlay 250 with the same hand. This increases the flexibility and the commercial value of the lid 210. As shown in FIGS. 5, 7 and 8, the overlay 250 has two separate apertures 276 which permit the overlay 250 to be rotated in either a clockwise or counter-clockwise direction to move the overlay 250 between the first position P1 and the second position P2. This feature further increases the flexibility and the commercial value of the lid 210.

The lid 210 is adapted to be used without the overlay 250. This means that the cover 212 is connected to a container but the overlay 250 is omitted. In this configuration, there is no structure to seal the opening 228 in the cover 212 and as a result, the flowable substance held by the container can pass through the lid 210. In this configuration, the recessed portion 240 remains positioned on both the top wall 214 and the side wall 216. However, the drink opening 228 can be positioned in either the top wall 214 or the side wall 216.

Although shown as having a generally circular shape, the lid 210, including the mounting portions 222, 260, can have numerous configurations. For example, the lid 210 could have a rectangular, square, or oval shape. To ensure a leak-proof seal with the container, the shape of the mounting portion 222, 260 should match the shape of the upper edge of the container so a cooperative sealing engagement can be achieved.

Alternatively, the mounting portions 222, 260 could have a shape similar to the upper edge of the container, yet dissimilar from the shape of the side walls 216, 254 and the top walls 214, 252. For example, the mounting portions 222, 260 could have an annular shape consistent with the container shape and the side walls 216, 254 and/or the top walls 214, 252 could have a non-annular shape.

Unlike prior art designs, the dimensions and the configuration of the opening 228 are not affected by the engagement and disengagement of the projection 264 as the overlay 250 is moved between the first and second positions P1, P2. This attribute allows a user to repeatedly move the overlay 250 between the first position P1 and the second position P2. Accordingly, the structural integrity and the durability of the lid 210 are increased.

The lid 210 can be formed by a variety of manufacturing processes, such as injection molding or a thermoforming operation, preferably vacuum forming and/or pressure forming. The cover 212 is preferably formed from plastic, however, other lightweight materials can be used to form the cover 212. After the manufacturing process has been completed, the drink opening 228 may be formed in the cover 212 with a punch and die. The aperture 276 could also be formed with a punch and die.

Preferably, the overlay 250 is formed from the same material used to form the cover 212. However, the overlay 250 can be formed from other lightweight materials.

The cover 212 can have at least one cover drain hole (not shown), preferably positioned in the center portion 236 near a lowermost portion of the center portion 236. When excess flowable contents, e.g., liquid, accumulate on the cover 212, the drain hole ensures the drainage of such contents into the container.

The overlay 250 can have an overlay drain hole (not shown), that is cooperatively dimensioned with the cover drain hole described above. The overlay drain hole is cooperatively positioned with the cover drain hole such that when the overlay 250 is rotated to the first position P1, the cover drain hole and the overlay drain hole align to form a passageway that ensures the drainage of accumulated container contents. Alternatively, the overlay drain hole is cooperatively positioned with the cover drain hole such that when the overlay 250 is rotated to the second position P2, the cover drain hole and the overlay drain hole align to form the passageway.

The cover 212 can have at least one cover vent hole (not shown), preferably in the center portion 236 or the side wall 216. Alternatively, the cover vent hole is positioned in a portion of the top wall 214 or a portion of the side wall 216. The cover vent hole is adapted to ensure the continuous flow of the container contents though the opening 228 while venting the container. Preferably, the cover vent hole is positioned such that the venting of the container occurs while the lid 210 is in the second position P2.

The overlay 250 can have an overlay vent hole (not shown), that is cooperatively dimensioned with the cover vent hole described above. The overlay vent hole is cooperatively positioned with the cover vent hole such that when the overlay 250 is rotated to the second position P2, the cover vent hole and the overlay vent hole align to form a passageway that ensures the venting of the container.

The drain holes and the vent holes described above can be formed with a punch and die after the lid 210 manufacturing process has been completed. Alternatively, a pointed tool may be used to form the drain holes and the vent holes.

In another preferred embodiment (not shown), the lid has at least one pin on either the overlay or the cover. In addition, the lid has at least one socket on the other of the overlay or the cover. The pin and the socket are cooperatively dimensioned such that when the pin is received by the socket, the overlay is in rotational engagement with the cover. Because the overlay and the cover are in rotational engagement, the lid can be rotated between the first and second positions P1, P2. The pin and socket are adapted to support the overlay when the lid is rotated between the first and second positions P1, P2.

The cover has a center portion that can be recessed. The overlay is a discontinuous structure that is adapted to be positioned about the cover. The overlay has at least one aperture that is alignable with an opening in the cover. Preferably, the pin depends from a lower surface of the overlay, and the socket depends from an upper surface of the cover. In this configuration, the socket is positioned in the center portion of the cover.

The overlay can include an annular mounting portion that engages a mounting portion of the cover. The overlay mounting portion supports the overlay during movement between the first and second positions. Alternatively, the overlay includes a mounting portion but it is segmented, meaning that it is not annular.

In another alternative, the annular mounting portion is omitted from the overlay. In this configuration, the pin and socket primarily support the overlay when the lid is rotated between the first and second positions P1, P2.

Figure 11:
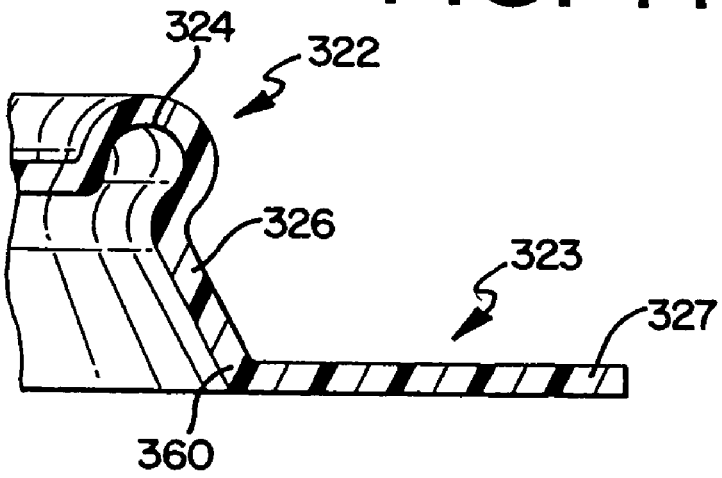
FIG. 11 is a partial cross-section of the lid taken along line 11-11 of FIG. 10, showing the tab.

FIGS. 9 and 10 disclose an alternate embodiment of a lid of the present invention, generally designated with the reference numeral 310. The lid 310 generally includes a cover 312 and the movable or rotatable element or disk 50, and the similar elements thereof retain their reference numerals. The lid 310 is shown having a tab 323 extending from a portion of the cover 312. The tab 323 is adapted to permit a user to easily position and/or remove the lid 310 from a container 325. The tab 323 extends radially outward from the mounting portion 322. Described in a different manner, the tab 323 extends radially from the peripheral edge 360 of the skirt 326. However, the tab 323 can extend from a different portion of the cover 312, including the side wall 16 or the flange 324. Although a single tab 323 is shown, the lid 310 can have a plurality of tabs 323 wherein the tabs 323 are spaced about the mounting portion 322. The tab 323 has a curved peripheral edge 327 that causes the tab 323 to have a curvilinear configuration. Alternatively, the tab 323 has an angular or linear configuration. As shown in FIG. 11, the thickness of the tab 323 generally corresponds to the thickness of the mounting portion 322. However, the thickness of the tab 323 can be either increased or decreased as necessary.

Figure 12:
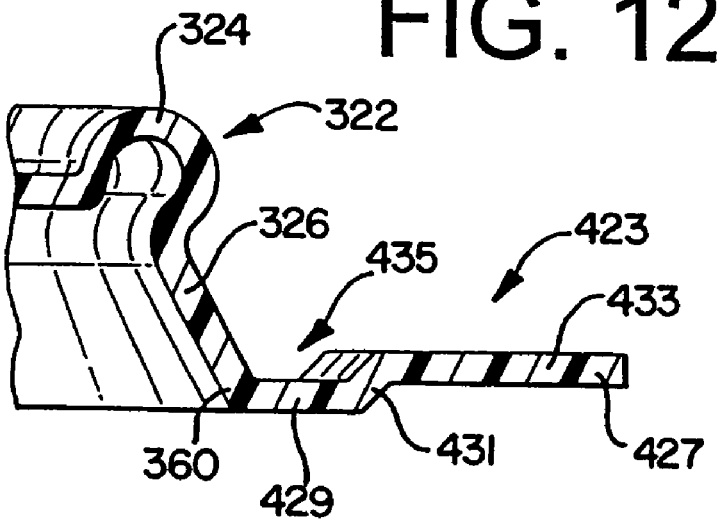
FIG. 12 is a partial cross-section of the lid taken along line 11-11 of FIG. 10, showing an alternate tab.

An alternate tab 423 extending from the mounting portion 322 is shown in FIG. 12. The tab 423 has a curvilinear configuration with a first segment 429, a second segment 431, and a third segment 433. The first segment 429 extends radially outward from an edge 360 of the skirt 326. The second segment 431 is angled or sloped upward from the first segment 429 to the third segment 433 whereby the tab 423 has a "stepped" configuration. The third segment 433 has a rounded edge 427 which causes the tab 423 to have a curvilinear configuration. Alternatively, the third segment 433 has a squared end or terminus. When viewed from above, a channel 435 is defined by the skirt 326, the first segment 429, and the second segment 431. The first segment 429 defines a first plane, the second segment 431 defines a second plane, and the third segment 433 defines a third plane. Due to the angled second segment 431, the first plane and the third plane are misaligned. Described in a different manner, the first plane is not in planar alignment with the third plane. Further, neither the first plane nor the third plane are in planar alignment with a plane defined by the flange 324. In another alternative (not shown), the tab has a second segment that is angled or sloped downward from the first segment towards the third segment causing the tab to have a stepped configuration in a downward direction. With this alternate design, the third segment is positioned lower than the skirt of the mounting portion.

As described above, the lid 310, or portions thereof can be formed by a variety of manufacturing processes, such as injection molding or a thermoforming operation, preferably vacuum forming and/or pressure forming. However, the primary components of the lid, the cover 312 and the rotatable element 50, can be formed from distinct processes. For example, the cover 312 can be thermoformed while the rotatable element 50 can be injection molded. Furthermore, the cover 312 and/or the element 50 can be co-injection molded, meaning that multiple polymers can be used to form the element 50. For example, the rotatable element 50 can be formed from a thermoplastic polymer and a thermoset polymer. In addition, an additive such as a filler, plasticiser, stabilizer, or colorant can be utilized to form the cover 312 and/or element 350.

Preferably, the tab 323 is integrally formed with the cover 312. Preferably, the thickness of the tab 323 corresponds with the cover 312, however, it can differ based upon design parameters of the lid 310. A conventional cutting tool is used to trim excess material from the lid 310 to form the tab 323. The precise configuration and/or thickness of the tab 323 can be revised by the changing the operating parameters of the cutting tool.

As also mentioned above, the tab 323 is adapted for a user to easily position and/or remove the lid 310 from the container 325. When the lids 310 are stacked in a vertical arrangement at a retail distribution point, an employee can grasp the tab 323 to quickly separate the uppermost lid 310 from others within the stack. The tab 323 furthers the assembly of the cover 312 and the rotatable element 50. During the step of assembling the cover 312 and the rotatable element 50, the tab 323 helps to fix the position of the cover 312 such that the rotatable element 50 can be properly positioned within the interior region of the cover 312. The tab 323 enhances the alignment between the cover 312 and the element 50 to effectuate the assembly of the lid 310. Referring to FIG. 10, the tab 323 of the lid 310 is shown positioned between a pair of guides or pegs G, which typically extend from a piece of equipment or tooling. Alternatively, the tab 323 is positioned against a single guide G. The interaction between the guides G and the tab 323 secures the lid 310 in a pre-assembly position wherein the cover 312 is separated from the rotatable element 50. In the pre-assembly position, the precise location of the slot 30 is fixed to facilitate reception of the actuator 54. Described in a different manner, the angular orientation of the cover 312, including the slot 30 is fixed. While the tab 323 is positioned between the guides G, the rotatable element 50 is moved towards the interior region of the cover 312. To reach an assembled position, the rotatable element 50 is positioned within the interior region of the cover 312 whereby the actuator 54 is received by the slot 30. In addition, the rotatable element 50 is positioned such that it rotatably engages the support members 102. Thus, the tab 323 helps to ensure the proper assembly and formation of the lid 310. In addition to providing positioning benefits during assembly of the lid 310, the tab 323 provides positioning benefits during the use of the lid 310. Specifically, the tab 323 provides tactile feedback for a user to determine the position of the drink opening 28 with respect to the position of the tab 323. This aspect is beneficial in low light conditions.

As shown in FIG. 1, the cover 12 has a drink opening 28 that is adapted to receive the projection 52 of the rotatable element 50 in the first position P1. The drink opening 28 is shown as being positioned in the top wall 14 of the cover 12. However, a spout can extend upward in a generally vertical manner from the top wall 14 and include a drink opening. In this manner, the drink opening is positioned above the top wall 14 due to the spout. In the first position P1, the flowable contents of the container flow through the aperture 78 of the element 50 and the spout. The spout can extend upwardly from the top wall 14 or a combination of the top wall 14 and the central region 36. Preferably, the spout is integrally formed with the cover 12. The dimensions of the spout, including the height and the width, vary with the design parameters of the lid 10. Preferably, the spout is cooperatively dimensioned with the projection 52 such that a base region of the spout receives the projection 52 to generally seal the opening 28 of the lid 10 in the second position P2.

Figure 13:
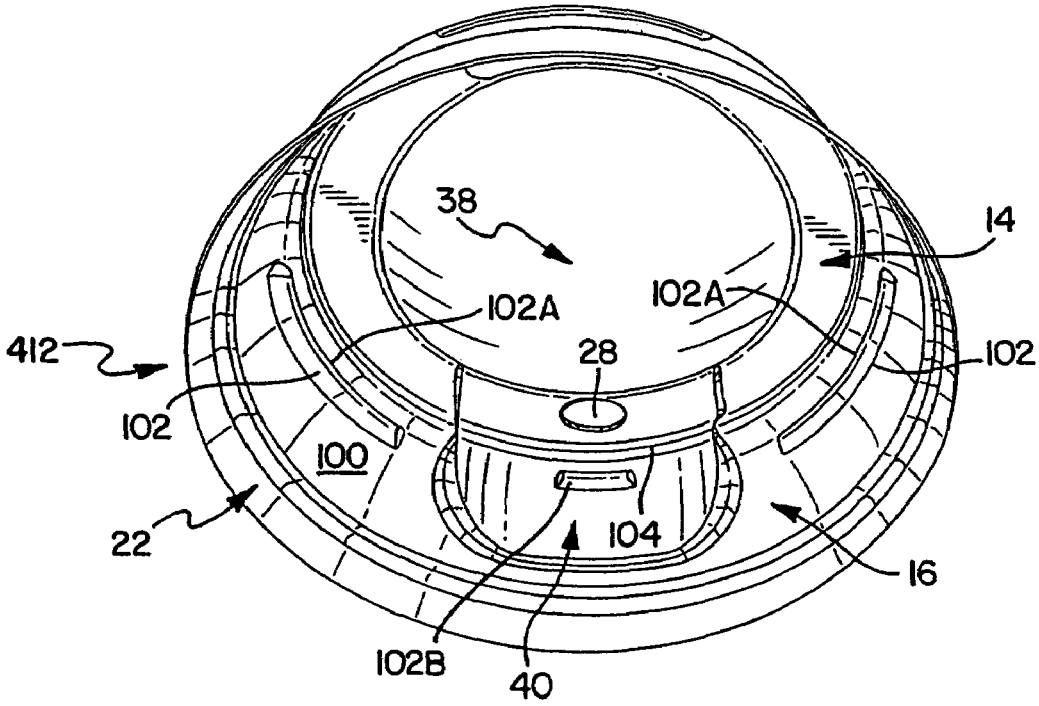
FIG. 13 is a perspective view of an alternate embodiment of a lid of the present invention, showing an interior cavity of the lid.

Referring to FIG. 3 and as mentioned above, the cover 12 has a plurality of support members 34 and support ledges 102, where the support ledges 102 extend into the interior region of the cover 12 from the side wall 16. As shown in FIG. 13, a cover 412 has a support ledge 102B that is positioned within the recessed portion 40 of the side wall 16 and near the drink opening 28. Alternatively, the recessed portion 40 is omitted and the support ledge 102B is positioned near the drink opening 28. In yet another alternative, a pair of support ledges 102B can extend inward from the side wall 16 and be positioned about the drink opening 28. As fully explained above, the rotatable element 50 is rotatably supported by the ledges 102 such that the element 50 is moveable between the first and second positions P1, P2. As shown in FIG. 13, the support ledge 102B has a reduced length compared to the other support ledges 102. However, the dimensions including the length of the support ledges 102, 102B can vary with the design parameters of the cover 12. The positioning of the support ledge 102B near the drink opening 28 enhances the operation of the rotatable element 50. In the first or closed position P1, the support ledge 102B provides further support to the element 50 such that the projection 52 is properly received by the drink opening 28. In the second or open position P2, the support ledge 102B provides further support to the element 50 such that the aperture 78 remains properly aligned with the drink opening 28. Furthermore, in either position P1, P2, the interaction between the support ledge 102B and the rotatable element 50 minimizes the chance for seepage past the element 50 in the region about the drink opening 28. Although the cover 412 is shown as not having the tab 323 of FIGS. 9-11, it is understood that the cover 412 can have a tab and that such structure will not interfere with the operation of the lid 412.

As shown in FIG. 13, the support ledges 102, 102B extend radially inward from the inner surface 100 of the side wall 16 of the cover 412. Alternatively, the cover 412 has a support channel in the side wall 16 wherein the channel is adapted to rotatably support the element 50. In this manner, the support channel is recessed into the side wall 16 such that it does not extend beyond the inner surface 100. The support channel can be positioned along the entire circumference of the side wall 16, or an extent of the circumference. The support channel can be continuous or interrupted, meaning spaced along the circumference of the side wall 16. Preferably, the element 50 has a rib or rail that is received by the support channel to rotatably support the element 50. To ensure proper rotation of the rotatable element 50, the rib and the support channel are cooperatively dimensioned. The rib can extend from a number of locations of the element 50, including the top wall 56, the side wall 59, or the lower edge 51. Like the support channel, the rib can be continuous or interrupted. For larger containers, the size of the cover 12 can be increased such that cover 12 has a plurality of support channels and the rotatable element 50 has a corresponding number of cooperating ribs. Preferably, the support channel in the side wall 16 is dimensioned to receive only the rib of the element 50. Alternatively, the height of the support channel is increased such that a greater extent of the element 50 is rotatably received. This means at least the outer edge 51 and the side wall 59 of the element 50 are received by the larger support channel. In another alternative, the support channel and rib configuration is reversed such that the rotatable element 50 has a recessed channel that receives a rib of the cover 12.

As explained above, the rotatable element 50 is moveably supported by support ledges 102 located in the side wall 16. Alternatively, the rotatable element 50 is rotatably supported by other portions of the cover 12 such as the top wall 14 and/or the central portion 36 of the cover 12. Thus, the top wall 14 could have at least one structure adapted to rotatably support the element 50. For example, a support ledge 102 can depend from the top wall 14 and rotatably support the element 50. In this configuration, the support ledge 102 depends from the top wall 14 at a position radially inward of the peripheral edge of the top wall 14. This support ledge 102 has a horizontal component that engages and rotatably supports the element 50, which can be a ring-shaped structure. As another example, a support ledge 102 can depend from the central portion 36 and rotatably support the element 50. As yet another example, a support ledge 102 can extend from the point where the top wall 14 and the side wall 16 converge. In is further understood that the element 50 could be rotatably supported on a top surface of the cover 12.

Figure 14:
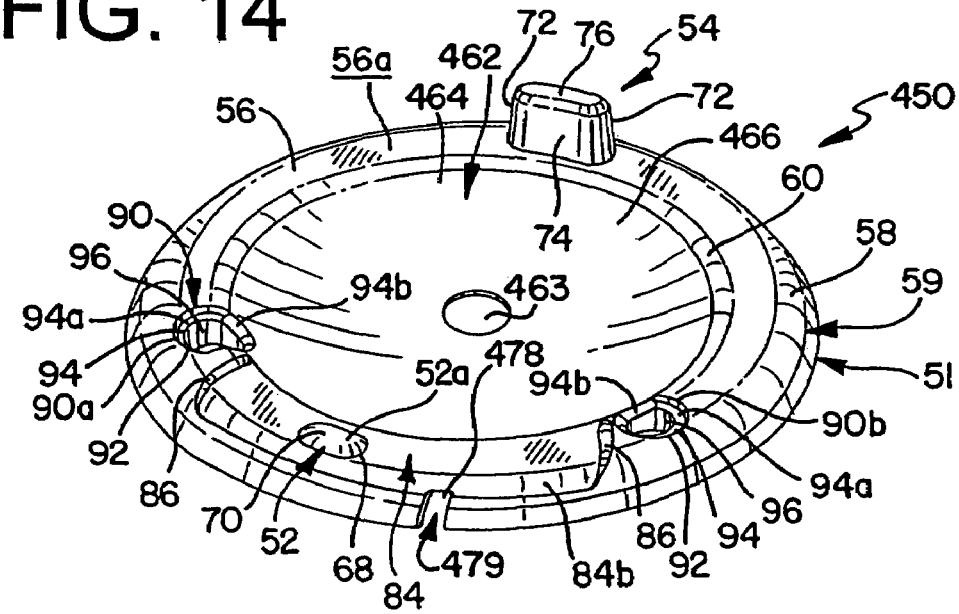
FIG. 14 is a perspective view of an alternate embodiment of a rotatable element for a lid of the present invention.

Referring to FIG. 4, the rotatable element or disk 50 has an aperture 78 that is aligned with the drink opening 28 in the second or open position P2. Alternatively and as shown in FIG. 14, the aperture 78 is omitted and the element 450 has at least one structure configured to define a passageway for the flow of the container contents. In a preferred embodiment, the element 450 has a notch 478 that defines a channel or passageway 479. The dimensions of the passageway 479 are determined by the width and length of the notch 478. The notch 478 extends radially inward from the outer edge 51 of the element 450. The notch 478 terminates prior to the top wall 56 of the element 450. However, the notch 478 can extend into the top wall 56 and/or into the inner shoulder 60 of the element 450. The notch 478 is positioned adjacent the recessed portion 84 of the element 450. In the first position P1, the notch 478 is misaligned with the drink opening 28 causing misalignment between the passageway 479 and the opening 28. In the second position P2, the notch 478 is generally aligned with the drink opening 28 causing the passageway 479 to be aligned with the opening 28. As a result, the passageway 479 permits the passage of the flowable substance held by the container through the lid 10. In yet another alternative, the element 450 has an upwardly directed or raised segment that defines a channel or passageway. To prevent binding of the rotatable element during its movement between the first and second positions P1, P2, the height of the raised segment corresponds to the height of the projection 52.

As discussed above and as shown in FIG. 14, the center or central portion 462 of the rotatable element 450 has an opening 463. As a result of the opening 463, the element 450 has a ring-shaped configuration. The opening 463 is adapted to permit the drainage of the liquid contents of the container pass between the element 450 and the cover 12. Although the diameter of the opening 463 is shown as roughly corresponding to the diameter of the wells 90, the size of the opening 463 can vary with the design parameters of the rotatable element 450. As a result, the dimensions of the ring-shaped element 450 will vary. For example, the diameter of the opening 463 is increased and the width of the center portion 462 corresponds to the width of the top wall 56 of the rotatable element 450.

In another embodiment, the rotatable element 50 has a band extending radially outward from the peripheral or outer edge 51 proximate the projection 52. The band is adapted to increase the sealing of the drink opening 28 by the projection when the lid 10 is in the closed or first position P1. Preferably, the band has a rectangular configuration and extends outward from the recessed portion 84 of the element 50. When the lid 10 is in the closed position P1, the band is positioned beneath the drink opening 28 and against the inner surface 100 of the cover 12. In this manner, the band helps to further seal the drink opening 28 in the closed position P1. The rotatable element 50 could also have a projection 52 with pliable characteristics to assist in sealing the drink opening 28. This type of projection 52 can be formed, for example, using a two-shot injection molding process.

In another embodiment, the rotatable element 50 has a recessed portion 84 with a vertical side wall 59. When the element 50 is viewed from the side, the vertical side wall 59 forms a shoulder or ledge (not shown) near the peripheral edge 51 of the element 50. The shoulder has a vertical wall component that originates at the peripheral edge and terminates near the edge 80 of the aperture 78. The shoulder extends an extent of the recessed portion 84. Preferably, the shoulder extends along the projection 52 and the aperture 78. The vertical side wall 59 is adapted to aid the interaction between the recessed portion 84 and the recess 40 of the cover 12.

Figure 15:
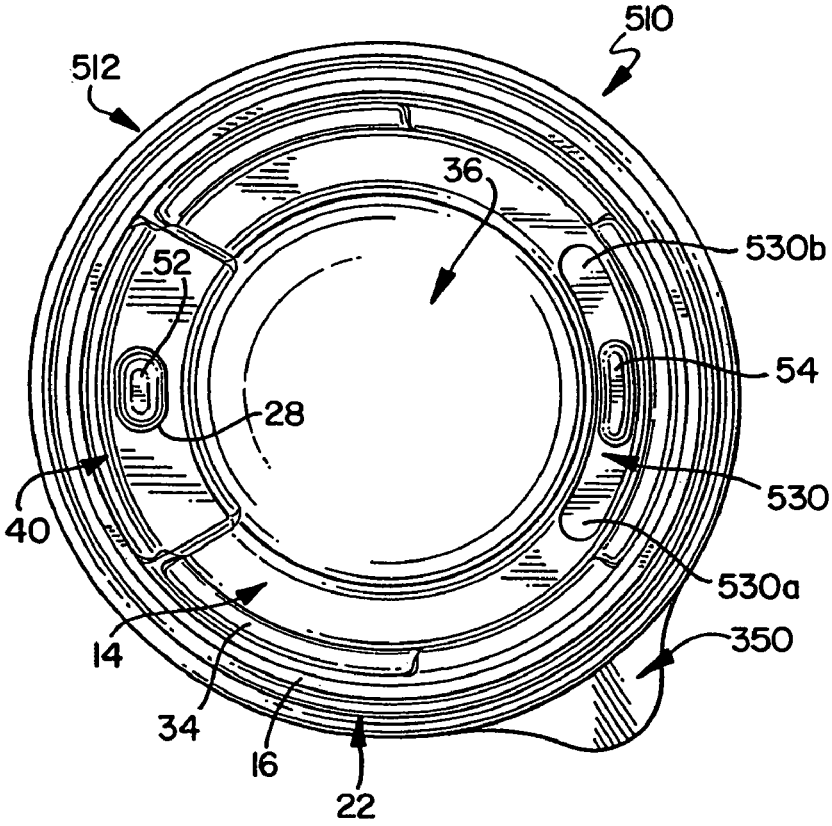
FIG. 15 is a top plan view of an alternate embodiment of a lid of the present invention, showing a lid with a cover having an enlarged slot.
Figure 16:
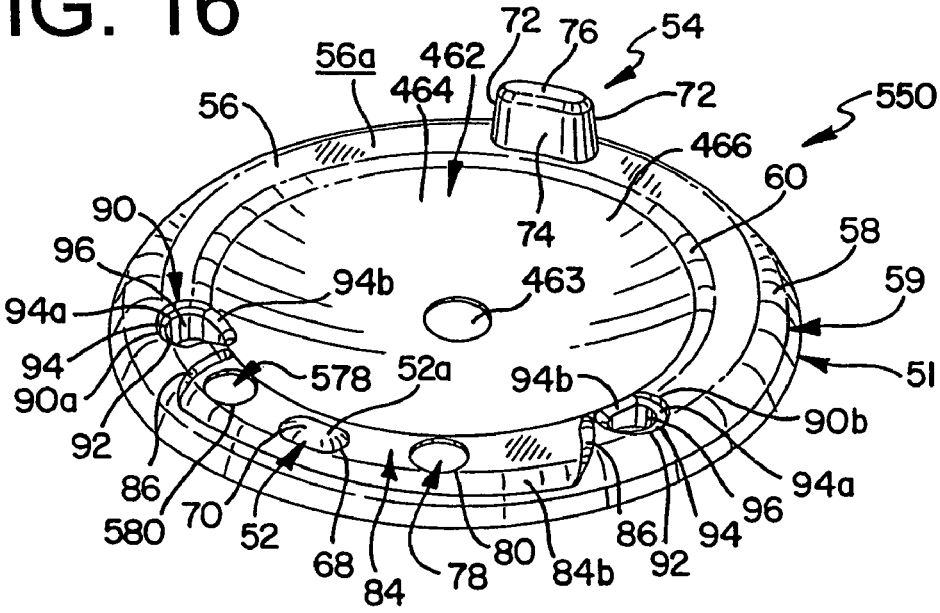
FIG. 16 is a perspective view of a rotatable element of the lid of FIG. 15, showing the element having a pair of apertures.
Figure 19:
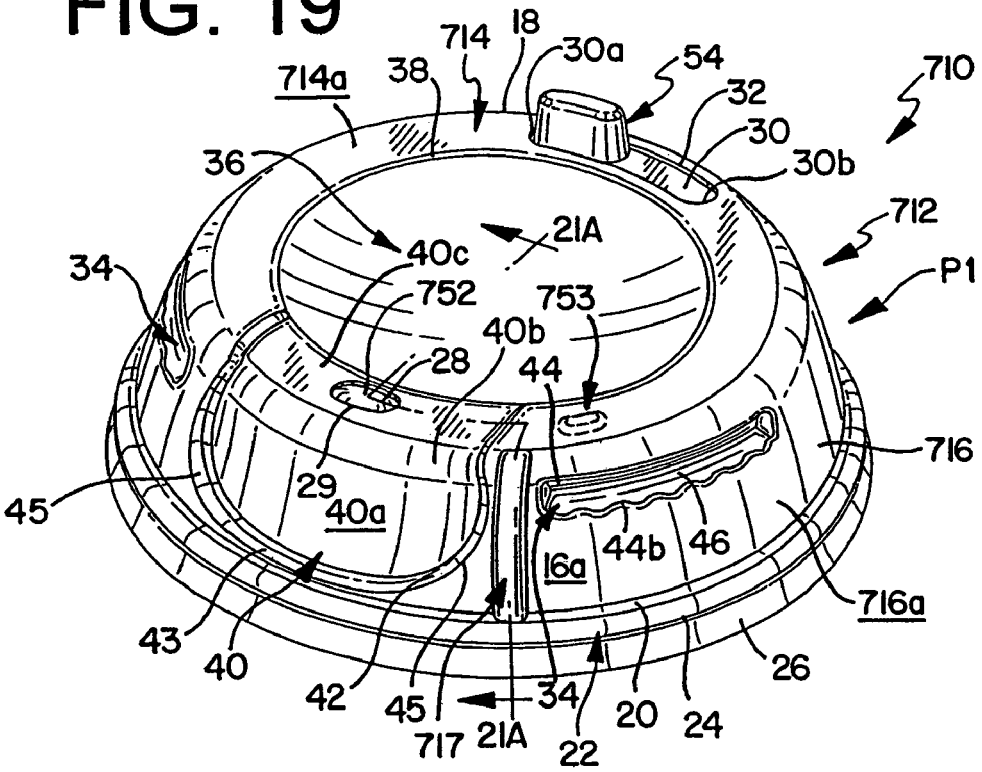
FIG. 19 is a perspective view of an alternate embodiment of a lid of the present invention, showing a cover and a rotatable element.
Figure 20:
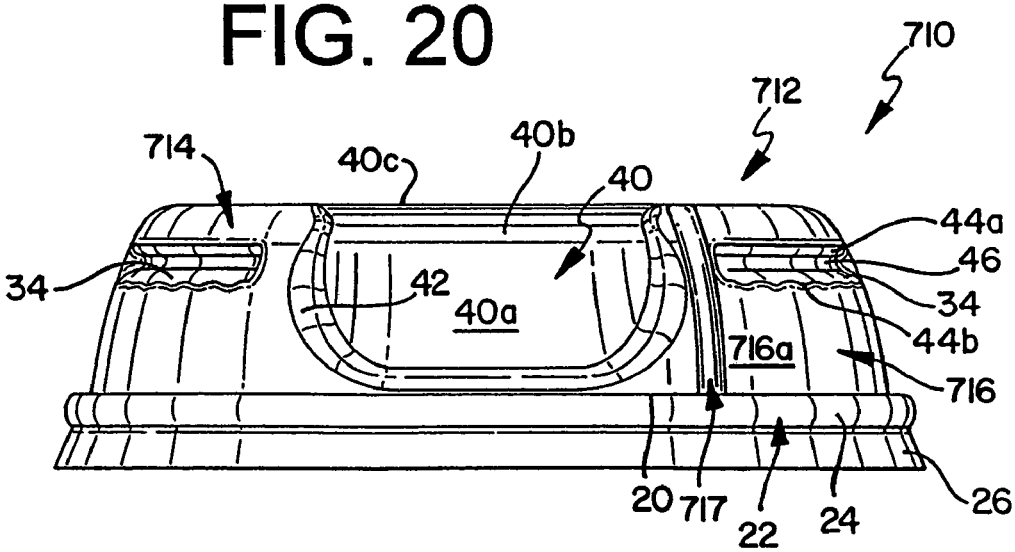
FIG. 20 is an end view of the lid of FIG. 19, showing the cover.

FIGS. 15 and 16 disclose an alternate embodiment of a lid of the present invention generally designated with the reference numeral 510. The lid 510 generally has a cover 512 and the rotatable element 550, and the similar elements thereof retain their reference numerals. The lid 510 has a slot 530 with increased dimensions. Specifically, the arc length of the slot 530 is increased. In the first or closed position P1 shown in FIG. 15, the actuator 54 is positioned between a first slot portion 530*a* and a second slot portion 530*b*. Thus, two distinct slot portions 530*a, b* flank the actuator 54 in the first position P1. In the first position P1, the actuator 54 is positioned at the general midpoint of the slot 530. The rotatable element 550 has a first aperture 78 and a second aperture 578, wherein the apertures 78, 578 are positioned about the projection 52. Preferably, the second aperture 578 is positioned in the recessed portion 84 of the element 550. Like the first aperture 78, the second aperture 578 has a peripheral edge 580 that defines the shape of the aperture 578. When the second aperture 578 is aligned with the drink opening 28, a passageway is formed between the disk 50 and the cover 512 permitting the passage or flow of the flowable substance held by the container through the lid 510. To move the lid 510 from the first position P1 to the open or second position P2, a user actuates the actuator 54 in either a clockwise or counter-clockwise direction such that either the first aperture 78 or the second aperture 578 is aligned with the drink opening 28. Therefore, the lid 510 is capable of movement in one of two distinct directions from the first position P1 to the second position P2, which increases the utility of the lid 510. Alternatively, the lid 510 has a pair of projections 52 positioned about the first aperture 78. In this configuration, to move the lid 510 from the second position P2 to the closed or first position P1, a user actuates the actuator 54 in either a clockwise or counter-clockwise direction such that either the first projection 52 or the second projection 52 is received by the drink opening 28.

Although the rotatable element 50 is shown in FIG. 4 as having a disk configuration, the element 50 can have a variety of configurations. For example, the rotatable element 50 can have a ring-shaped configuration. Also, at least one spoke or rib can be added to the ring-shaped element 50 to increase its structural integrity. The spoke(s) can have a recessed central portion that corresponds with the recessed configuration of the central region 36 of the cover 12. Alternatively, the rotatable element 50 can have a hour-glass shaped configuration where the portions not having either the post 54 or the recessed portion 84 are removed. This configuration reduces the quantity of material used to fabricate the rotatable element 50.

Again referring to FIG. 4, the rotatable element 50 has an actuator 54 defined by a post that extends generally upward from a top wall 56 of element 50. Alternatively, the post 54 depends downward from the top wall 56 to define a well. The well is cooperatively dimensioned with the slot 30 of the cover 12 such that a user can actuate the lid 10 between the first position P1 and the second position P2. For example, a user can insert a finger into the slot 30 and the well formed by the depending post 54 to actuate the element 50 between the first and second positions P1, P2. Thus, the well is adapted to receive a user's finger to actuate the rotatable element 50. In another alternative, the actuator 54 is defined by a plurality of protrusions such that a user can engage the protrusions to actuate the rotatable element 50 between the first and second positions P1, P2.

FIGS. 17 and 18 disclose an alternate embodiment of a lid of the present invention generally designated with the reference numeral 610. As shown therein, the support members 34 and the resulting support ledges 102 are omitted from the side wall 616 of the cover 612. Also, the actuator or post 654 of the rotatable element 650 has a flange 671 that is adapted to slidingly engage the top wall 14 of the cover 612. As explained above, in an assembled position, the post 654 extends through the slot 30 in the cover 612 wherein the flange 671 slidingly engages a portion of the top wall 14 of the cover 12. This means that a lower surface of the flange 671 slidingly engages the upper surface 14*a* of the top wall 14. The interaction between the flange 671 and the top wall 14 provides moveable support for the element 650 such that the element 650 is rotatable between the first position P1 and the second position P2. Thus, the flange 671 provides means for supporting the element 650 within the internal cavity 38 of the cover 612 whereby the element 650 is rotatable between the first and second positions P1, P2.

As shown in FIGS. 17 and 18, the flange 671 is positioned about the end walls 674 and the side walls 674, but below the top wall 676 of the post 654. Also, the flange 671 extends from the periphery of the post 654 such that the post 654 has a "T-shaped" configuration. Preferably, the flange 671 is integrally formed with the post 654 and is flexible. As a result, when the post 654 is inserted into the slot 30 during the assembly process, the flange 671 flexes as it passes through the slot 30 and then returns to its original configuration (meaning un-flexed) when it clears the slot 30. The flange 671 defines a plane that is in planar alignment with a plane defined by the top wall 14 of the cover 612. Alternatively, the flange 671 is angled, peaked, or sloped. The flange 671 has a length and a width, wherein each is greater than a length and width of the post 654. Preferably, the width of the flange 671 corresponds with the width of the top wall 14 of the cover 612. One of ordinary skill recognizes that the dimensions of the flange 671 can not be so great as to preclude the passage of the flange 671 through the slot 30.

The lid 610 is shown as having the flange 671 and no support members 34. However, the lid 610 can have a combination of these structures. For example, the lid 610 could include the flange 671 and at least one support member 34 and the resulting support ledge 100. In this configuration, the element 650 is rotatably supported by the interaction between the flange 671 and the top wall 14 and by the interaction between the peripheral edge 51 of the element and the support ledge 100. As another example, the lid 610 could have two or more posts 654 and a corresponding number of slots 30, wherein each post 654 has a flange 671 that slidably engages the top wall 14 of the cover 612 near each respective slot 30. In this manner, the element 650 is rotatably supported by the interaction between multiple flanges 671 and the top wall 14.

FIGS. 19-22 disclose an alternate embodiment of a lid of the present invention generally designated with the reference numeral 710. The lid 710 generally has a cover 712 and the rotatable element 750, and the similar elements thereof retain their reference numerals. The cover 712 has a side wall 716 with a vertical channel or rib 717. The vertical channel 717 is internal to the cover 712, however, the channel 717 protrudes from the outer surface 716*a* of the side wall 716. This means that the side wall 716 is raised at the channel 717. The channel 717 extends between the lower edge 20 of the side wall 716 and the peripheral edge 18 of the top wall 714. This means that the channel 717 is positioned between the mounting portion 22 and the top wall 714. The channel 717 is adapted to provide a first passageway for the flow of the flowable contents through the lid 710. In this manner, the channel 717 provides a generally vertical passageway for the content to flow to the opening 28 of the lid 710.

Referring to FIG. 22, the rotatable element 750 has a first projection 752 and a second projection 753. The projections 752, 753 are spaced a distance apart but remain within the recessed portion 784 of the element 750. Since the portion 784 is recessed or depressed with respect to the top wall 756 of the element 750, the element 750 has transition walls 785 between the top wall 756 and the recessed portion 784. Furthermore, the recessed portion 784 defines a plane that is below a plane defined by the top wall 756. Unlike recessed portions discussed above, the recessed portion 784 has increased dimensions such that the recessed portion 784 extends to the peripheral edge 751 of the element 750. Described in a different manner, the recessed portion 784 has an extended portion 784*a* that is coincident with the peripheral edge 751. As a result, an extent of the outer shoulder 758 and the side wall 759 proximate the extended portion 784 are omitted. Due to the configuration of the recessed portion 784, the aperture 78 is omitted. The recessed portion 784 is adapted to provide a second passageway for the flow of the flowable contents through the lid 710. The rotatable element 750 has an opening 763 and a plurality of wells 790 positioned radially outward of the opening 763. The recessed portion 784 is shown as spanning a pair of wells 790, however, the dimensions of the portion 784 can vary with the design parameters of the lid 710.

The lid 710 is movable between a closed or first position P1 and an open or second position P2. In the first position P1 shown in FIGS. 19 and 21A, the first projection 752 is received by the drink opening 28 of the cover 712. The second projection 753 is positioned beneath the top wall 714 but preferably beyond the lip recess 40 of the cover 712. Also, the channel 717 is positioned between the first and second projection 752, 753. Furthermore, the post 54 of the rotatable element 750 extends through the slot 30 of the cover 712. Although the vertical channel 717 creates a fluid passageway, the first projection 752 obstructs fluid flow through the drink opening 28 of the cover 712.

Consistent with that explained above, the post 54 is actuated to move the lid 710 between the first and second positions P1, P2. In the open or second position P2 shown in FIG. 21B, both the first projection 752 and the second projection 753 are misaligned with the drink opening 28. Described in a different manner, the first and second projections 752, 753 are positioned about the opening 28. Referring to FIG. 21B, the first projection 752 is shown as being positioned beyond the opening 28, while the second projection 753 is not shown due to the section line used to section FIG. 19. In the second position P2, the recessed portion 784 of the element 750 is in fluid communication with the channel 717. Specifically, the extended portion 784*a* of the recessed portion 784 is in fluid communication with the channel 717. In the second position P2, the second projection 753 is positioned between the drink opening 28 and the channel 717. In the second position P2, the interaction between the cover 712 and the projections 752, 753 exerts a downwardly directed force on the element 750 which deflects the element 750. This deflection of the element 750 creates a clearance C between the inner surface of the cover 712 and the rotatable element 750. Specifically, the interaction between the first projection 752 and/or second projection 753 and an inner surface of the top wall 40*c* of the recessed portion 40 causes the element 740 to deflect or flex which results in the clearance C near the drink opening 28 of the cover 712. The clearance C is a function of the deflection of the rotatable element 750. Preferably, the region of deflection of the element 750 is the recessed portion 784. The top wall 40*c* of the recessed portion is positioned below the top wall 714 of the cover 712 which is evidenced by the notch or step between the top wall 40*c* and the top wall 714. The clearance is further defined by the extended portion 784*a* of the recessed portion 784 of the rotatable element 750. The clearance C completes the fluid passageway that allows the container contents to flow through the drink opening 28. Accordingly, the fluid passageway is formed by the vertical channel 717 and the clearance C between the rotatable element 750 and top wall 40*c* about the drink opening 28. The clearance C is maintained while the rotatable element 750 is rotatably supported by the support members 102 of the cover 712. The top walls 714, 40*c* are dimensioned such that the first projection 752 and/or the second projection 753 can slidingly engage the inner surface thereof to permit movement between the first and second positions P1, P2.

Figure 23:
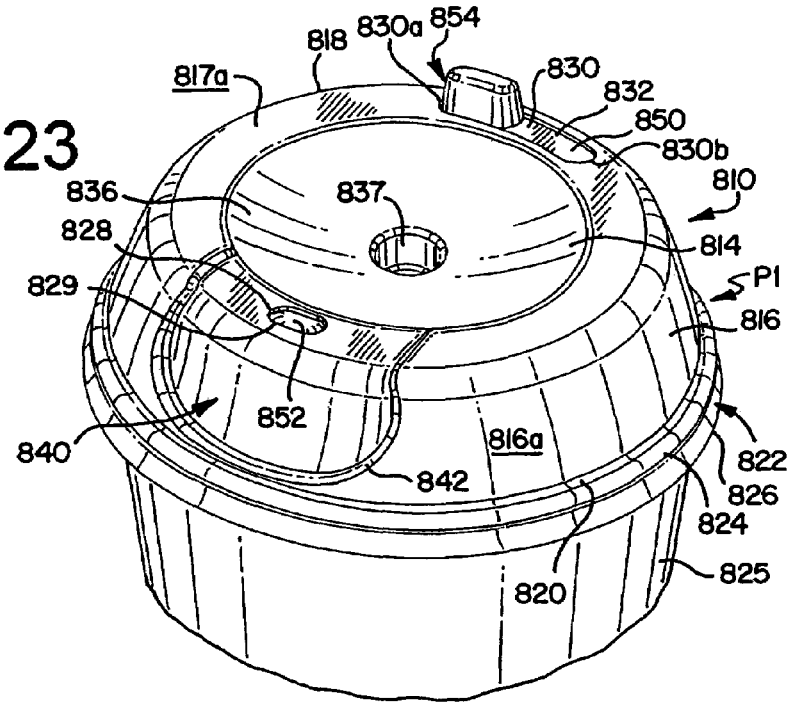
FIG. 23 is a perspective view of an alternate embodiment of the lid of the present invention, the lid shown in a closed position.
Figure 24:
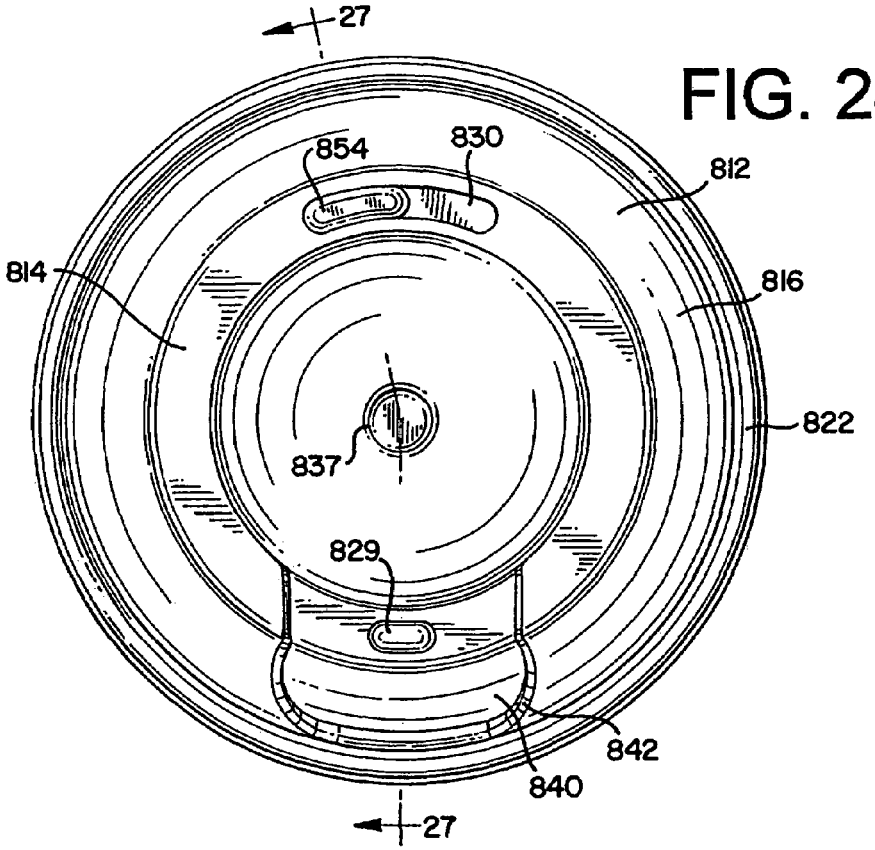
FIG. 24 is a top view of the lid of FIG. 23, the lid shown in a closed position.
Figure 26:
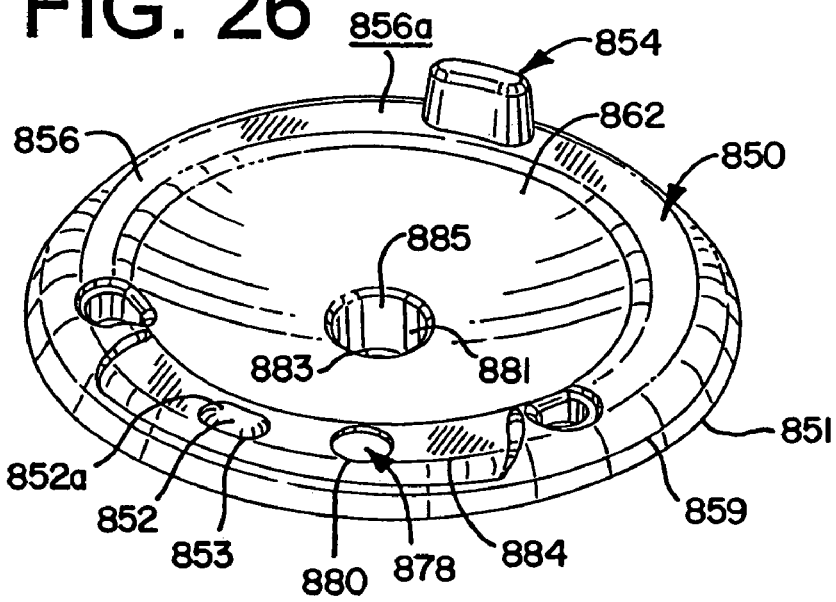
FIG. 26 is a perspective view of a moveable element of the lid of FIG. 23.
Figure 27:
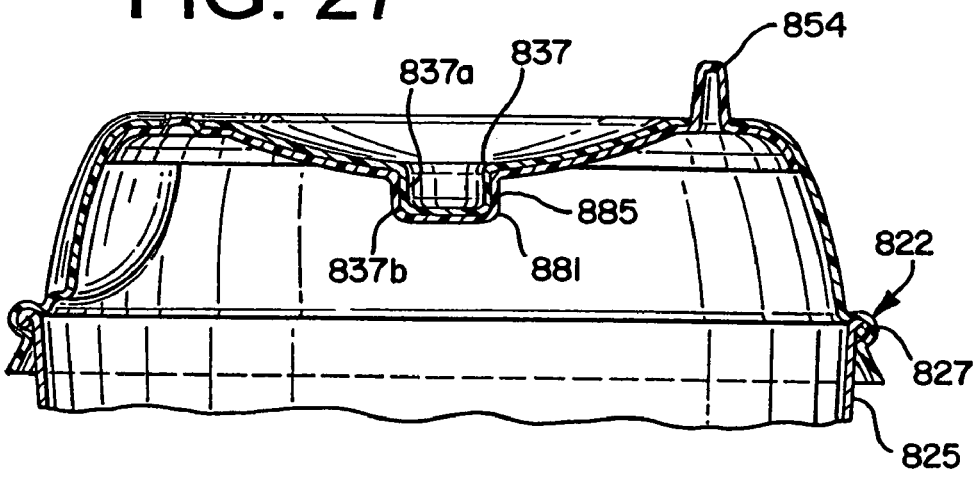
FIG. 27 is a cross-sectional view of the lid of FIG. 23, taken along lines 27-27 of FIG. 24.
Figure 28:
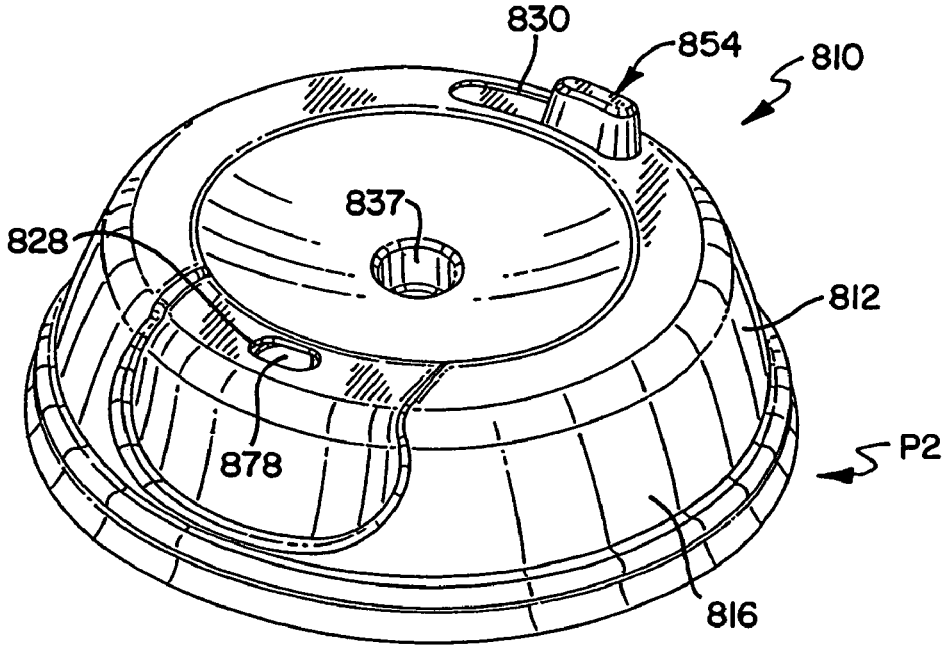
FIG. 28 is a perspective view of the lid of FIG. 23, the lid shown in an open position.

FIGS. 23-28 disclose another embodiment of the reclosable lid of the present invention, generally designated with the reference numeral 810. Like the previous embodiments, the lid 810 is adapted to be attached to a container 825. The container 825 has a central opening defining a volume that can be used to hold or contain a flowable substance, for example a liquid. The container 825 and the lid 810 can be of either the disposable or extended use variety. FIGS. 23 and 24 show the lid 810 in a closed position P1 wherein the lid 810 is sealed such that the flowable substance cannot flow through the lid 810. FIG. 28 shows the lid 810 in an open position P2, wherein a flowable substance may flow from the container 825 and through the lid 810. The lid 810 generally comprises a cover 812 and a moveable or rotatable element 850.

Figure 25:
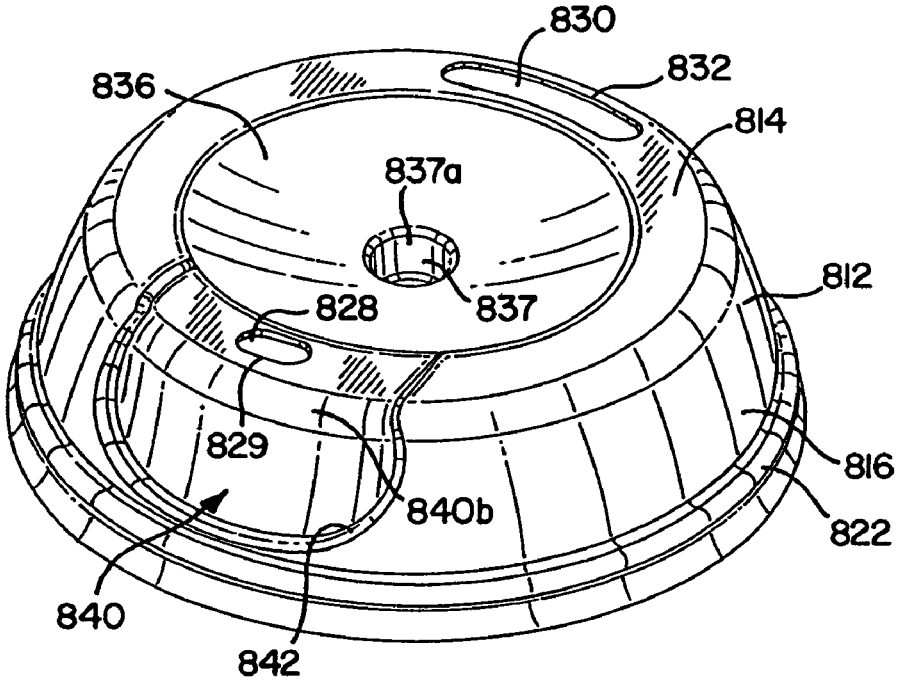
FIG. 25 is a perspective view of a cover of the lid of FIG. 23.

The cover 812 is adapted to be attached to the container 825 that holds a flowable substance. The cover 812 is adapted to span the opening in the upper portion of the container 825 that is generally defined by an upper rim or edge 827 of the container 825. For illustrative purposes, the container 825 could be a coffee cup having an opening defined by the rim of the cup. The cover 812, as illustrated in FIGS. 23-25, generally has a top wall 814, a side wall 816, and a mounting portion 822 adapted to be attached to the container 825.

The top wall 814 is generally annular, although other configurations are possible. The side wall 816 depends from a peripheral edge 818 of the top wall 814. Although the top wall 814 is shown as having a generally level upper surface 814*a*, the upper surface 814*a* can be curved or angled. The side wall 816 has a side wall surface 816*a* and a lower edge 820. The side wall surface 816*a* can be curved or generally flat. The overall shape of the cover 812 is generally frustoconical, however, the cover 812 can have a number of other configurations.

A mounting portion 822 depends from the lower edge 820 of the side wall 816, and can be considered as part of the side wall 816. The mounting portion 822 includes a generally annular flange 824 and a generally annular skirt 826. The mounting portion 822 is adapted for connecting the lid 810 to the container 825 in a manner that seals the lid on the container 825. Thus, the mounting portion 822 prevents leakage of the container 825 contents between the lid 810 and the container 825 when the lid 810 is positioned on the container 825. In a preferred embodiment, the mounting portion 822 is integral with the side wall 816.

A drink opening 828 is located preferably in the top wall 814. Alternatively, the opening 828 is located in the side wall 816. The opening 828 is adapted to permit the passage or flow of the flowable contents held by the container 825 through the cover 810. The opening 828 has an edge 829 that defines the shape of the opening 828. Although shown in FIGS. 23-25 as having an obround shape, the opening 828 can have a variety of shapes, including but not limited to circular, square, or rectangular.

A slot or channel 830 is located preferably in the top wall 814. Alternatively, the slot 830 may be located in the side wall 830. The slot 830 permits access to the actuator 854 used for rotating the moveable element 850 as described in greater detail below. The slot 830 has an edge 832 that defines the shape of the slot 830. Although shown in FIGS. 23-25 as having an obround shape, the slot 830 can have a variety of shapes, including but not limited to circular, square, or rectangular. Because the slot 830 must provide access to the actuator 854, the shape and size of the slot 830 will be related to the form and size of the actuator 854. As previously described, in an alternate embodiment, the moveable element 850 can have two apertures. While most features of the cover 810 need not be changed to adapt to a double-aperture element, the slot 830 may need to be enlarged to accommodate the larger range of motion required to move between additional positions.

As further shown in FIGS. 23, 25 and 27, the cover 810 has a support member 837, which preferably depends from a central portion 836 of the top wall 814. In a most preferred embodiment, the support member 837 depends from a center of the top wall 814. The support member 837 is adapted such that the rotatable element 850 may be rotatably mounted on the support member 837. The support member 837 is generally a cylindrical protrusion in the underside of the top wall 814, and has an inner side wall 837*a* and an outer side wall 837*b*. Alternatively, the support member 837 may be embodied in one of many other shapes and forms. For example, the support member 837 may contain or comprise a lip or cusp (not shown) for securing the disk. Furthermore, although in the preferred embodiment, the support member 837 is located substantially in the center of the top wall 814, it need not be located in the center, nor even in the top wall 814. Additionally, the support member 837 need not depend from the top wall 814, and may comprise any form on which the element 850 may be rotatably mounted, for example a depression on the underside of the top wall 814 (which may form a projection from the upper side of the top wall) or an aperture through the top wall 814. Preferably, the support member 837 is integral with the top wall 814, but a separable support member would function suitably. In addition, the support member 837 may comprise a separate rivet member. The support member 837 could also comprise a generally arrowhead-shaped member that cooperates with an opening in the moveable element 850. The support member 837 could also form part of a ball and socket arrangement with the moveable element 850 to rotatably support the element 850. It is further understood that in a preferred embodiment, the element 850 is rotatably supported on an underside of the cover 812. It is appreciated, however, that the element 850 could be supported on a top surface of the cover 812 to provide the reclosable lid of the present invention.

As shown in FIG. 23, the top wall 814 has a center portion 836 which is preferably recessed such that the center portion 836 has a curvilinear configuration when viewed in cross-section. The degree of recess or curvature of the center portion 836 can vary with the design parameters of the lid. Alternatively, the entire top wall 814 is in planar alignment. In this configuration, the center portion 836 is not recessed.

Referring to FIGS. 23 and 24, the side wall 816 has a recessed portion 840, which is adapted to receive a lip of a person drinking from the container. An edge 842 of the recessed portion 840 defines the configuration of the portion. The recessed portion 840 is positioned radially inward from the side wall surface 816*a*. Although the recessed portion 840 is shown positioned on both the top wall 814 and the side wall 816, the recessed portion 840 can be limited to either the top wall 814 or the side wall 816. The shape and configuration of the recessed portion 840 can be varied to conform to numerous design parameters. Similarly, the degree of recess of the portion 840 can vary. For example, as shown in FIG. 1, the recessed portion 840 is deeper at a base portion and shallower at an end proximate the drink opening 828. Preferably, the recessed portion 840 is positioned about the drink opening 828. The top wall 814 and the side wall 816 cooperate to form a rounded edge or shoulder 840*b* at the recessed portion 840. It is further understood that the cover 812 of the lid 810 could also have a tab formed thereon as shown in the embodiment of FIG. 9.

The moveable element, or disk, 850 is illustrated in FIGS. 23 and 26. The element 850 is rotatably mounted on the support member 837 of the cover 812 such that the support member 837 is received in a portion of the element 850. As discussed above, several structures have been disclosed and other structures are possible wherein the element 850 is rotatably supported with respect to the cover 812. In addition, although the moveable element 850 is illustrated as a disk, and is referred to interchangeably as a "disk" throughout this description, this is only illustrative of the preferred embodiment. The moveable element 850 may take any of a multitude of forms other than a disk, and the shape of the movable element 850 is not a limitation of the present invention. For example, the disk can be ring-shaped as described above in other embodiments of the invention.

As shown in FIG. 26, the element 850 has an aperture 878, an actuator 854 accessible through the slot 830, a projection 852, and an indentation or depression 881. The element 850 has an outer edge 851 and a top wall 856 with an top wall surface 856*a* and a center portion 862. A side wall 859 depends from the top wall 856. The top wall 856 has a center portion 862 extending radially inward from the top wall surface 856*a*. Preferably, the center portion 862 is recessed such that the center portion 862 has a curvilinear configuration when viewed in cross-section. The degree of recess or curvature of the center portion 862 can vary with the design parameters of the lid 810. Preferably, the degree of recess of the center portion 862 of the element 850 is similar to the degree of recess of the center portion 836 of the cover 812. Alternatively, if the entire top wall 814 of the cover 812 is in planar alignment, the top wall surface 814*a* and the center portion 862 of the element 850 are also in planar alignment.

The projection 852 extends from a portion of the top wall 856. The projection 852 has a peripheral edge 853 that defines the shape of the projection 852. Preferably, the projection 852 is cooperatively dimensioned with the drink opening 828 such that at least a portion of the projection 852 is adapted to be received by, or positioned in, the opening 828. The projection 852 has a projection surface 852*a* that is preferably sloped or angled to facilitate reception of the projection 852 by the opening 828. When the projection 852 is completely received in the opening 828, the opening 828 is sealed and the lid 810 is in the closed position shown in FIG. 23. Although the presence of the projection 852 is preferable, it is not essential to the present invention. Alternatively, the element 850 has a generally planar surface that is aligned with a surface of the cover 812 proximate the opening 828 in a surface-to-surface engagement such that the opening 828 is sealed. Such as shown in the above embodiments, the element 850 can have a opening adapted to drain the flowable contents into the container 825.

The actuator 854 is accessible through the slot 830 in the cover 812, and is manipulated to move the element 850 between an open position P2 and a closed position P1. As illustrated in FIG. 26, the actuator 854 is preferably a post, but may take any other form suitable for manipulation. For example, the actuator 854 could be a small projection or protuberance; a series of smaller projections, bumps, or ridges; or simply a high-friction surface. The post 854 of the preferred embodiment extends from a portion of the top wall 856. In an alternative embodiment, the post or actuator 854 may be positioned on the side wall 859 of the element 850, and the slot 830 may be correspondingly positioned on the side wall 816 of the cover 812. The post 854 can have either a solid or hollow construction depending upon design parameters. At least a portion of the post 854 is received by the slot 830 and extends past the top wall surface 814*a*. Although the configuration and dimensions of the post 854 can vary according to design parameters of the lid 810, the post 854 must retain a configuration that permits it to be accessible through the slot 830. As shown in FIG. 26, the post 854 has a catenoid shape. The post 854 can have a gripping portion (not shown) that is adapted to facilitate the engagement of a user's fingers with the post 854. The gripping portion can be integral to the post 854 or it can be a separate element fastened to a portion of the post 854. For example, the gripping portion can be a plastic or rubber element fastened to the walls of the post 854.

As shown in FIG. 26, the disk 850 has at least one aperture 878. The aperture 878 has a peripheral edge 880 that defines the shape of the aperture 878. When the aperture 878 is aligned with the drink opening 828, a passageway is formed between the element 850 and the cover 812 permitting the passage or flow of the flowable substance held by the container 825 through the lid 810. Although the aperture 878 can have a variety of configurations and dimensions, the aperture 878 is preferably cooperatively dimensioned with the drink opening 828. In a preferred embodiment, the aperture 878 is positioned on the disk top wall 856 and spaced a distance from the projection 852. In another preferred embodiment, similar to the embodiment described in FIGS. 15-16, the element 850 could include two separate apertures, each spaced a distance from the projection 852. The aperture 878 may be positioned on the disk side wall 859 if necessary, such as if the drink opening 828 of the cover 812 is positioned on the cover side wall 816. The aperture 878 could be formed merely by forming a slot or channel in the peripheral edge 851 of the element 850.

A disk recessed portion 884 is preferably positioned about the projection 852 and the aperture 878. The degree of recess of the portion 884 can vary. Although the recessed portion 884 is shown positioned on a portion of both the disk side wall 859 and the disk top wall 856, the recessed portion 884 can be limited to either the side wall 859 or the top wall 856. The recessed portion 884 is adapted to be received by an inner surface of the recessed portion 840 of the cover 812 when the element 850 is positioned proximate the cover 812. The position of the recessed portion 884 of the element 850 is similar to the position of the recessed portion 840 of the cover 812.

An indentation 881 is located in the center 862 of the disk top wall 856, and is one preferred mechanism for rotatably mounting the disk 850 on the support member 837. As discussed, several structures can be used to rotatably support the element 850 on the cover 812. The indentation 881 illustrated in FIG. 26 is cylindrical in shape, and has an indentation edge 883 and an inner side wall 885. Alternatively, the indentation 881 may have a more complex shape, or may simply comprise an aperture. The support member 837 and the indentation 881 are cooperatively dimensioned such that they are in rotational engagement with each other. Preferably, the support member 837 and the indentation 881 engage each other with an interference fit between the inner side wall 883 of the indentation 881 and the outer side wall 837*b* of the support member 837, as illustrated in FIG. 27.

Referring to FIG. 23, the element 850 and the cover 812 are cooperatively dimensioned such that the element 850 can be positioned within the interior region defined by the cover 812, to comprise an "assembled position," wherein the element 850 is rotatably mounted on the support member 837. As further shown in FIGS. 23, 27 and 28, the element 850 is attached to the support member 837 in such a way that the element 850 is held in place, while having at least some freedom to rotate in either direction. Preferably, as described above, the support member 837 and the indentation 881 are cylindrically shaped and engage each other with an interference fit. Other structures could be added to the support member 837 and indentation 881 to enhance the rotatable connection. However, many other mechanisms for rotatably mounting the element 850 upon the support member 837 exist, and the present invention is not intended to be limited to any particular mechanism for rotational engagement between the element 850 and the cover 812. In one alternative embodiment, the support member 837 contains or comprises a lip or cusp for holding the disk in place, eliminating the necessity for an interference fit. In another possible embodiment, the support member 837 consists of only an aperture, and the disk contains a cooperatively dimensioned projection that extends through the aperture to support the disk, rather than an indentation. Furthermore, it is understood that the male/female aspects of the support member 837 and indentation 881 could be reversed on the cover 812 and element 850. The key aspect of the present invention is not the structure of the mounting mechanism, but the use of a moveable element rotatably mounted by a support member.

In the assembled position, the actuator 854 is accessible by a user through the slot 830. In the preferred embodiment, the element 850 is positioned proximate the cover 812 such that at least a portion of the post 854 is received by and extends through the slot 830. In this configuration, the element 850 is positioned beneath the cover 812 such that the center portion 836 of the cover 812 is proximate the center portion 862 of the element 850. The actuator 854 may take one of many other forms, but regardless of the form of the actuator, it is accessible through the slot 830.

In the assembled position, the element 850 is movable by rotating between a first, or closed, position and a second, or open, position. The element 850 is moved between the first and second positions P1, P2 by manipulation of the actuator 854 by a user. In the first position P1, as shown in FIG. 23, the projection 852 is received by the drink opening 828 such that the opening 828 is sealed and the lid 810 is closed. When the opening 828 is sealed, the edge 829 of the opening 828 is in frictional engagement with the projection 852. The top portion of the projection 852 can extend past the edge 829 of the drink opening 828. This seal prevents the flow of the flowable substance in the container 825 through the opening 828, enabling the container 825 and lid 810 to be moved without risking spillage. Also, in the first position P1, the recessed portion 862 of the element 850 is engaged with the recessed portion 836 of the cover 812. In addition, in the first position P1, the aperture 878 is misaligned or offset from the opening 828. Alternatively, the projection 852 and the opening 828 are in a snap fit engagement wherein each have sufficient structure to enable the snap fit engagement. Other cooperating structures can also be utilized.

In an alternate configuration of the element 850, the projection 852 is omitted (not shown), and the top wall surface 856 is substantially flat. In the first position P1, the flat top wall 856 surface of the element 850 is aligned with the opening 828 in a surface-to-surface engagement such that the opening 828 is sealed.

In the second position P2, the aperture 878 is aligned with the drink opening 828 to form a passageway between the element 850 and the cover 812 wherein the lid 810 is open, as illustrated in FIG. 28. The passageway permits the passage or flow of the flowable substance held by the container 825 through the lid 810. When the lid 810 is in the second position P2, at least a portion of the aperture 878 is aligned with at least a portion of the edge 829 of the drink opening 828. In addition, in the second position P2, the projection 852 is misaligned with, or offset from, the opening 828. When the aperture 878 is partially aligned with the drink opening 828, the passageway remains but its dimensions are reduced. When the aperture 878 is completely misaligned with the drink opening 828, the passageway is eliminated. When the aperture 878 is completely misaligned with the drink opening 828 and the projection 852 is received in the opening 828, the opening 828 is sealed and the lid 810 is in the first position, P1. Alternatively, if no projection is present, the element 850 is returned to the first position P1 wherein the aperture 878 is completely misaligned with the drink opening 828, and the opening 828 is sealed.

A user can move the element 850 between the first position P1 and the second position P2 by manipulating the actuator 854. In the preferred embodiment, this is done by grasping and actuating or manipulating the post 854 between the first end 830*a* of the slot 830 and the second end 830*b* of the slot 830. Referring to FIG. 23, when the post 854 is proximate the first end 830*a*, the element 850 is in the first position P1. Conversely, referring to FIG. 28, when the post 854 is proximate the second end 830*b*, the element 850 is in the second position P2. The post 854 can be located in a number of positions between the first and second ends, and as a result, the projection 852 can be misaligned with the opening to varying degrees.

As explained above, the element 850 can have a first and second aperture, wherein the apertures are positioned about the projection such as shown by the disk in FIG. 16. In this configuration, the disk can be rotated in either a clockwise or counter-clockwise direction to move the disk between a first position, in which the lid is closed, and a second position and a third position, in which the lid is open. In this position, the actuator is located close to the center of the slot, rather than at either end. When the disk is in the first position, rotating the disk in the clockwise direction brings the first aperture into alignment with the opening. Similarly, when the disk is in the first position, rotating the disk in the counter-clockwise direction moves the disk to the third position, bringing the second aperture into alignment with the opening. This feature further increases the flexibility and value of the lid.

Several additional embodiments of the lid of the present invention are further disclosed herein and described below.

FIGS. 29-36 disclose another embodiment of the lid, generally designated with the reference numeral 1010. The lid 1010 generally includes a cover 1012 and a moveable element 1050.

Figure 29:
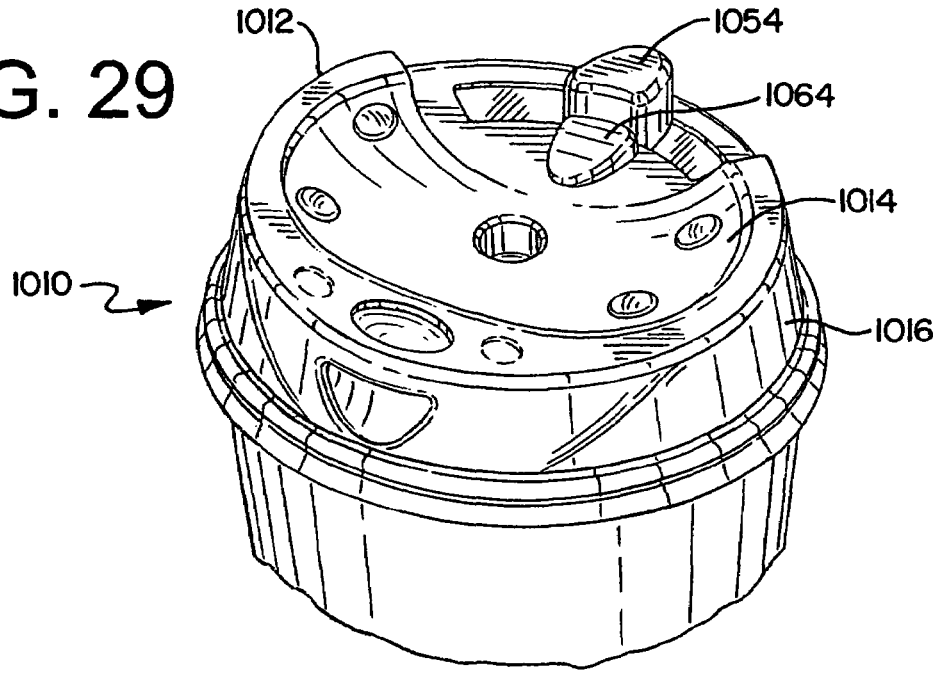
FIG. 29 is a perspective view of an alternate embodiment of the lid of the present invention, the lid shown in a closed position.

The cover 1012 has a top wall 1014 and a side wall 1016 depending from the top wall 1014. The top wall 1014 further has an opening 1028 and a slot 1030. The cover 1012 further has a mounting portion 1022 connected to the side wall 1016 that is configured to mount to a container or cup as shown in FIG. 29. The top wall 1014 further has a support member 1034 generally at a central portion 1017 of the top wall 1014. In one preferred embodiment, the support member 1034 is in the form of a depending post.

Figure 31:
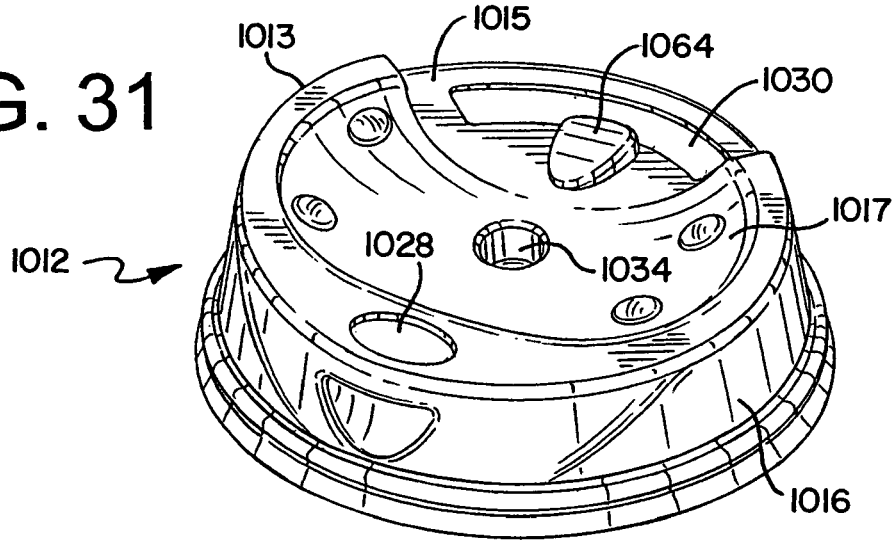
FIG. 31 is a perspective view of a cover of the lid of FIG. 29.
Figure 32:
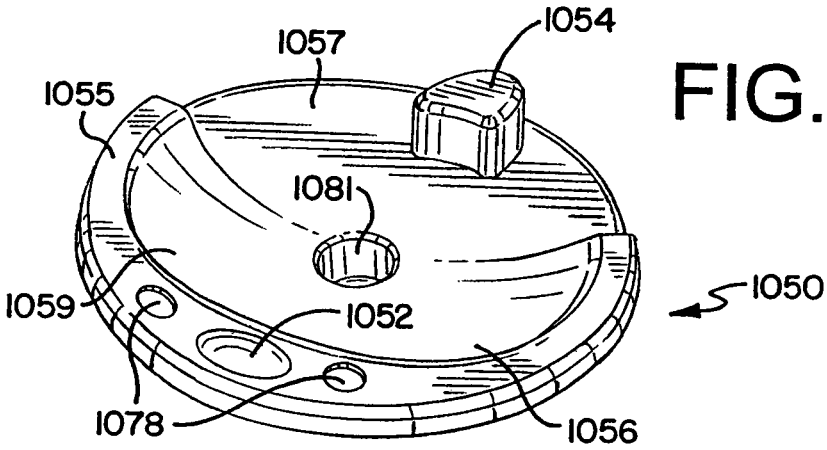
FIG. 32 is a perspective view of a moveable element of the lid of FIG. 29.

In this embodiment, the top wall 1014 of the cover 1012 is bi-leveled, as further shown in FIGS. 29 and 31. The top wall 1014 has an upper level 1013 and a lower level 1015. The relatively annular upper level 1013 is connected to the relatively planar lower level 1015 by the tapering central portion 1017. This configuration provides a means of clearance for a nose of a user drinking from the container. The slot 1030 is located on the lower level 1015 and the opening 1028 is located on the upper level 1013. As further shown in FIGS. 29 and 31, the cover 1012 further includes a position indicator 1064 located on the top wall 1014 generally at the central portion 1017. The position indicator 1064 is described in greater detail below.

As further shown in FIGS. 29-33, the moveable element 1050 is rotatably mounted on the cover 1012. The moveable element 1050 is generally disk-shaped and has a projection 1052, an aperture 1078 (preferably a first aperture 1078 and a second aperture 1078), and an actuator 1054. The moveable element 1050 further has a central indentation 1081 that cooperates with the support member 1034 of the cover 1012 as described in greater detail below. Additionally, the moveable element 1050 is cooperatively dimensioned to accommodate the bi-leveled top wall 1014 of the cover 1012. Like the cover 1012, the moveable element 1050 has a top wall 1056 that has a relatively annular upper level 1055 and a relatively planar lower level 1057 connected by a tapering central portion 1059.

Figure 30:
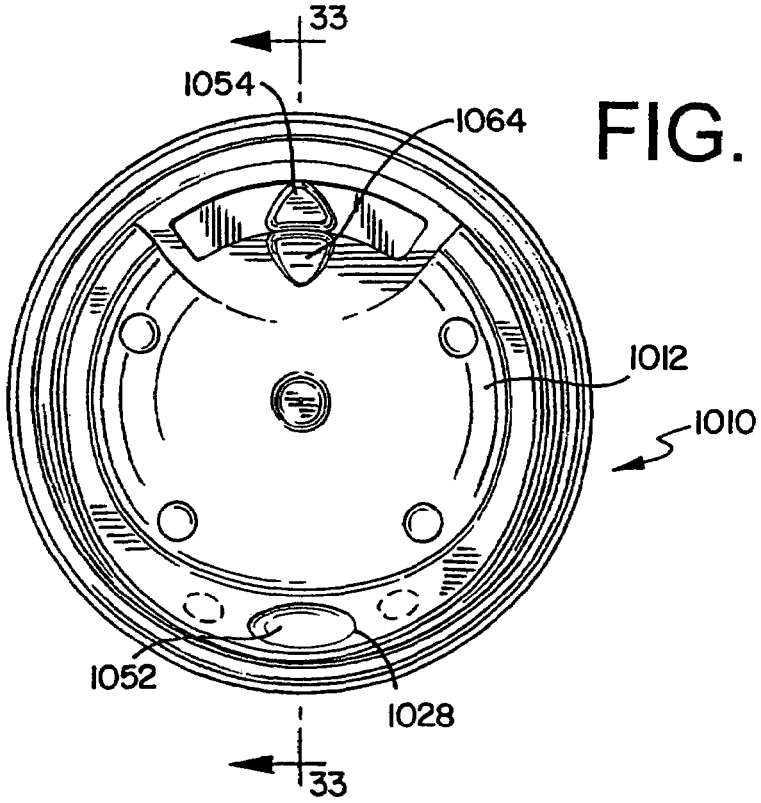
FIG. 30 is a top plan view of the lid of FIG. 29, the lid shown in a closed position.
Figure 33:
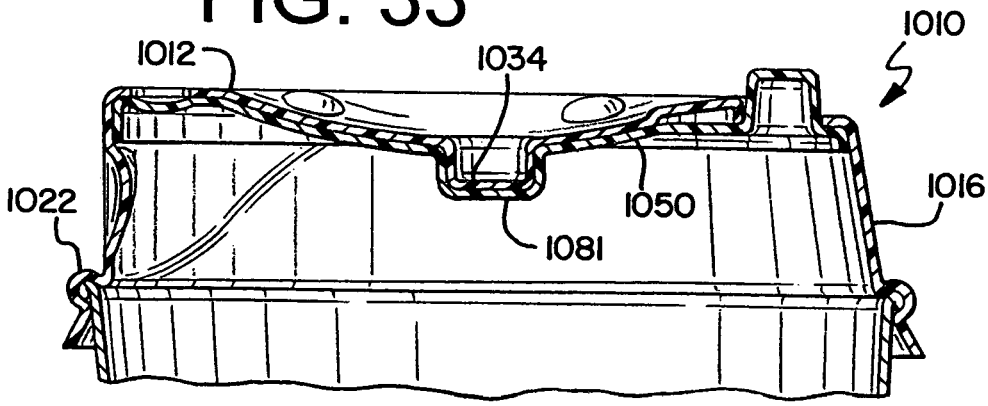
FIG. 33 is a cross-sectional view of the lid of FIG. 23, taken along lines 33-33 of FIG. 30.

As shown in FIGS. 29, 30 and 33, the moveable element 1050 is rotatably mounted on the cover 1012. Preferably, the moveable element 1050 is mounted on the support member 1034 wherein the indentation 1081 of the moveable element 1050 is received by the support member 1034 of the cover 1012. The indentation 1081 is dimensioned so as to fit around the support member 1034. However, the moveable element 1050 may be rotatably mounted on the support member 1034 by any other known means as well as those methods described herein. Once properly mounted, the actuator 1054 is received by the slot 1030. In the assembled lid 1010, the actuator 1054 is accessible through the slot 1030.

The moveable element 1050 is moveable between a first position and a second position by rotation of the moveable element 1050 about the support member 1034. FIGS. 29 and 30 show the lid 1010 in the first position defining a closed position. In the closed position, the projection 1052 is positioned within the opening 1028. The apertures 1078 are misaligned with the opening 1028. Also, the position indicator 1064 indicates to the user that the lid 1010 is in the closed position. The indicator 1064 is aligned with the actuator 1054 to indicate the closed position. As shown in FIG. 34, the moveable element 1054 is rotatably moveable to the second position such as by a user manipulating the actuator 1054. The second position defines an open position wherein the aperture 1078 is aligned with the opening 1028 wherein a flowable substance can pass therethrough. In this position, the actuator 1054 is positioned to one end of the slot 1030 wherein the actuator 1054 is misaligned with the position indicator 1064. As further shown in FIG. 35, because the moveable element 1054 has a second aperture 1078, the actuator 1054 can be rotated in an opposite direction than as shown in FIG. 34, wherein the actuator 1054 is rotated to an opposite side of the slot 1034. In this position, the other aperture 1078 is aligned with the opening 1028. Thus, the moveable element 1054 can be rotated in either a clockwise direction or a counterclockwise direction to place the moveable element 1054 in the second, open position.

It is understood that the position indicator 1064 and the actuator 1054 have first and second positional relationships with respect to one another when the lid is in the closed and open positions. In the present embodiment, the closed position is indicated by the position indicator 1064 being aligned with the actuator 1054. The open position is indicated by misalignment of the indicator 1064 and the actuator 1054. It is understood, however, that this configuration could be reversed wherein an aligned configuration could indicate an open position and a misalignment could indicate a closed position. It is further understood that the indicator 1064 may take other forms.

FIGS. 37-43 disclose another embodiment of the lid of the present invention. The lid 1110 generally includes a cover 1112 and a moveable element 1150.

Figure 37:
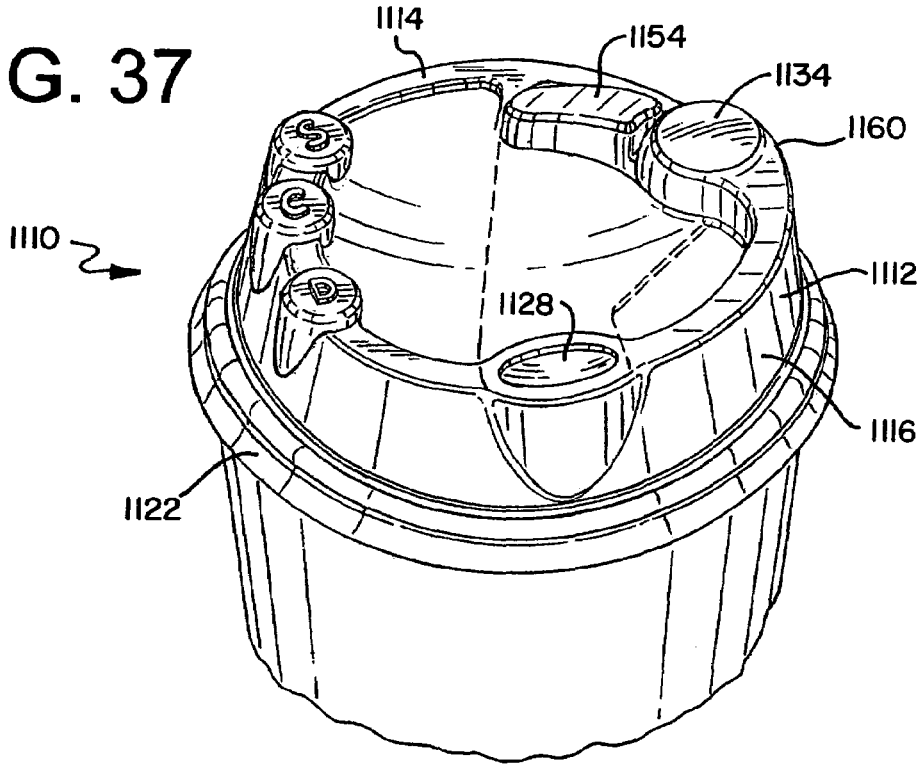
FIG. 37 is a perspective view of an alternate embodiment of the lid of the present invention, the lid shown in a closed position, the position of a moveable element indicated by broken lines.
Figure 38:
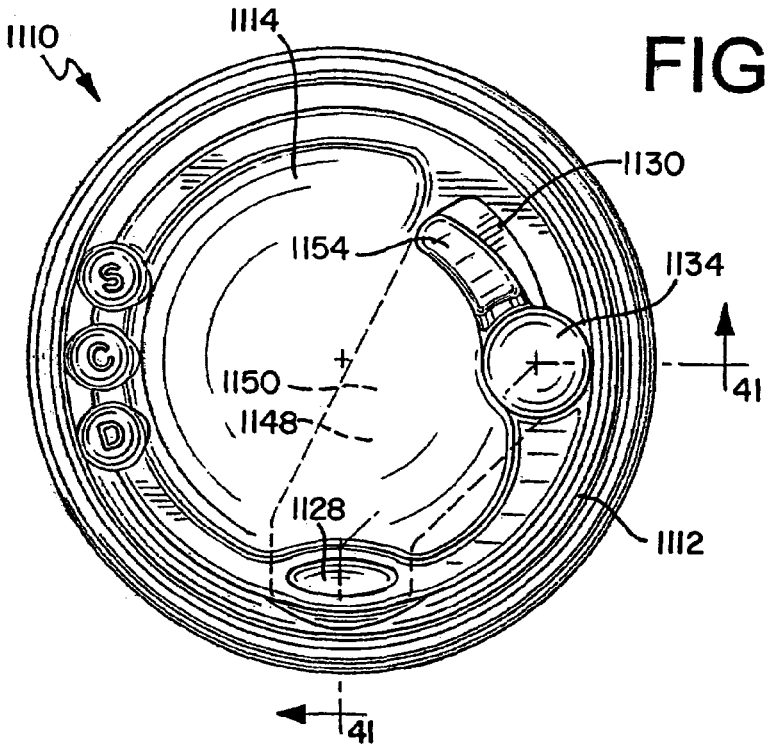
FIG. 38 is a top plan view of the lid of FIG. 37, the lid shown in the closed position, the position of the moveable element indicated by broken lines.

As further shown in FIGS. 37-39, the cover 1112 has a top wall 1114 and a depending side wall 1116. The cover 1112 further has an opening 1128, a slot 1130, a mounting portion 1122, and a support member 1134. The opening 1128 is preferably in the top wall 1114 but could be in other locations such as the side wall 1116. The support member 1134 protrudes, rather than depends, from the top wall 1114, and the support member 1134 is located near an edge 1160 of the top wall 1114, rather than in the center, as illustrated in FIGS. 37-43. As described in greater detail below, the moveable element 1150 is pivotally mounted on the support member 1134.

Preferably, the support member 1134 for this embodiment is a protrusion from the top wall 1114, which receives a member projecting from the moveable element 1150. Alternately, the support member 1134 can have any one of the many possible configurations already discussed herein. The slot 1130 in the top wall 1114 provides access to an actuator associated with the moveable element 1150 and allows the moveable element 1150 to pivot between the open and closed positions. As further shown in FIG. 37, the cover 1112 may have indicators for additives that may be included with flowable contents contained in the container, generally designated "S," (sugar) and "C" (cream). Other indicators, such as "D" (decaf) may also be included.

As shown in FIG. 40, the moveable element 1150 of the lid 1110 includes a knob 1151 and an actuator 1154 affixed to an appendage 1148. The appendage 1148 is an elongated finger-type member rather than being disk-shaped. Preferably, the moveable element 1150 has no aperture, and opens and closes the lid 1110 by blocking or moving away from the opening 1128, creating an open position and a closed position. Alternately, the moveable element 1150 contains an aperture (not shown). The moveable element 1150 can also contain a projection 1152 for sealing the opening 1128 when the moveable element 1150 is in the closed position. The moveable element 1150 is pivotably mounted on the support member 1134. Preferably, and as can be appreciated from FIGS. 41-43, the knob 1151 fits inside the support member 1134, forming an interference fit, allowing the moveable element 1150 to pivot between the open and closed positions. Nearly any means discussed herein of rotatably mounting a moveable element 1150 on a support member 1134 will function to pivotably mount a moveable element 1150 as well. Thus, a wide range of mounting configurations are available.

Figure 42:
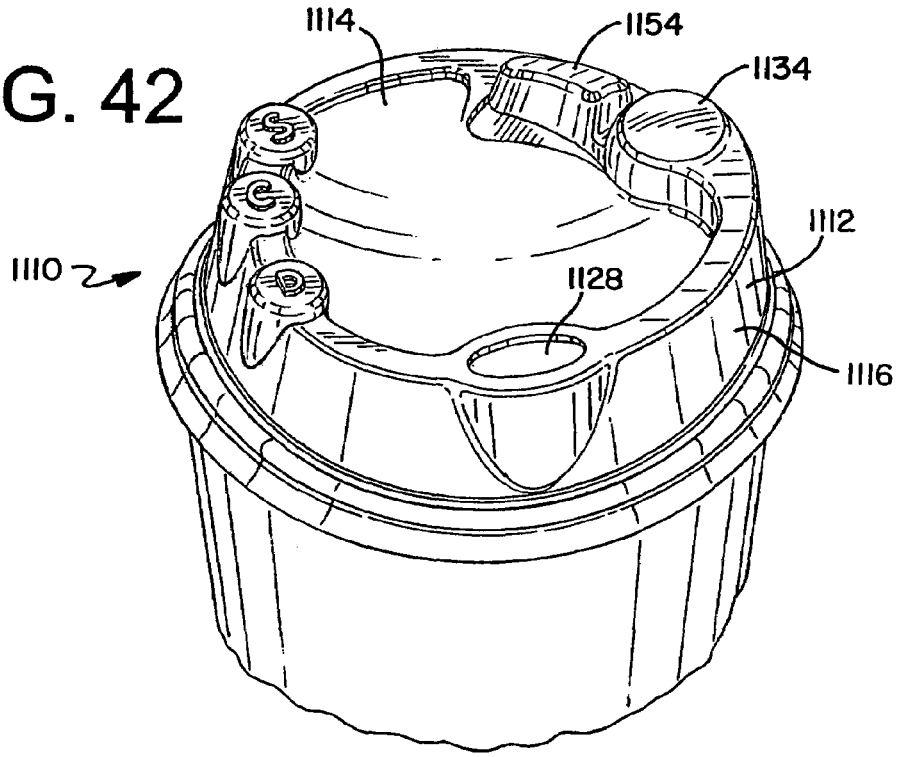
FIG. 42 is a perspective view of the lid of FIG. 37, the lid shown in an open position.
Figure 43:
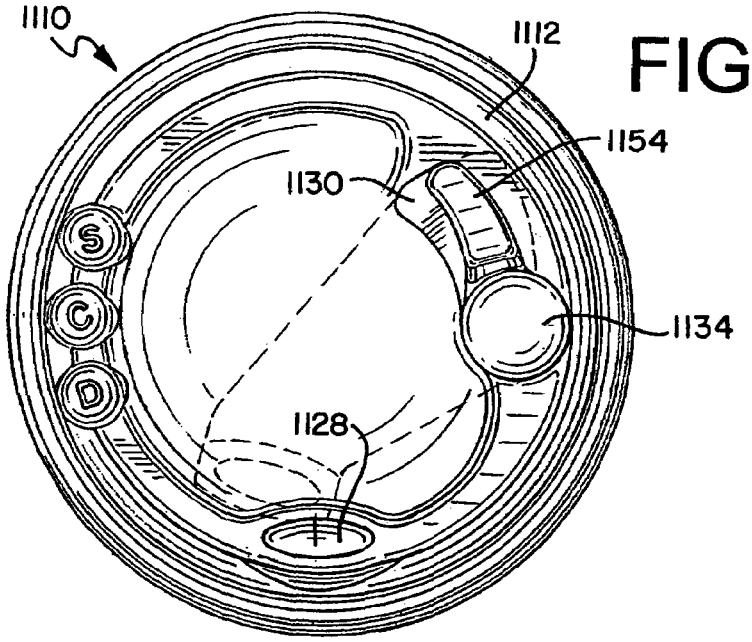
FIG. 43 is a top plan view-of the lid of FIG. 37, the lid shown in the open position, the position of the moveable element indicated by broken lines.
Figure 44:
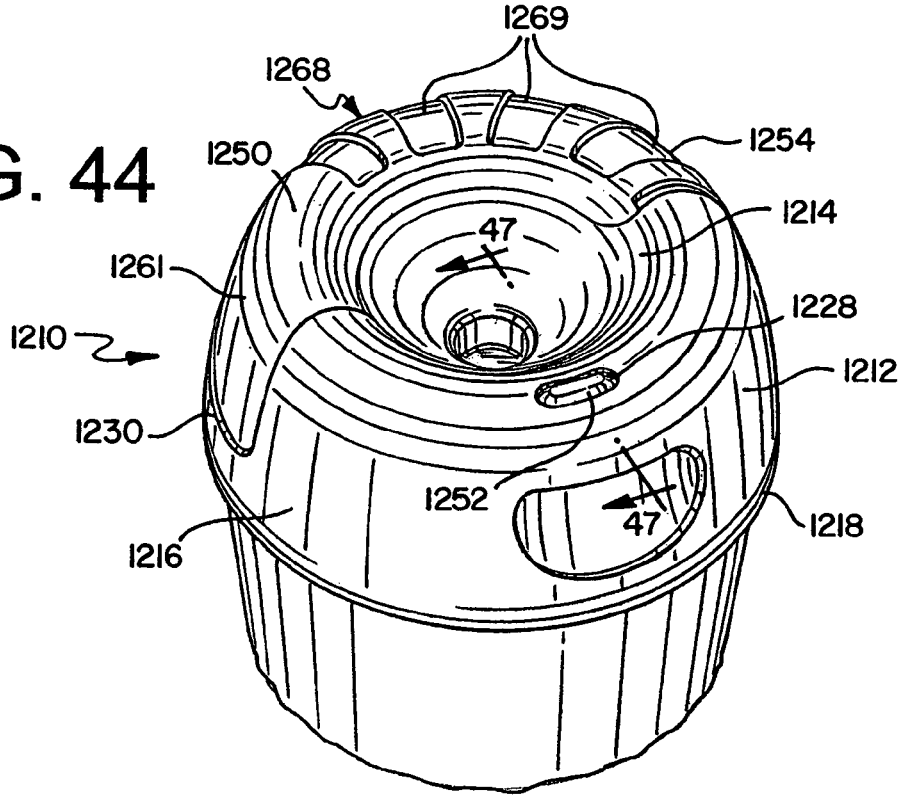
FIG. 44 is a perspective view of an alternate embodiment of the lid of the present invention, the lid shown in a closed position.

As shown in FIGS. 41-43, the lid 1110 is moveable between an open position and a closed position by the user manipulating the actuator 1154, which is accessible through the slot 1130. The appendage 1148 of the moveable element 1150 is preferably a generally elongated member, as illustrated in FIG. 40. In the closed position, illustrated in FIGS. 37 and 38, the tip of the appendage 1148 obstructs the opening 1128. The actuator 1154 is positioned at an end of the slot generally towards a central portion of the cover 1112. In the open position, illustrated in FIGS. 42 and 43, the appendage 1148 is pivoted away from the opening 1128, allowing a flowable substance to pass through. A user forces the actuator 1154 to an opposite end of the slot 1130 generally towards an outer edge of the container 1112. Thus, the actuator 1154 moves to and from a center portion of the cover 1112 or to and from an outer edge of the cover 1112. This movement pivots the moveable element 1150 about the support member 1134. The slot 1130 of this embodiment is fairly short in length, since the proximity of the actuator 1154 to the point of rotation requires a small movement for operation. The movement and location of the actuator 1154 of this embodiment favors the use of a trigger-shaped actuator 1154, rather than the standard post described above. It is understood that the location of the support member 1134 could vary to accommodate different shapes of pivoting moveable members 1150.

FIGS. 44-47 disclose another embodiment of the lid of the present invention, generally designated with the reference numeral 1210. The lid 1210 generally includes a cover 1212 and a moveable element 1250.

The cover 1212 has an opening 1228, a slot 1230, a mounting portion 1218, and a support member 1234 depending from a center of the top wall 1214. The top wall 1214 has a central recessed portion. The support member 1234 is generally in the form of a post. As described in greater detail below, the moveable element 1250 is rotatably mounted on the support member 1234. The slot 1230 is a large slot 1230 and extends about a half of the circumference of the cover 1212, and further extends to both the top wall 1214 and sidewall 1216 of the cover 1212. Further, the cover 1212 contains a stop 1270 (FIG. 47) that constrains the rotation of the moveable element 1250 as described in greater detail below.

Figure 46:
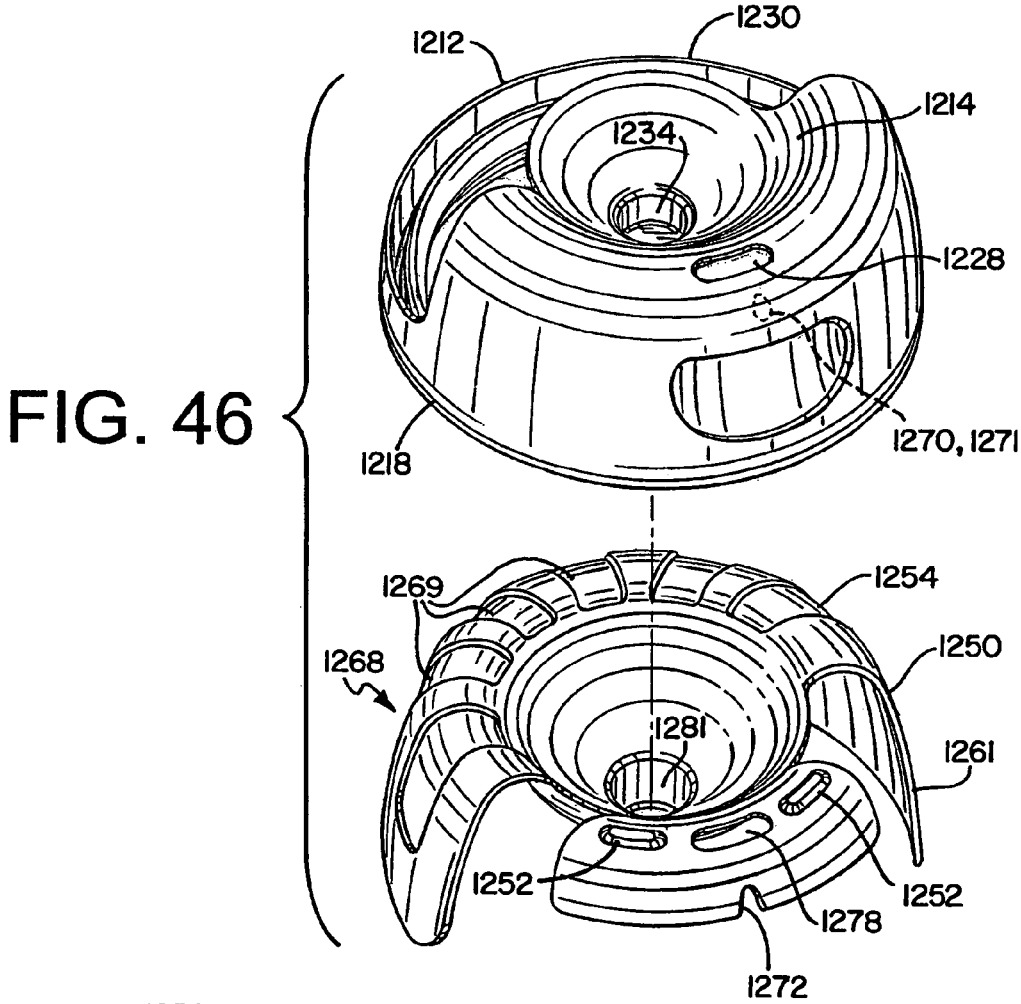
FIG. 46 is an exploded perspective view of the lid of FIG. 44, with a connection between the cover and moveable element shown with broken lines.
Figure 47:
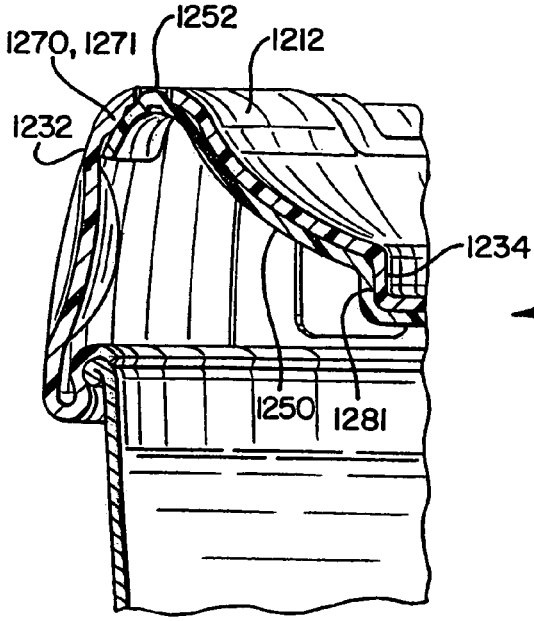
FIG. 47 is a partial cross-sectional view of the lid of FIG. 44, taken along lines 47-47 of FIG. 44.

As shown in FIGS. 46-47, the moveable element 1250 has a central recessed portion that corresponds to the central recessed portion of the cover 1212. The moveable element 1250 has an indentation 1281 that defines a recess. As explained in greater detail below, the indentation 1281 receives the support member 1234 of the cover 1212 for rotatable support. The moveable element 1250 further has an aperture 1278 and a projection 1252 on each side of the aperture 1278. The aperture 1278 and projections are located on a frontal segment of the moveable element 1250. Finally, the moveable element 1250 has an actuator 1254 accessible through the slot 1230. The actuator 1254 extends around a circumference of the element and is spaced from the frontal segment. Generally, the moveable element 1250 in contoured to correspond in shape with the inside structure of the cover 1212.

The actuator 1254 defines an extended side wall 1261 opposite the aperture 1278. The actuator 1254 has recesses 1269 on the side wall 1261 to form a gripping element 1268 to enhance the grippability of the actuator 1254. To accommodate this extended side wall 1261, the slot 1230 in the cover 1212 extends through a portion of the cover top wall 1214 and through most of the height of the cover side wall 1216, stretching for nearly half the circumference of the cover 1212. The configuration of this embodiment of the present invention provides a large area of access to the actuator 1254.

As shown in FIGS. 46 and 47, the moveable element 1250 is preferably rotatably supported by the cover 1212. The moveable element 1250 is positioned within the cover 1212 wherein the indentation 1281 receives the support member 1234. The indentation 1281 is dimensioned so as to fit around the support member 1234. However, the moveable element 1250 can be rotatably mounted on the support member 1234 by any means described herein. As discussed and disclosed, the overall contour of the moveable element 1250 generally corresponds to the inner surface of the cover 1212.

Figure 45:
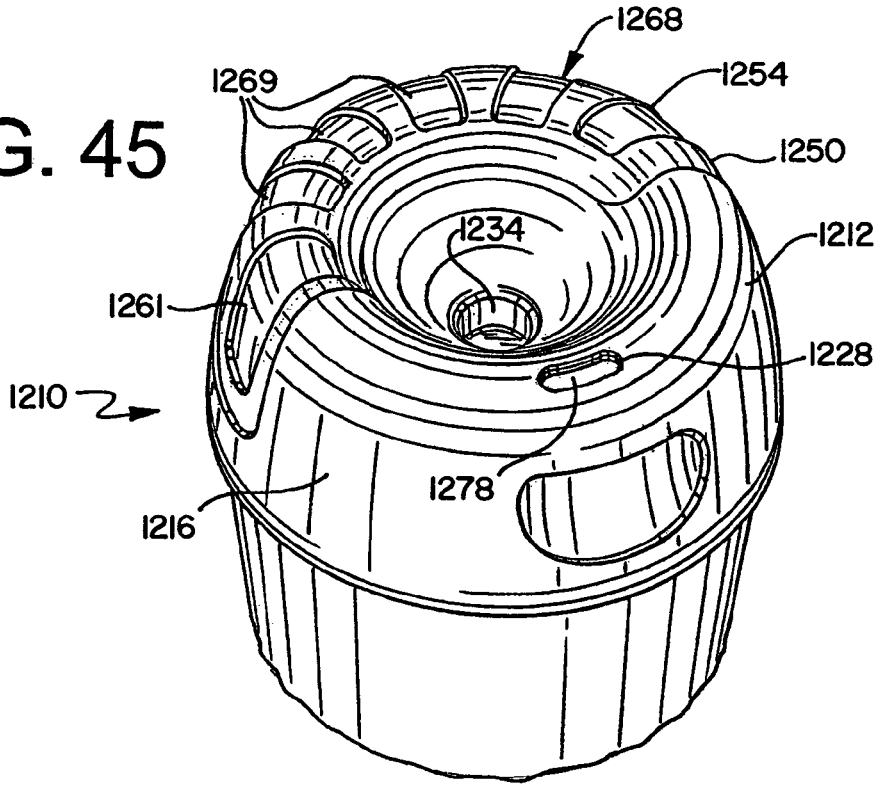
FIG. 45 is a perspective view of the lid of FIG. 44, the lid shown in an open position.

The moveable element 1250 of the lid 1210 illustrated in FIGS. 44-47 is moveable between an open position and a closed position. As shown in FIG. 45, when the aperture 1278 that is cooperatively dimensioned with the opening 1228, is aligned with the opening 1228 on the cover 1212, the lid 1210 is in the "open" position. As discussed, the projections 1252 are located on either side of the aperture 1278. When a user engages the actuator 1254 and rotates the moveable element 1250, one of the projections 1252 is aligned with the opening 1228, wherein the opening 1228 is obstructed and the lid 1210 is in the closed position. The gripping element 1268 of the actuator 1254 assists the user in rotating the moveable element 1250. It is understood that the moveable element 1250 can be rotated in an opposite direction wherein the other projection 1252 will be aligned with the opening 1228 to also create a closed lid position. Thus, the lid 1210 has two closed positions and one open position. Accordingly, as illustrated and described, the lid 1210 can be moved from one closed position, where the aperture 1278 is located to the left of the opening 1228, to the open position, and to the other closed position, where the aperture 1278 is located to the right of the opening 1228, by rotation.

As can be understood by FIGS. 44-47, the slot 1230 does not constrain the rotation of the moveable element 1250, because the actuator 1254 does not project through the slot 1230. Accordingly, the lid 1210 has at least one stop 1270 to constrain rotation of the moveable element 1250. As shown in FIGS. 46 and 47, the stop 1270 preferably comprises a tab 1271 on the inner surface 1232 of the cover 1212. The stop 1270 shown in FIGS. 46-47 is aligned with the center of the opening 1228, and the moveable element 1250 has a notch 1272 aligned with the center of the aperture 1278, such that the tab 1271 will sit within the notch 1272, partially constraining the rotation of the moveable element 1250, when the aperture 1278 and the opening 1228 are aligned. Thus, the lid 1210 will be "locked" in the open position, and small forces exerted on the lid 1210, resulting from jostling or bumping, will not move the lid 1210 from the open position. The lid 1210 may additionally or alternately include stops (not shown) to the left and/or right of the opening 1228 to create other partially constrained ("locked") positions, or to totally constrain rotation of the moveable element 1250 beyond certain points of rotation. Alternately, a stop 1270 may both partially and totally constrain rotation of the moveable element 1250, as may be desired.

As illustrated in FIGS. 5-8, the moveable element used to seal and open the lid may be an overlay (e.g. the overlay 250) rather than being positioned on the interior of the lid. However, other means of mounting the overlay on the cover exist beyond those previously illustrated and described. FIGS. 48-58 disclose additional embodiments utilizing rotatable overlay elements. It will be understood that the several embodiments share common features that will be designated with similar reference numerals. The lid disclosed in FIGS. 48-51, generally designated with the reference numeral 1310, will be described in greater detail. As there are many structural similarities, this detailed description will also apply to the other embodiments such as in FIGS. 52-53 (utilizing "1310*a*" reference designations), FIGS. 54-55 (utilizing "1310*b*" reference designations) and FIGS. 56-58 (utilizing "1310*c*" reference designations). Other distinguishing features of each embodiment will also be described.

As shown in FIGS. 48-51, the lid 1310 generally includes a cover 1312 and a moveable element in the form of a rotatable overlay 1350. As explained in greater detail below, the overlay 1350 is rotatably supported on a track of the cover 1312.

Figure 48:
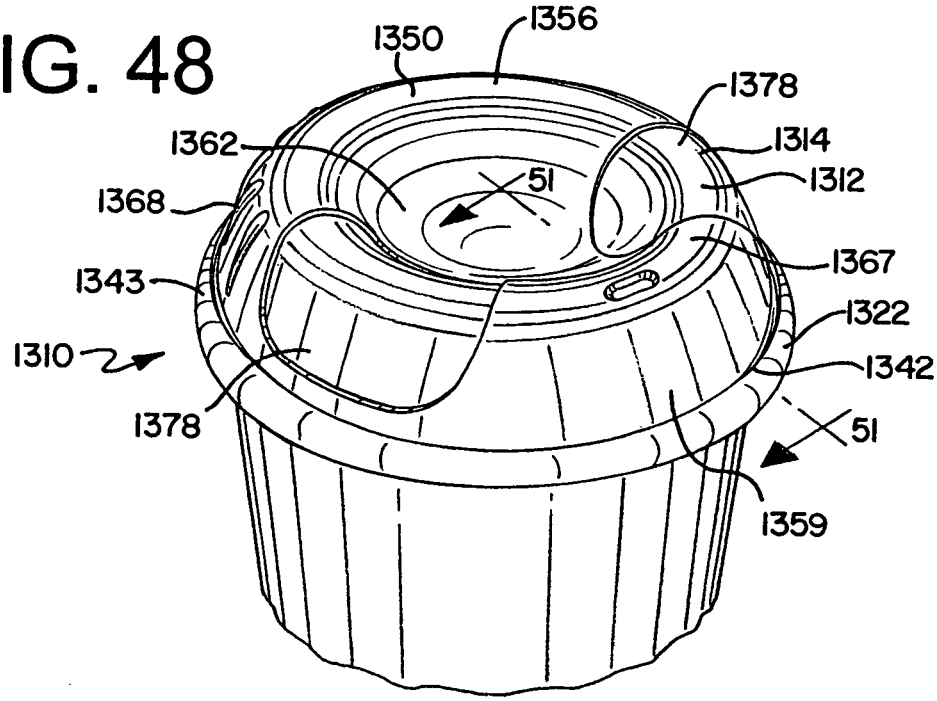
FIG. 48 is a perspective view of an alternate embodiment of the lid of the present invention, the lid shown in a closed position.

The cover 1312 generally has a top wall 1314, a side wall 1316 depending from the top wall 1314, a mounting portion 1322 at the base of the side wall 1316 and an opening 1328. The top wall 1314 also has a recessed central portion 1336. The cover 1312 further defines a track 1342 that rotatably supports the overlay 1350. As shown in FIGS. 48 and 51, the track 1342 is preferably annular, and most preferably comprises an annular cusp 1343 extending around the entire circumference of the cover 1312. The cusp 1343 is positioned on the outside of the side wall 1316 and preferably extends from a portion of the mounting portion 1322. The track 1342 is defined generally between the cusp 1343 and a portion of the mounting portion 1322.

The overlay 1350 generally has a similar contoured shape as the cover 1312. As shown in FIGS. 48 and 50, the overlay 1350 has a top wall 1356 and a depending side wall 1359. The overlay 1350 has a recessed central portion 1362 cooperatively dimensioned with the recessed central portion 1336 of the cover 1312. Additionally, the overlay 1350 preferably has at least one aperture 1378, which is aligned with the opening 1328 in the open position, providing access to the opening 1328. The aperture 1378 is preferably a cut-away portion 1378 of the overlay 1350, but is alternately a small hole or slot in the overlay 1350. Preferably, the overlay 1350 has two apertures 1378 that create a finger 1367 therebetween. The finger 1367 is adapted to seal the opening 1328 in the closed position. In one embodiment, the finger 1367 is connected to the overlay 1350 at both ends, as illustrated in FIGS. 48-51. The overlay 1350 further has an annular flange 1346 extending from the side wall 1359 of the overlay 1350. The annular flange 1346 is dimensioned to fit in the track 1342 as described in greater detail below.

Further, the overlay 1350 preferably has an actuator 1368 in the form of a gripping element 1368 to facilitate gripping and manipulating the overlay 1350, such as one or more ridges. Finally, the overlay 1350 preferably includes a projection 1352, which projects from the bottom surface of the overlay 1350, and preferably at the finger 1367. The projection 1352 fits within the opening 1328 when the lid 1310 is in the closed position, sealing the opening 1328.

As can be appreciated from FIGS. 50-51, the overlay 1350 fits over the cover 1312. As discussed, the overlay 1350 is rotatably supported in the track 1342 of the cover 1312. The annular flange 1346 on the overlay 1350 is received in the track 1342. The cusp 1343 engages the flange 1346 as shown in FIG. 51. The cusp 1343 holds the overlay 1350 close to the top of the lid 1310 while allowing it the freedom to rotate relative to the cover 1312.

Notably, while the track 1342 for mounting the overlay 1350 is preferably annular, the structure or structures creating the track 1342 need not be. For example, the annular track 1342 may alternately comprise several intermittently spaced cusps (not shown) around the circumference of the sidewall, the flange 1346 being interlocked with the cusps. Similarly, the track 1342 may only extend for a portion of the perimeter of the cover 1312. Finally, the track 1342 need not be annular, although an annular track 1342 is preferable, and any configuration of the track 1342 allowing the overlay 1350 to be rotatably mounted on the cover 1312 is effective. Still other embodiments and configurations are possible.

Figure 49:
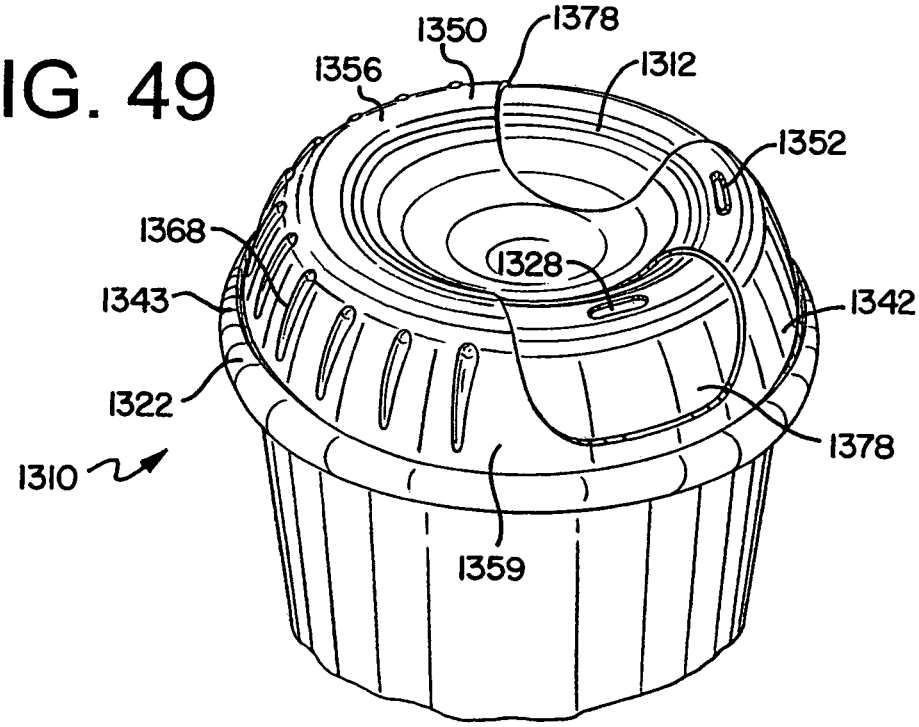
FIG. 49 is a perspective view of the lid of FIG. 48, the lid shown in an open position.

As with the previous embodiments, the lid 1310 has a closed position and an open position. The closed position is shown in FIG. 48 wherein the finger 1367 is proximate and covering the opening 1328. Furthermore, the projection 1352 is received in the opening 1328. As shown in FIG. 49, a user rotates the overlay 1350 such as by engaging the actuator 1368 wherein the aperture 1378 is generally aligned with the opening 1328 to allow a flowable substance to flow through the opening 1328. It is understood that a user could rotate the overlay 1350 in an opposite direction wherein the other aperture is aligned with the opening 1328. When moving between the open and closed positions, the overlay 1350 rides in the track 1342 of the cover 1312.

Figure 52:
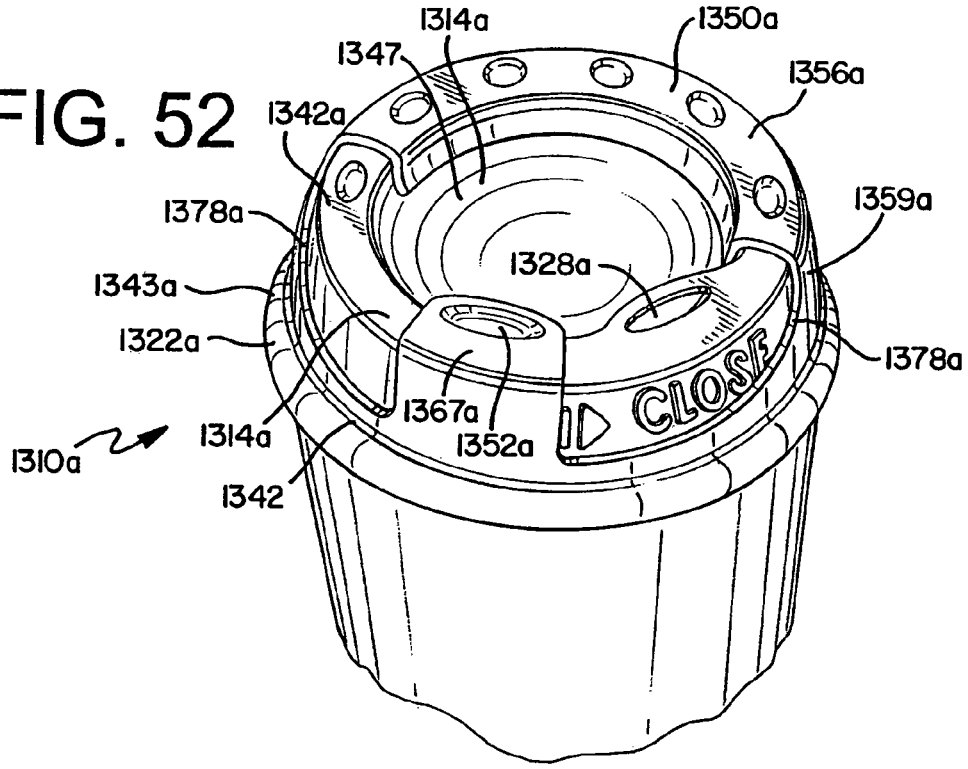
FIG. 52 is a perspective view of an alternate embodiment of the lid of the present invention, the lid shown in an open position.
Figure 53:
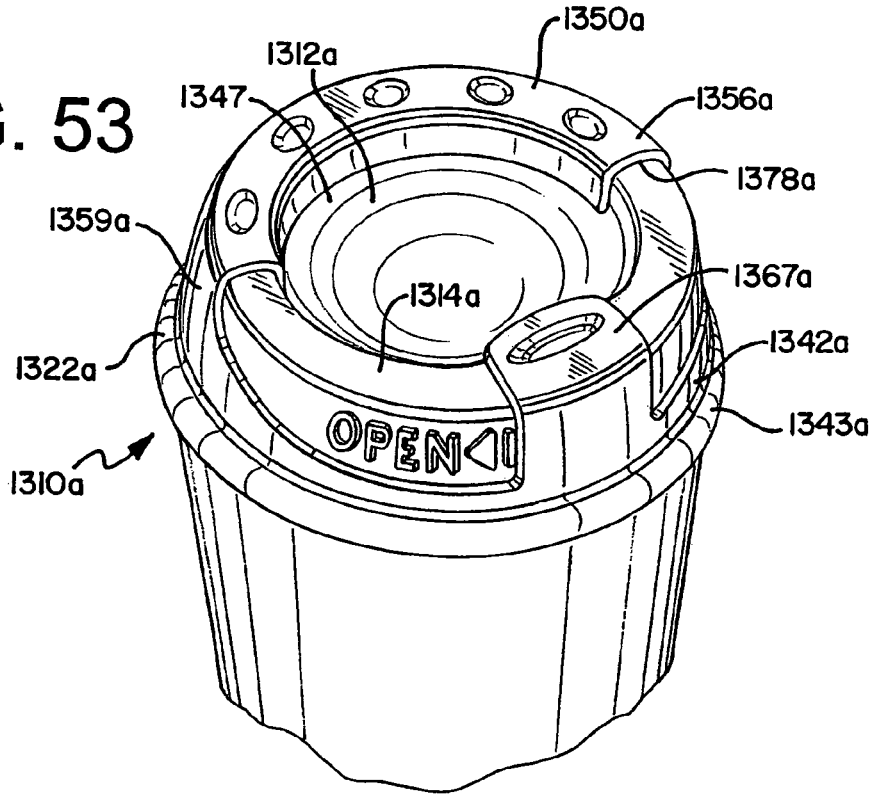
FIG. 53 is a perspective view of the lid of FIG. 52, the lid shown in a closed position.

FIGS. 52-53 disclose another embodiment of the lid using a rotatable overlay, generally designated with the reference numeral 1310*a*. The lid 1310*a* has similar features to the lid 1310 of FIGS. 48-51. As shown in FIGS. 52 and 53, the lid 1310*a* has a recessed central portion. The overlay 1350*a* has an open central portion 1347 and preferably has a generally toroidal shape, i.e. a three-dimensional ring wherein the recessed central portion of the cover 1312*a*. The cover 1312 has a top wall 1314*a* that defines an additional annular track. The overlay 1350*a* also has a top wall 1356*a* that corresponds to the top wall 1314*a* of the cover 1312*a*. The top wall 1356*a* is also rotatably supported by the top wall 1356*a* of the cover 1312*a*, as the overlay 1350*a* rides along the annular track defined by the top wall 1314*a* of the cover 1312*a*. The overlay 1350*a* also has apertures 1378*a* separated by the finger 1367*a*. In this embodiment, the finger 1367*a* extends upwards from a base of the overlay 1350*a* and does not extend across the central portion of the overlay 1350*a*. The finger 1367*a* has a distal end that rides over the top wall 1314*a* of the cover 1312.

FIG. 52 shows the open position wherein the overlay 1350*a* is rotated such that the finger 1367 is spaced from the opening 1328*a* and one of the apertures 1378*a* is aligned with the opening 1328*a*. In this position, the side wall of the cover 1312 has a "close" indicia thereon indicating a direction of rotation for the overlay 1350*a* to close the lid 1310*a*. FIG. 53 shows the overlay 1350*a* rotated such that the finger 1367 obstructs the opening 1328*a*. In this position, the side wall of the cover 1312 has an "open" indicia thereon indicating a direction of rotation for the overlay 1350*a* to open the lid 1310*a*.

Figure 54:
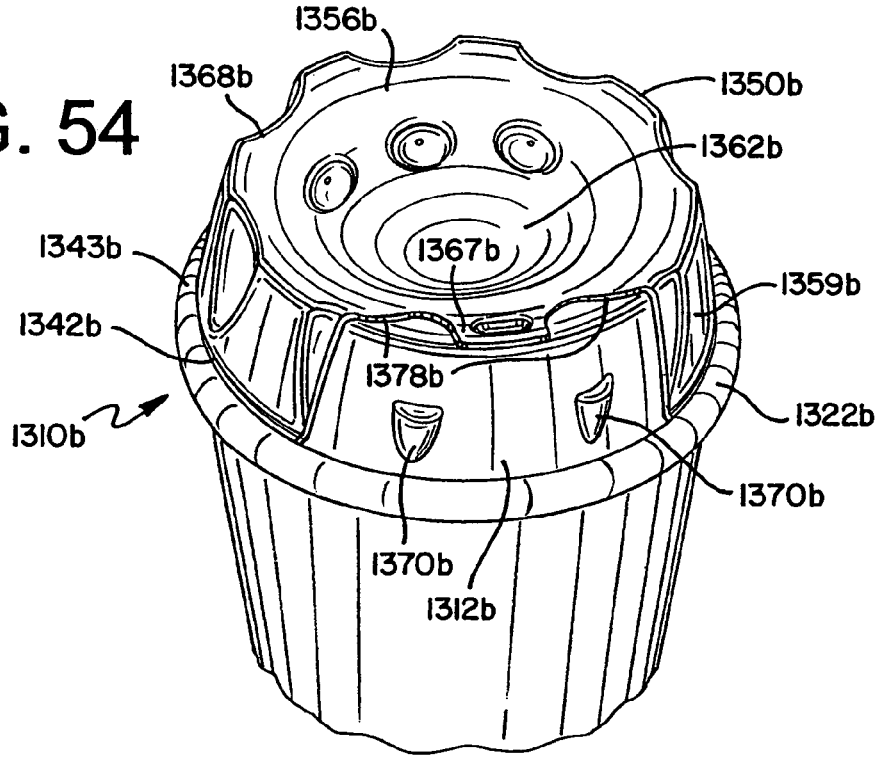
FIG. 54 is a perspective view of an alternate embodiment of the lid of the present invention, the lid shown in a closed position.
Figure 55:
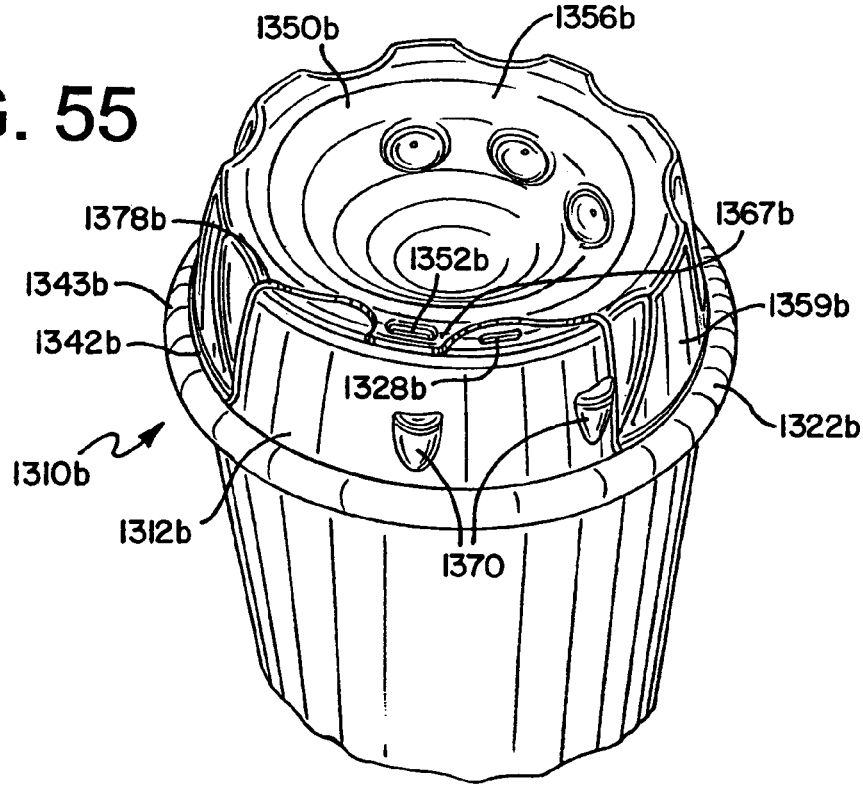
FIG. 55 is a perspective view of the lid of FIG. 54, the lid shown in an open position.

FIGS. 54-55 show another embodiment of the lid utilizing a rotatable overlay, the lid being generally designated with the reference numeral 1310*b*. The structure is similar as described above. The overlay 1350*b* has larger ridges 1368*b* than in the previous embodiments. The overlay 1350*b* has cut-away portions or apertures 1378*b* wherein the finger 1367*b* extends therebetween. As shown in FIGS. 54-55, the cover 1312*b* includes one or more stops 1370 for constraining rotation of the overlay 1350*b*. The stops 1370 may partially constrain rotation of the overlay 1350*b*, by creating one or more "locked" positions, or may totally constrain rotation of the overlay 1350*b*, or may do both. For example, the stops 1370 of the lid 1310*b* illustrated in FIGS. 54-55 totally constrain rotation of the overlay 1350*b* in one direction. Many other stop configurations are possible to achieve the same effect.

FIG. 54 shows the lid in a closed position wherein the finger 1367*b* obstructs the opening 1328*b*. FIG. 55 shows the overlay 1350*b* rotated wherein the lid is in the open position. In this position, an edge portion of the overlay 1350*b* engages the stop 1370 to prevent further rotation of the overlay 1350*b*. It is understood that the other stop 1370 is used to engage another edge portion of the overlay 1350*b* if the overlay 1350*b* is rotated in an opposite direction.

Figure 56:
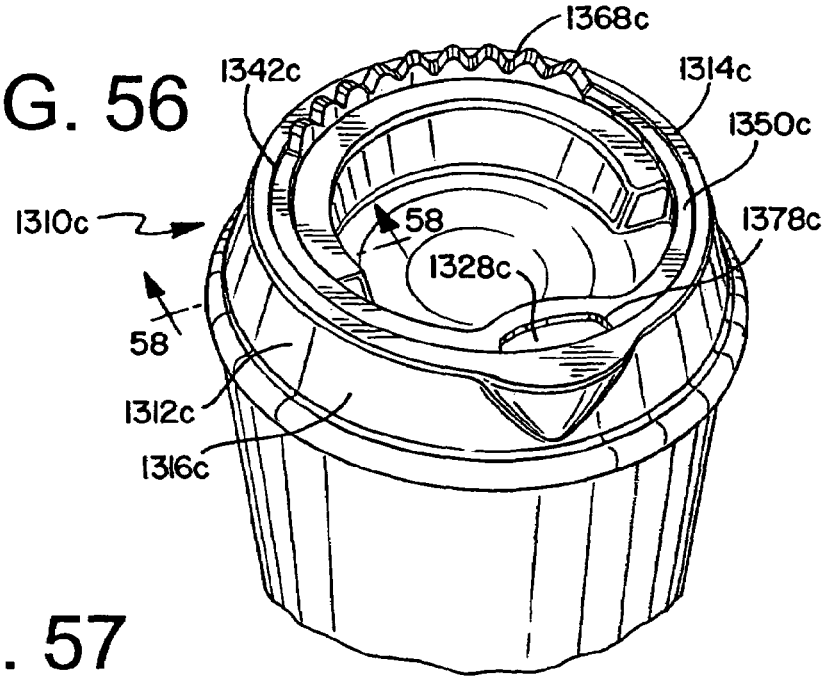
FIG. 56 is a perspective view of an alternate embodiment of the lid of the present invention, the lid shown in an open position.
Figure 57:
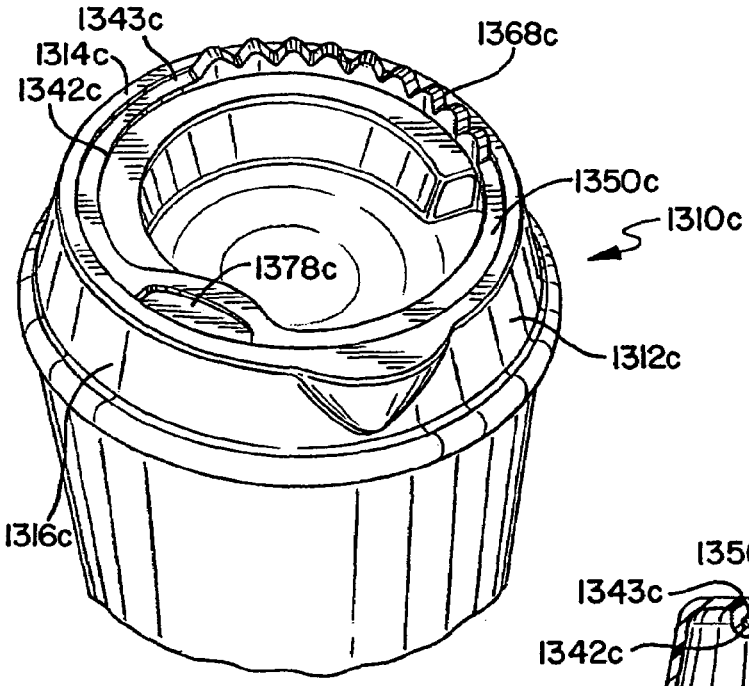
FIG. 57 is a perspective view of the lid of FIG. 56, the lid shown in a closed position.
Figure 58:
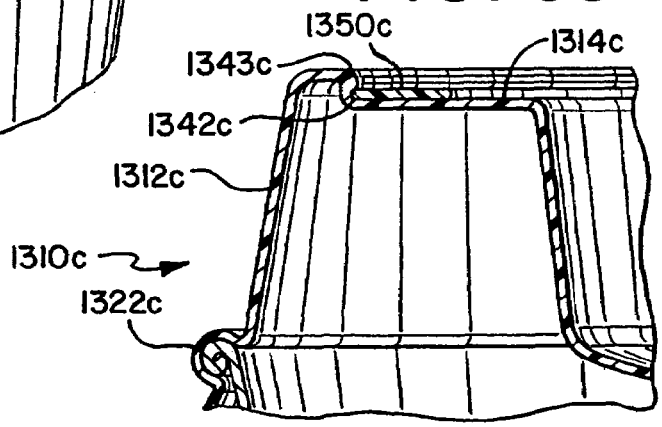
FIG. 58 is a broken cross-sectional view of the lid of FIG. 56, taken along lines 58-58 of FIG. 56.

FIGS. 56-58 show yet another embodiment utilizing a rotatable overlay, the lid being designated with the reference numeral 1310*c*. In this embodiment, the track 1342*c* is located in the top wall 1314*c* of the cover 1312*c*, rather than in the side wall 1316*c*. The overlay 1350*c* is annular and generally ring-shaped. The overlay 1350*c* has an aperture 1378*c* to expose the opening 1328*c*, and rotates while mounted on the annular track 1342*c* in the top wall 1314*c*. The overlay 1350*c* has an actuator in the form of a plurality of upstanding ridges 1368*c*. FIG. 56 shows the lid 1310*c* in the open position. FIG. 56 shows the lid 1310*c* with the overlay 1350*c* rotated wherein the lid 1310*c* is in the closed position. FIG. 58 shows a cross-sectional view of the overlay 1350*c* mounted on the cover 1312*c*.

FIGS. 59-65 disclose yet additional embodiments of lids utilizing rotatable overlay elements having alternate mounting structures. It will be understood that the several embodiments have similar structural features that will be designated with similar reference numerals. The lid disclosed in FIGS. 59-61, generally designated with the reference numeral 1410, will be described in greater detail. This detailed description will also apply to the other embodiments such as in FIGS. 62-63 (utilizing "1410*a*" reference designations) and FIGS. 64-65 (utilizing "1410*b*" reference designations). Other distinguishing features of each embodiment will also be described.

As shown in FIGS. 59-61, the lid 1410 generally includes a cover 1412 and an overlay 1450 rotatably supported on the cover 1412.

The cover 1412 has a top wall 1414, a hub 1434 located in the top wall 1414, a side wall 1416 depending from the top wall 1414, and an opening 1428. Preferably, the cover 1412 also has a mounting portion 1422 for mounting to a container. The top wall 1414 has a recessed central portion 1462. The hub 1434 is preferably located in the recessed central portion 1462. As further shown in FIGS. 59-61, the hub 1434 is a knob 1498 on the top wall 1414 of the cover 1412. The hub 1434 further has an annular groove 1476 extending almost a circumference on the hub 1434. The cover 1412 further has status indicia 1465 located on the side wall 1416 of the cover 1412. Preferably, the status indicia 1465 is an embossed "open" and/or "close" on the cover 1412.

The overlay 1450 is rotatably mounted on the cover 1412 and has a top wall 1456 and a depending side wall 1461. The overlay 1450 further has an outer surface 1475, an inner surface 1474. A connector 1480 is included on the top wall 1456. The overlay 1450 preferably includes a gripping element 1468 on the side wall as in the embodiments discussed above. The connector 1480 of the overlay 1450 further has a tab portion 1477 that depends from the connector 1480 and fits within the annular groove 1476 of the hub 1434 described in greater detail below. In this embodiment, the side wall 1461 of the overlay 1450 does not extend down the entire side wall of the cover 1412.

The overlay 1450 has a cut out portion, or aperture 1478, that defines a pair of fingers 1467. The fingers 1467 have a projection 1452 thereon that that seals the opening 1428 when the lid 1410 is in the closed position.

In some embodiments, as discussed above, the overlay 1450 has a position indicator 1464. This position indicator 1464 may take any of the forms previously discussed, but preferably is a pointer 1466 on the overlay 1450 that points to one or more status indicia 1465 on the cover 1412. In a preferred embodiment, the position indicator 1464 depends from one of the fingers 1467. The status indicia 1465 communicates the position of the lid 1410 in a variety of different ways, as discussed above. The shape of the overlay 1450 is preferably asymmetrical, as shown in FIGS. 59-65, but may be symmetrical as well.

The hub 1434 and connector 1480 may have one of a number of different forms, allowing the overlay 1450 to be rotatably mounted on the hub 1434. As illustrated in FIGS. 59-61, the overlay 1450 is positioned over the cover 1412. The tab portions 1477 on the overlay 1450 fit into the annular groove 1476 as shown in FIG. 61. The tab portions 1477 can slide within the groove 1476 when the overlay 1450 is rotated. As shown, the overlay 1450 is cooperatively dimensioned wherein the top wall 1456 and side wall 1461 of the overlay confronts the top wall 1414 and side wall 1416 of the cover 1412. Other structures for connecting the overlay 1450 to the cover 1412 are also possible.

As discussed above, the lid 1410 may incorporate stops to partially constrain rotation of the overlay 1450. The stops may create one or more "locked" positions, or may totally constrain rotation of the overlay 1450, or may do both. The stops can be one of the embodiments previously described or be incorporated into the hub/tab connecting portions between the cover 1412 and the overlay 1450.

As with the previous embodiments, the lid 1410 has a closed position and an open position. The closed position is shown in FIG. 59 wherein the finger 1467 is proximate and covering the opening 1428. Furthermore, the projection 1452 is received in the opening 1428. Also, the pointer 1466 of the position indicator 1464 is aligned with the "close" indicia 1465. As shown in FIG. 60, a user rotates the overlay 1450 such as by engaging the actuator 1468 wherein the aperture 1478 is generally aligned with the opening 1428 to allow a flowable substance to flow through the opening 1428. In this position, the pointer 1466 of the position indicator 1464 is aligned with the "open" indicia 1465. It is understood that a user could rotate the overlay 1450 in an opposite direction to close the lid 1410. When moving between the open and closed positions, the overlay 1450 rides in the track or groove 1476 of the cover 1412.

Figure 62:
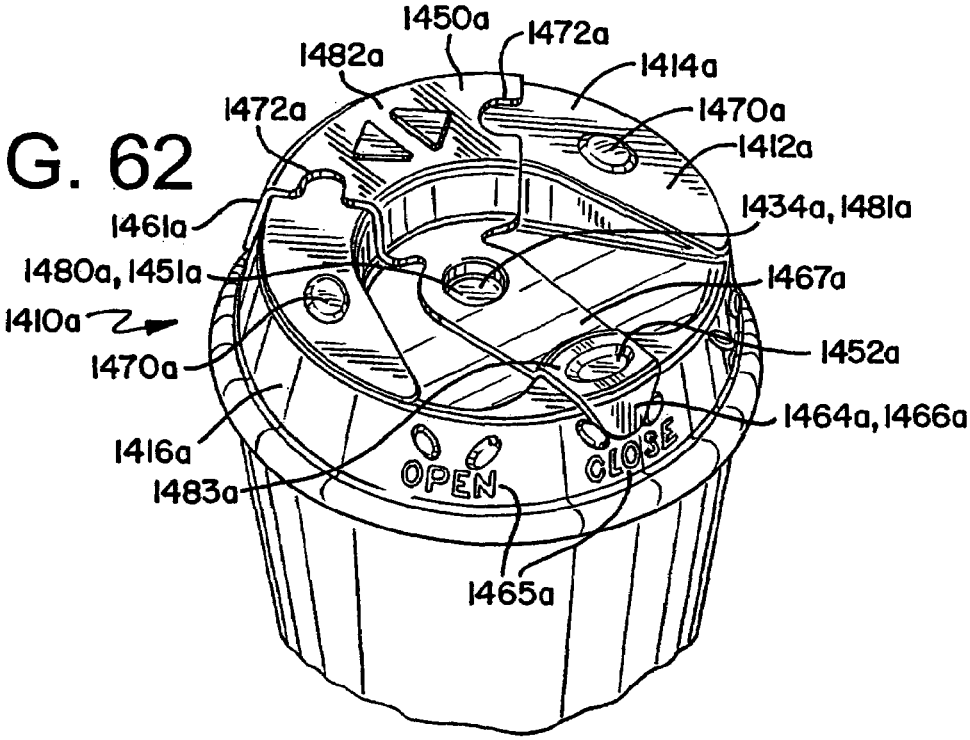
FIG. 62 is a perspective view of an alternate embodiment of the lid of the present invention, the lid shown in a closed position.
Figure 63:
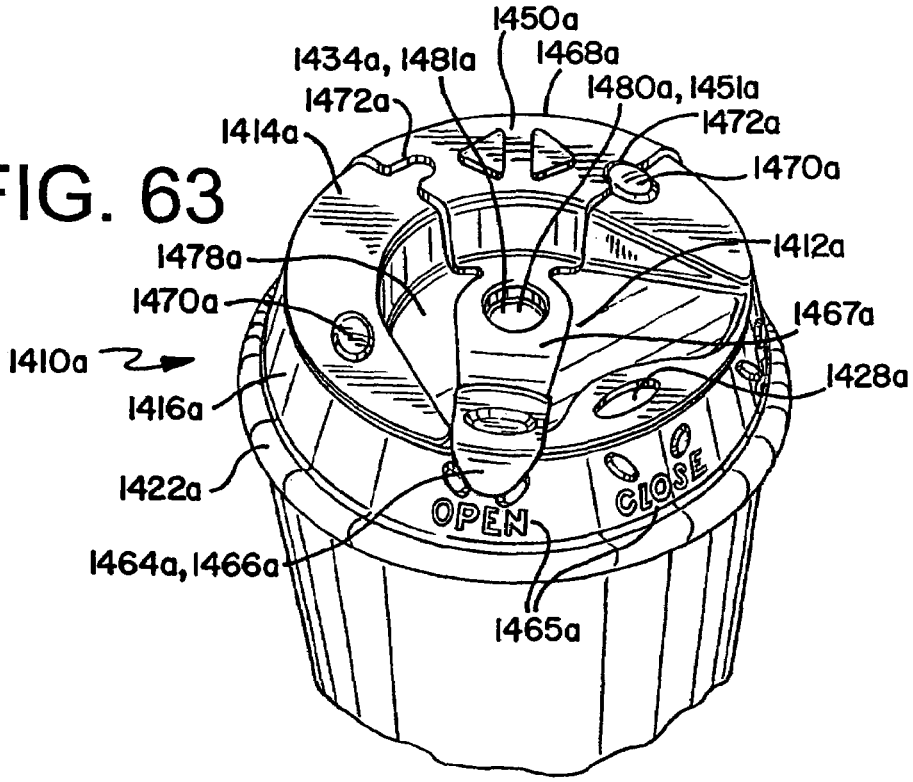
FIG. 63 is a perspective view of the lid of FIG. 62, the lid shown in an open position.

FIGS. 62-63 disclose another embodiment of the lid utilizing a center-mounted overlay, the lid generally being designated with the reference numeral 1410*a*. The lid 1410*a* has the cover 1412*a* and the overlay 1450*a*. The cover 1412*a* has the hub 1434*a* that is an indentation 1481*a* in the top wall 1414*a* of the cover 1412*a*. The overlay 1450*a* has the connector 1480*a* in the form of a knob 1451*a* on the inner surface 1474*a* of the overlay 1450*a*. In such a configuration, the indentation 1481*a* is cooperatively dimensioned with the knob 1451*a* such that the knob 1451*a* fits within the indentation 1481*a*, securing the overlay 1450*a* to the cover 1412*a* and permitting rotation of the overlay 1450*a* between the open position and the closed position. This mounting configuration is similar to that illustrated above with respect to other embodiments, such as in FIG. 33.

It is further appreciated that the top wall 1414*a* of the cover 1412*a* defines an annular rail structure generally at a rear periphery of the cover 1412*a*. The cover 1412*a* further has indicia indicators 1465*a* on the side wall 1416*a* of the cover 1412*a*. As discussed in greater detail below, stops 1470*a* are located on the top wall 1414*a* of the cover 1412*a*.

The overlay 1450*a* in FIGS. 62-63 has a first end 1482*a* and a second end 1483*a* on opposing sides of the connector 1480*a*. The width of the overlay 1450*a* is greater at the first end 1482*a* than at the second end 1483*a*. The overlay 1450*a* narrows such that a point 1466*a* is created and serving as a position indicator 1464*a*. A distal end of the second end 1483*a* extends downward along the side wall 1416*a* of the cover 1412*a*.

As discussed, the cover 1412*a* includes one or more stops 1470*a* for constraining rotation of the overlay 1450*a*. The stops 1470*a* of the lid 1410*a* illustrated in FIGS. 62-63 totally constrain rotation of the overlay 1450*a* in one direction (not allowing it to move past a certain point), but also frictionally engage notches 1472*a* in the overlay 1450*a* to "lock" the overlay 1450*a* in the open position, partially constraining its rotation in the other direction. It is appreciated that there are two pairs of stop/notch structures for restraining rotation of the overlay 1450*a* in either direction.

The lid 1410*a* has a closed position and an open position. The closed position is shown in FIG. 62 wherein the finger 1467*a* is proximate and covering the opening 1428*a*. Furthermore, the projection 1452*a* is received in the opening 1428*a*. Also, the pointer 1466*a* of the position indicator 1464*a* is aligned with the "close" indicia 1465*a*. It is further shown that additional ribs could be located on the side wall 1416*a* of the cover 1412*a* above the indicia 1465*a*. The pointer 1466*a* rests between the ribs in the closed and open positions. As shown in FIG. 63, a user rotates the overlay 1450*a* such as by engaging the actuator 1468*a* wherein the finger 1467*a* is spaced from the opening 1428*a* to allow a flowable substance to flow through the opening 1428*a*. In this position, the pointer 1466*a* of the position indicator 1464*a* is aligned with the "open" indicia 1465*a*. It is further understood that the notch 1472*a* is received by the stop 1470*a* to prevent further rotation of the overlay 1450*a*. It is understood that a user could rotate the overlay 1450*a* in an opposite direction to close the lid 1410*a*. It is further shown that the overlay 1450*a* could have direction indicia on the top wall of the overlay 1450*a*, such as in the form of arrows.

Figure 64:
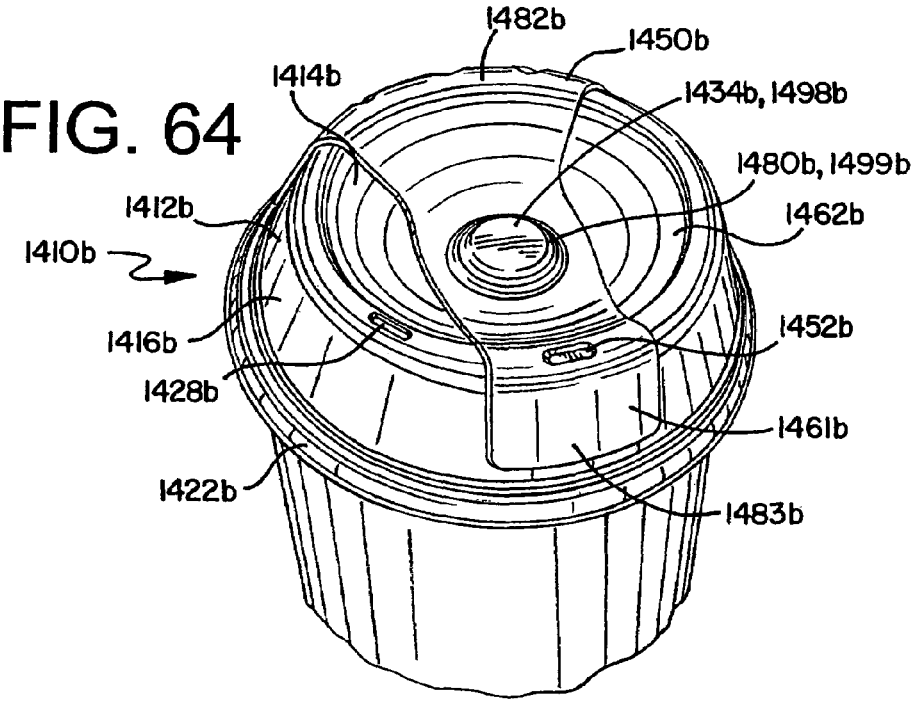
FIG. 64 is a perspective view of an alternate embodiment of the lid of the present invention, the lid shown in an open position.
Figure 65:
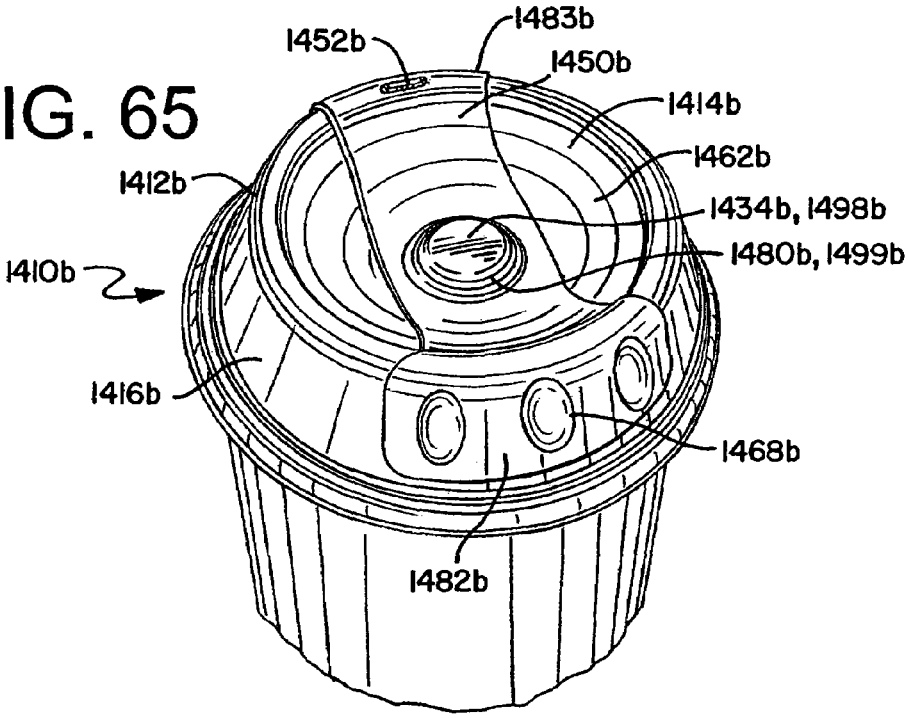
FIG. 65 is a perspective view of the lid of FIG. 64, the lid shown in a closed position.

FIGS. 64-65 disclose yet another embodiment, generally designated with the reference numeral 1410*b*. The hub 1434*b* is a knob 1498*b* on the top wall 1414*b* of the cover 1412*b* and the connector 1480*b* is an indentation 1499*b* in the inner surface of the overlay 1450*b*. The indentation 1499*b* is cooperatively dimensioned with the knob 1498*b* such that the knob 1498*b* fits within the indentation 1499*b*, securing the overlay 1450*b* to the cover 1412*b* and permitting rotation of the overlay 1450*b* between the open position and the closed position. The overlay 1450*b* shown in FIGS. 64-65 has a narrow, finger-like end 1483*b* with a projection 1452*b* for sealing the opening, allowing the lid 1410*b* to be opened with a smaller rotation of the overlay 1450*b*, while having a wider end 1482*b* opposite the projection, to create a more effective gripping surface. It is appreciated that the overlay 1450*b* is rotated in either direction to place the lid 1410*b* in open and closed positions.

Figure 66:
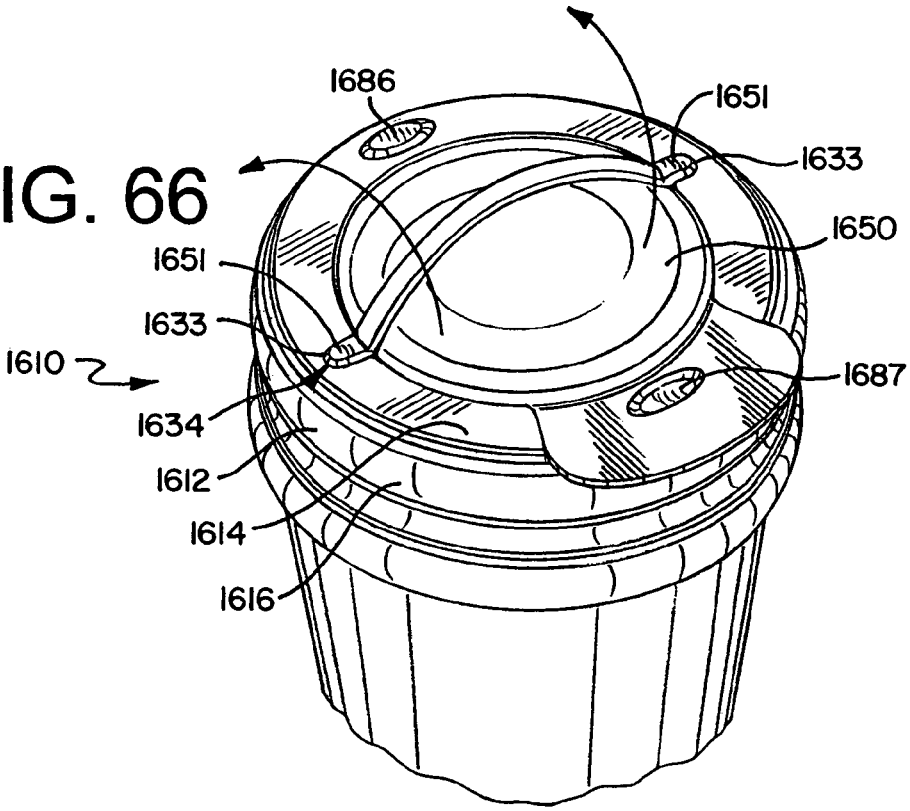
FIG. 66 is a perspective view of an alternate embodiment of the lid of the present invention, the lid shown in a closed position.
Figure 67:
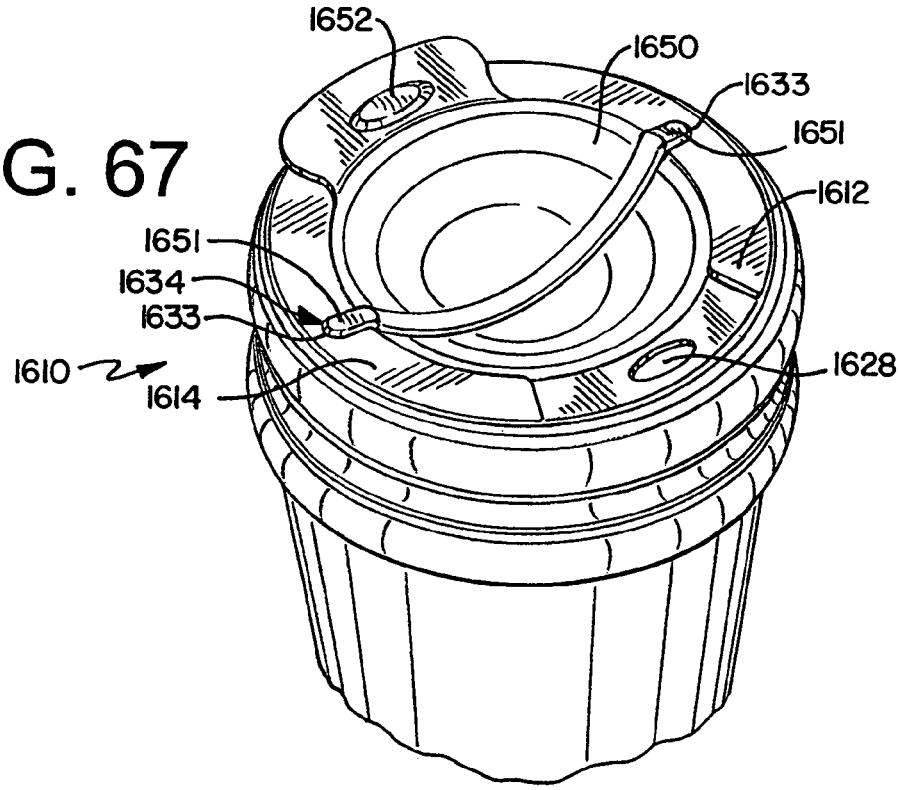
FIG. 67 is a perspective view of the lid of FIG. 66, the lid shown in an open position.
Figure 68:
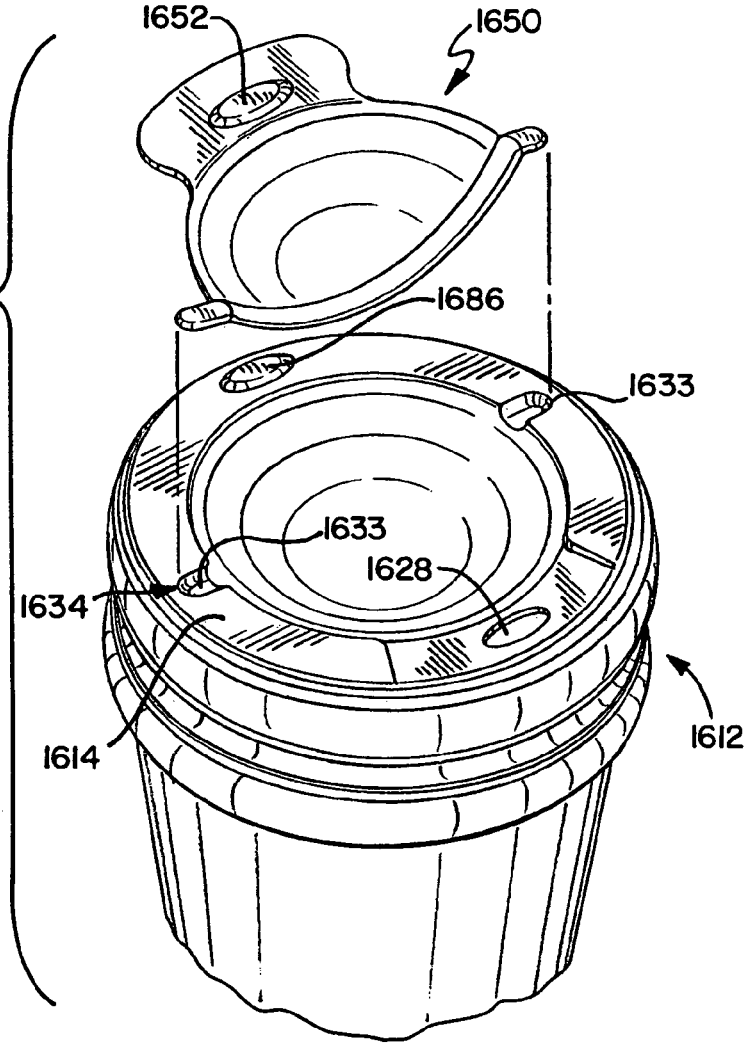
FIG. 68 is an exploded view of the lid of FIG. 66, with connections between the cover and moveable element shown with broken lines.

FIGS. 66-68 disclose another alternate embodiment of the lid of the present invention, generally designated with the reference numeral 1610. In this embodiment, the lid 1610 generally includes a cover 1612 and a moveable member or moveable element 1650.

The cover 1612 has a top wall 1614, a side wall 1616, a mounting portion 1622, an opening 1628 and a support member 1634. Preferably, as illustrated in FIGS. 66-68, the support member 1634 is a pair of notches 1633 in the top wall 1614 of the cover 1612. The top wall 1614 further has a protuberance 1686. The moveable element 1650 has a base portion having a pair of pegs 1651. The moveable element 1650 further has a plug 1652 located in an extension member that extends from the base. Opposite the plug 1652, the moveable element 1650 has a recess 1687.

As shown in FIGS. 66-68, the moveable element 1650 is pivotally mounted to the cover 1612 wherein the element 1650 cooperates with the support member 1634. Specifically, the two pegs 1651 on the moveable element 1650 "snap" into the notches 1633 on the cover 1612. Alternately, the support member 1634 takes a different form (not shown), wherein the moveable element 1650 is more permanently attached to the cover 1612. Additionally, the peg 1651 can have a more complex shape, such as a cross-shaped peg (not shown) that may be pivotably mounted on a cooperatively-shaped support member. Many other cooperative configurations are possible.

As shown by the arrows in FIG. 66, the moveable element 1650 pivots within the notches 1633 between an open position and a closed position. FIG. 66 disclosed the closed position wherein the plug 1652 is received in the opening 1628 for sealing the opening 1628. FIG. 67 discloses the open position wherein the moveable element 1650 is pivoted away from the opening 1628. The pegs 1651 rotate within the notches 1633 to allow for the pivotal movement. As further shown in FIG. 67, the recess 1687 engages the protuberance 1686 on the cover 1612 to lock the lid 1610 in the open position.

FIGS. 69-71 disclose another embodiment of the lid of the present invention, generally designated with the reference numeral 1710. The lid 1710 generally includes a cover 1712 and a moveable element 1750.

The cover 1712 has a top wall 1714, a depending side wall 1716, and a mounting portion 1722, and an opening 1728. The moveable element 1750 is mounted on the cover 1712, preferably on the top wall 1714. The moveable element 1750 preferably has a first segment 1790 permanently attached to the cover 1712 by a high-tack adhesive element 1791, and a second segment 1792 releasably attached to the cover 1712 by a low-tack adhesive element 1793. Preferably, the low-tack adhesive element 1793 is located on the second segment 1792 of the moveable element 1750. Alternately, the low-tack adhesive element 1793 is located on the cover 1712, preferably near or around the opening 1728. The second segment 1792 is preferably positioned near the opening 1728 and the low-tack adhesive element 1793 releasably holds the second segment 1792 to the cover 1712, sealing the opening 1728. To open the lid 1710, the second segment 1792 of the moveable element 1750 is pulled away from the cover 1712, exposing the opening 1728, while the first segment 1790 remains connected to the high-tack adhesive element 1791. The strength of the low-tack adhesive element 1793 is sufficient to hold the lid 1710 in a closed position, but not so great that the moveable element 1750 is difficult to separate from the cover 1712. Additionally, the low-tack adhesive element 1793 preferably remains sticky after the lid 1710 is opened, allowing the lid 1710 to be re-sealed.

The high-tack adhesive element 1791 is not a necessary component of the lid 1710, although it is preferably present. Accordingly, in another embodiment, the lid 1710 has a low-tack adhesive element 1793 releasably attaching at least a portion of the moveable element 1750 to the cover 1712, with the high-tack adhesive element 1791 optionally present. If the high-tack adhesive element 1791 is not present, the moveable element 1750 can be permanently attached to the cover 1712 by any means described herein with respect to any other embodiment. For example, the moveable element 1750 may be tethered to the cover 1712. Alternately, the moveable element 1750 is not permanently attached to the cover 1712, being completely removable by releasing the low-tack adhesive element 1793.

FIGS. 72-80 disclose yet additional embodiments of lids utilizing moveable members that are externally mounted and generally tethered to the cover. It will be understood that the several embodiments have similar structural features that will be designated with similar reference numerals. The lid disclosed in FIGS. 72-74, generally designated with the reference numeral 1510, will be described in greater detail. This detailed description will also apply to the other embodiments such as in FIGS. 75-76 (utilizing "1510*a*" reference designations), FIGS. 77-78 (utilizing "1510*b*" reference designations), and FIGS. 79-80 (utilizing "1510*c*" designations). Other distinguishing features of each embodiment will also be described.

As shown in FIGS. 72-74, the lid 1510 generally includes a cover 1512 and a moveable element or moveable member 1550.

The cover 1512 generally includes a cover 1512 having a top wall 1514, a depending side wall 1516, a mounting portion 1522 for mounting to a container, and an opening 1528. The top wall 1514 has a recessed central portion 1515 and an annular ring portion 1517. The top wall 1514 further has a protuberance 1586 that cooperates with the moveable element 1550 to be described below. In a preferred embodiment, the opening 1528 and the protuberance 1586 are located in the annular ring portion 1517 of the top wall 1514.

The moveable element 1550 is tethered to the cover 1512. In other words, the moveable element 1550 has one fixed end 1539 and one moveable end 1541. The moveable element 1550 is tethered to the cover 1512 by a permanent or semi-permanent connection 1584. The moveable element 1550 may be integrally molded with the cover 1512, forming a single integral piece. Alternately, the moveable element 1550 is manufactured separately and attached to the cover 1512 by any acceptable means. Preferably, the moveable element 1550 is a flap or a strap having a plug 1552 that fits within the opening 1528. The moveable element 1550 further has a recess 1587 that is dimensioned to cooperate with the protuberance 1586 of the cover 1512. In the one preferred embodiment, the moveable element 1550 is shaped as a segment of a circle, preferably a semicircle. The moveable element 1550 has a hinge 1584.

As further shown in FIGS. 72-74, the moveable element 1550 is positioned within the central recessed portion of the top wall 1514. The outer peripheral surface of the moveable element 1550 abuts an inner surface defined by the annular ring portion 1517. The lid 1510 is tethered by the hinge 1584 across the top wall 1514 of the cover 1512. The hinge 1584 allows the moveable element 1550 to be pivoted about the hinge 1584.

As with the other embodiments, the moveable element 1550 is moveable to place the lid 1510 in a closed position and an open position. FIG. 72 shows the closed position. The moveable element 1550 is positioned along a front portion of the cover top wall 1514 wherein the plug 1552 is received in the opening 1528. FIG. 74 shows the moveable element 1550 moving from the closed position. The moveable element 1550 is pivotable about the hinge 1584. As shown in FIG. 73, the protuberance 1586 is received in the recess 1587 in the open position, locking the lid 1510 in the open position. Preferably, the protuberance 1586 and the recess 1587 are cooperatively dimensioned such that they are frictionally engaged with each other in the open position. Also, the moveable element 1550 preferably includes a tab 1523 or flange at the edge, facilitating the opening and closing of the lid 1510.

It is further understood that the moveable element 1550 of the lid 1510 of the present invention may function effectively having almost any shape or configuration. The moveable element 1550 may similarly be tethered to nearly any part of the cover 1512.

Figure 75:
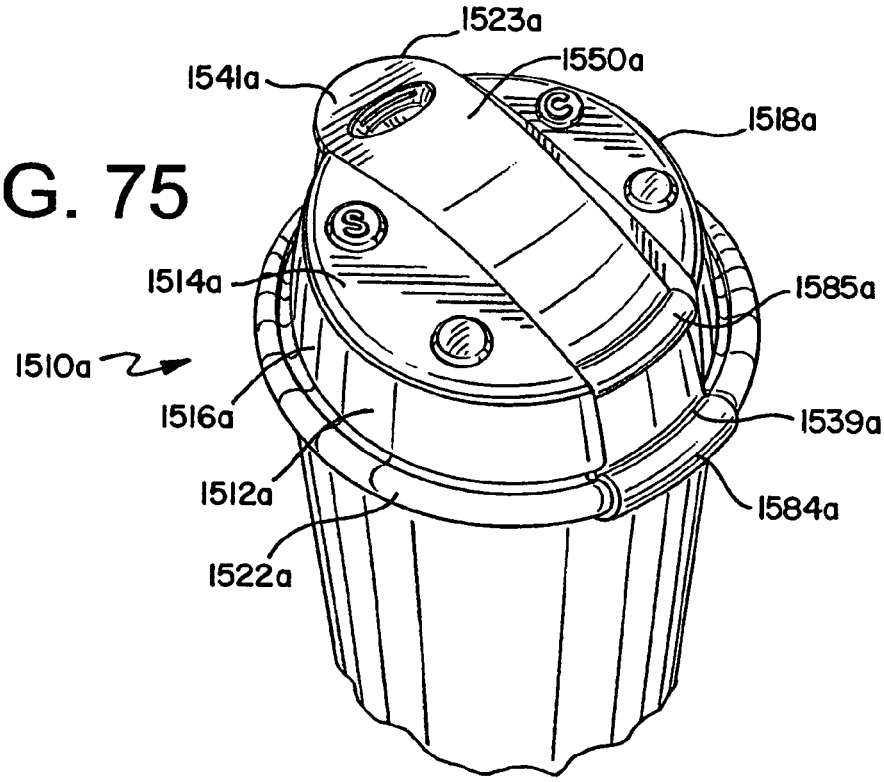
FIG. 75 is a perspective view of an alternate embodiment of the lid of the present invention, the lid shown in a closed position.
Figure 76:
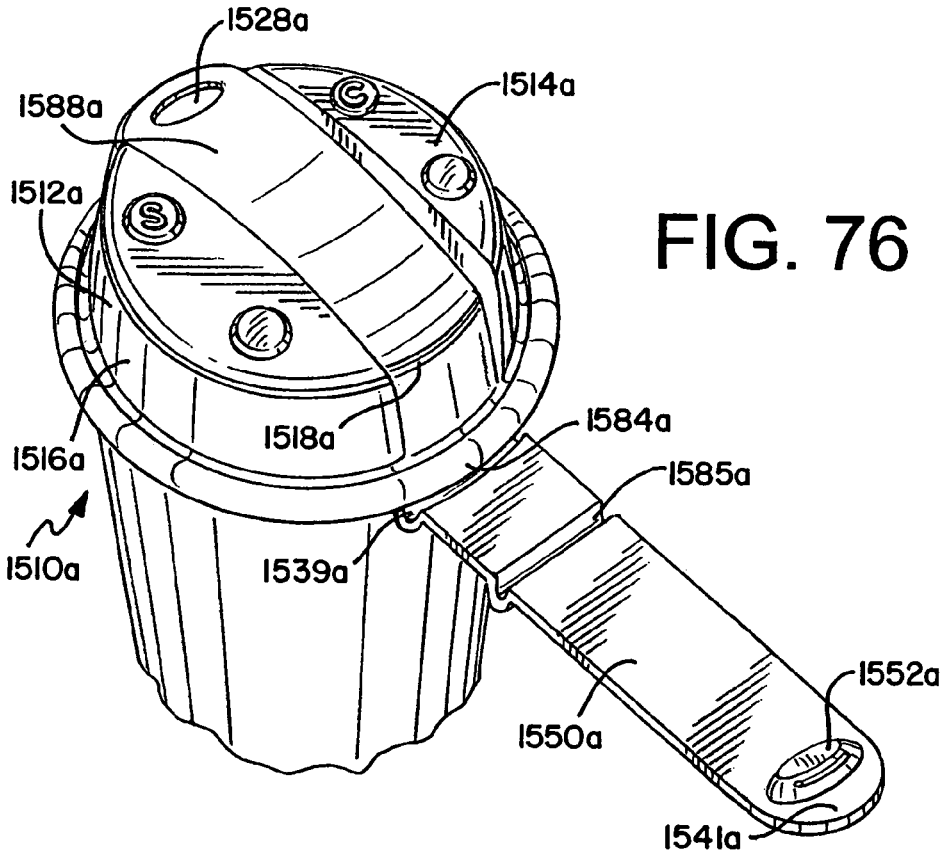
FIG. 76 is a perspective view of the lid of FIG. 75, the lid shown in an open position.

FIGS. 75-76 disclose another embodiment of the lid, generally designated with the reference numeral 1510*a*, wherein the moveable element 1550*a* is tethered to the cover 1512*a*.

As shown in FIG. 76, the cover 1512*a* has a channel 1588*a* extending across the top wall 1514*a* from a front portion to a rear portion. The opening 1528*a* is positioned in the top wall 1514*a* at the channel 1588*a*. The moveable element 1550*a* is tethered to the cover 1512*a* by a connection proximate the mounting portion 1522*a* of the cover 1512*a*. This connection could be integral or separately made. The moveable element 1550*a* has the first hinge 1584*a* having a curved portion. The moveable element 1550*a* further has a second hinge 1585*a*, also having a curved portion.

FIG. 76 shows the lid 1510*a* in the open position wherein the moveable member 1550*a* is pivoted about the first hinge 1584*a* and extends away from the cover 1512*a*. FIG. 75 shows the closed position. The moveable element 1550*a* is pivoted about the first hinge 1584*a* wherein the curved portion accommodates the mounting portion 1522*a*. The moveable element further pivots about the second hinge 1585*a* wherein the curved portion accommodates the interface between the cover side wall 1516*a* and the cover top wall 1514*a*. This configuration permits the moveable element 1550*a* to bend to conform to the shape of the cover 1512*a* to reduce the profile of the closed lid 1510*a*. The moveable member 1550*a* fits within the groove 1588*a* and the plug fits into the opening 1528*a* further enhancing the low profile characteristics of the lid 1510*a*.

Figure 77:
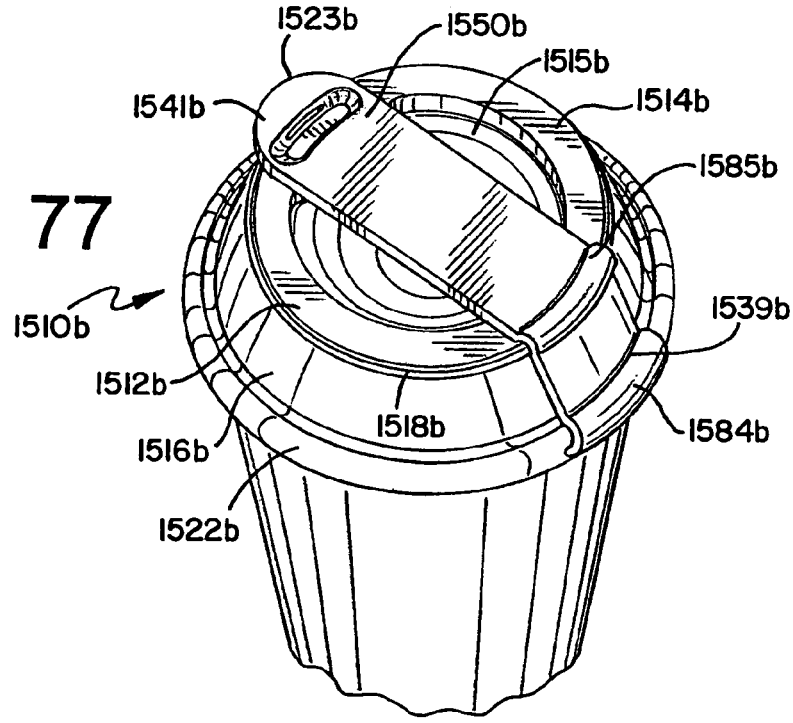
FIG. 77 is a perspective view of an alternate embodiment of the lid of the present invention, the lid shown in a closed position.
Figure 78:
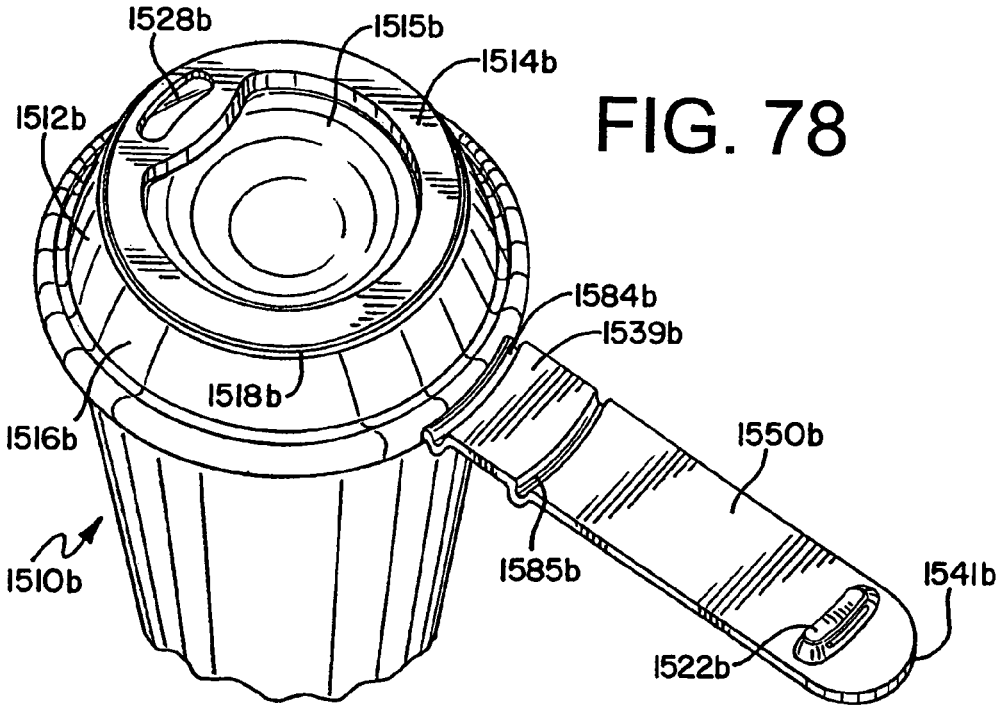
FIG. 78 is a perspective view of the lid of FIG. 77, the lid shown in an open position.

FIGS. 77-78 disclose another embodiment, generally designated with the reference numeral 1510*b*, similar to the embodiment in FIGS. 75-76. The cover 1512*b* has a central recessed portion. The moveable element 1550*b* pivots about the first hinge 1584*b* and the second hinge 1585*b*. The moveable element 1550*b* extends across the central recessed portion of the cover top wall 1514*b*.

Figure 79:
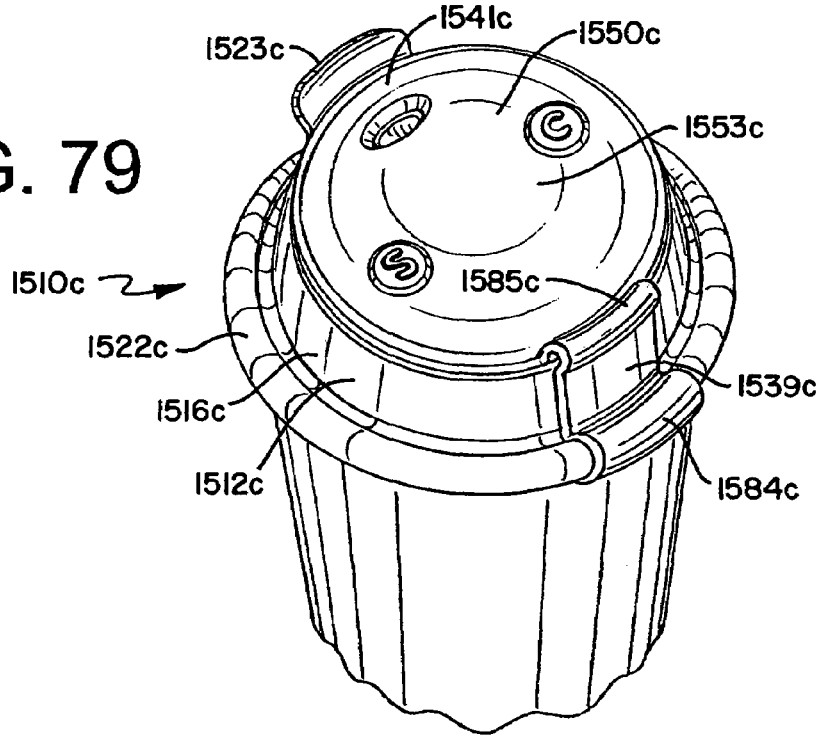
FIG. 79 is a perspective view of an alternate embodiment of the lid of the present invention, the lid shown in a closed position.
Figure 80:
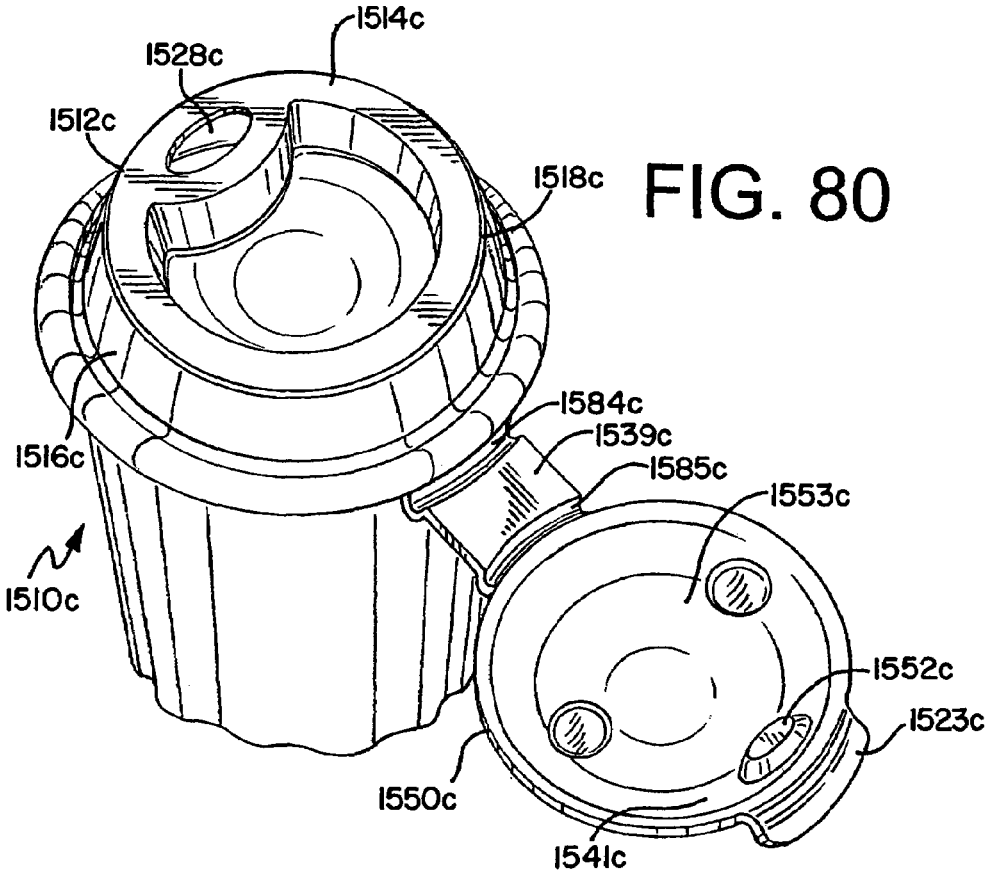
FIG. 80 is a perspective view of the lid of FIG. 79, the lid shown in an open position.

FIGS. 79-80 disclose another embodiment, generally designated with the reference numeral 1510*c*, similar in construction to the embodiments in FIGS. 75-78. The top wall 1514*c* has a central recessed portion 1515*c*. An annular ring portion 1517*c* is further defined in the top wall 1514*c*. In this embodiment, the moveable element 1550*c* has an enlarged portion 1553*c* that is generally in the form of a circle. The enlarged portion 1553*c* has an outer periphery that generally corresponds to the outer periphery defined by the annular ring portion 1517*c* of the top wall 1514*c*. Thus, as shown in FIG. 79, when the lid 1510*c* is in the closed position, the enlarged portion 1553*c* generally completely covers the top wall 1514*c* of the cover 1512*c*. FIG. 80 shows the lid 1510*c* in the open position.

FIGS. 81-99 disclosed several additional embodiments of the lid of the present invention utilizing a moveable member that generally moves along a track associated with the cover of the lid. The movement is generally axially along a straight line of motion or along a curved line of motion.

Figure 81:
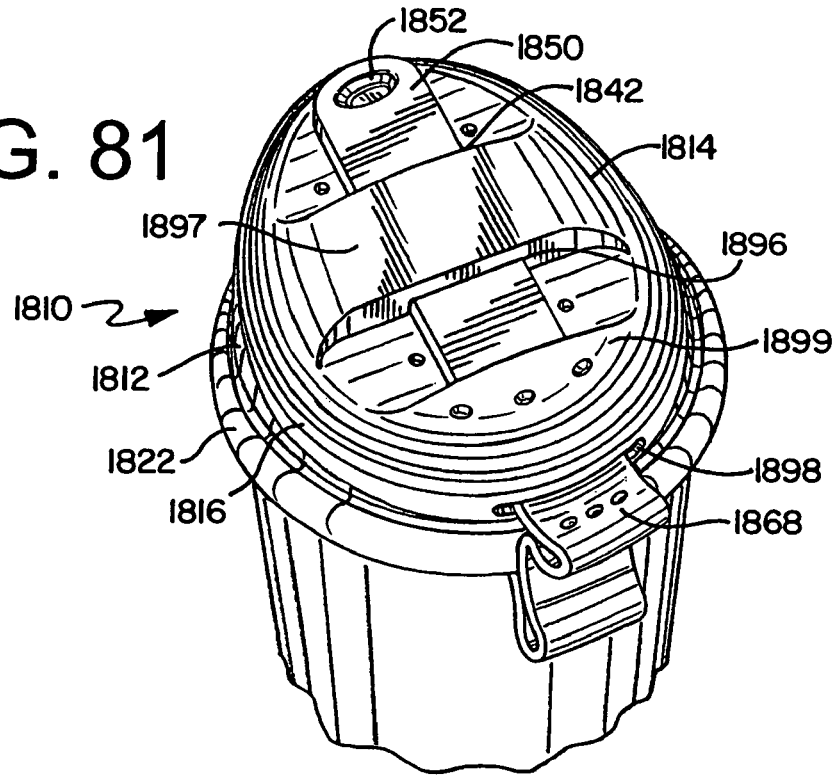
FIG. 81 is a perspective view of an alternate embodiment of the lid of the present invention, the lid shown in a closed position.
Figure 82:
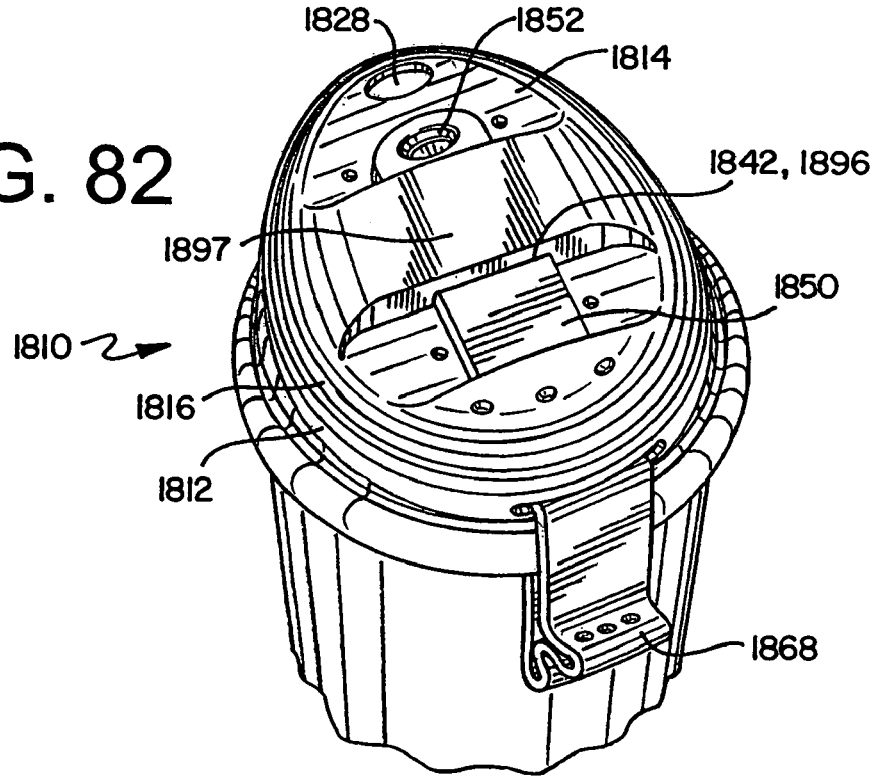
FIG. 82 is a perspective view of the lid of FIG. 81, the lid shown in an open position.

FIGS. 81 and 82 disclose a lid having a cover 1812 and a moveable member 1850. The cover has a top wall 1814, a side wall 1816 depending from the top wall 1814, a mounting portion 1822, a track 1842, and an opening 1828. The track 1842 preferably extends transversely across the cover 1814. Most preferably, the track 1842 extends transversely across the cover 1814, proximate a center line of the cover 1812. The cover has a front raised portion 1897 and a rear raised portion 1899. The front raised portion has a front passageway 1896 therethrough and the rear raised portion has rear passageway 1898. The passageways 1896, 1898 are cooperatively dimensioned with the moveable element 1850. The passageways 1896, 1898 cooperate to form portions of the track 1842.

Preferably, the moveable element 1850 is in the form of a strap that extends from the cover 1812 and along the track 1842. The moveable element 1850 contains a gripping element 1868 to facilitate gripping and otherwise manipulating the moveable element 1850 by a user. Additionally, the moveable element 1850 preferably contains a projection 1852 which seals the opening 1828 in the closed position.

As shown in FIGS. 81 and 82, the moveable element 1850 is tethered to the cover 1812. The moveable element 1850 is mounted on the track 1842. As discussed, one end of the moveable element 1850 is connected to the cover 1812. The free end of the moveable element 1850 is fed through the rear passageway 1898 and then through the front passageway 1896 wherein the member 1850 is moveable along the track 1842. The moveable element 1850 is axially slideable along the cover 1812.

The moveable element 1850 is moved between an open position and a closed position by sliding along the track 1842. Sliding occurs by the movement of the member 1850 back and forth along a single line of motion. Generally, this line of motion is straight. A user engages the gripping element 1868 to move the moveable element 1850 between the closed and open positions. FIG. 81 shows the lid 1810 in the closed position wherein the plug 1852 is received in the opening 1828. FIG. 82 shows the lid 1810 in the open position wherein the moveable element 1850 is slid along the track 1842 wherein the plug 1852 is spaced away from the opening 1828.

FIGS. 83-85 disclose another embodiment of the lid of the present invention designated with the reference numeral 1810*a*. The lid 1810*a* also utilizes a moveable element 1850*a* that slides along a track 1842*a*. The track 1842*a* is defined in the top wall 1814*a* wherein a raised portion defines a channel 1888*a*. The channel 1888*a* extends laterally across the top wall 1814*a*. As shown in FIGS. 83 and 85, the channel 1888*a* preferably has longitudinal grooves 1889*a* on opposing sides.

The moveable element 1850*a* is generally in the form of a strap. In this particular embodiment, the moveable element 1850*a* is not tethered to the cover 1812*a*. The moveable element 1850*a* is dimensioned to cooperate with the channel 1888*a*. Edges of the moveable element 1850*a* are received in the longitudinal grooves 1889*a*. The moveable element 1850*a* has extension portions 1894*a* that are received in the respective grooves 1889*a* of the channel 1888*a*. The moveable element 1850*a* has a gripping element 1868*a* in the form of a raised ridge on the element 1850*a*.

As shown in FIGS. 83 and 84, the moveable element 1850*a* is slideable within the track 1842*a* and channel 1888*a* between closed and open positions. FIG. 83 shows the lid 1810*a* in a closed position wherein the moveable element 1850*a* is slid forward wherein the plug 1852*a* is received in the opening 1828*a*. FIG. 84 shows the lid 1810*a* in an open position wherein the moveable element 1850*a* is slid along the track 1842*a* towards the rear of the cover 1812*a* wherein the plug 1852*a* is spaced from the opening 1828*a*. The moveable element 1850*a* is guided in the track 1842*a*.

FIGS. 86-87 disclose another embodiment of the lid of the present invention designated with the reference numeral 1810*b*. The lid 1810*b* also utilizes a moveable element 1850*b* that slides along a track 1842*b*. The track 1842*b* is defined in the top wall 1814*a* wherein a raised portion defines a channel 1888*b*. The channel 1888*b* extends laterally across the top wall 1814*b*. As shown in FIG. 86, the channel 1888*b* preferably has longitudinal grooves 1889*b* on opposing sides.

The moveable element 1850*b* is generally in the form of a strap. In this particular embodiment, the moveable element 1850*b* is tethered to the cover 1812*b*. The moveable element 1850*b* is connected to the side wall 1816*b* of the cover 1812*b*. The moveable element 1850*b* is dimensioned to cooperate with the channel 1888*b*. As shown in FIGS. 86 and 87, the moveable element 1850*b* is slideable within the track 1842*b* and channel 1888*b* between closed and open positions. FIG. 87 shows the lid 1810*b* in a closed position wherein the moveable element 1850*b* is slid forward wherein the plug 1852*b* is received in the opening 1828*b*. FIG. 86 shows the lid 1810*b* in an open position wherein the moveable element 1850*b* is slid along the track 1842*b* towards the rear of the cover 1812*b* wherein the plug 1852*b* is spaced from the opening 1828*b*. The moveable element 1850*b* is guided in the track 1842*b*.

Figure 88:
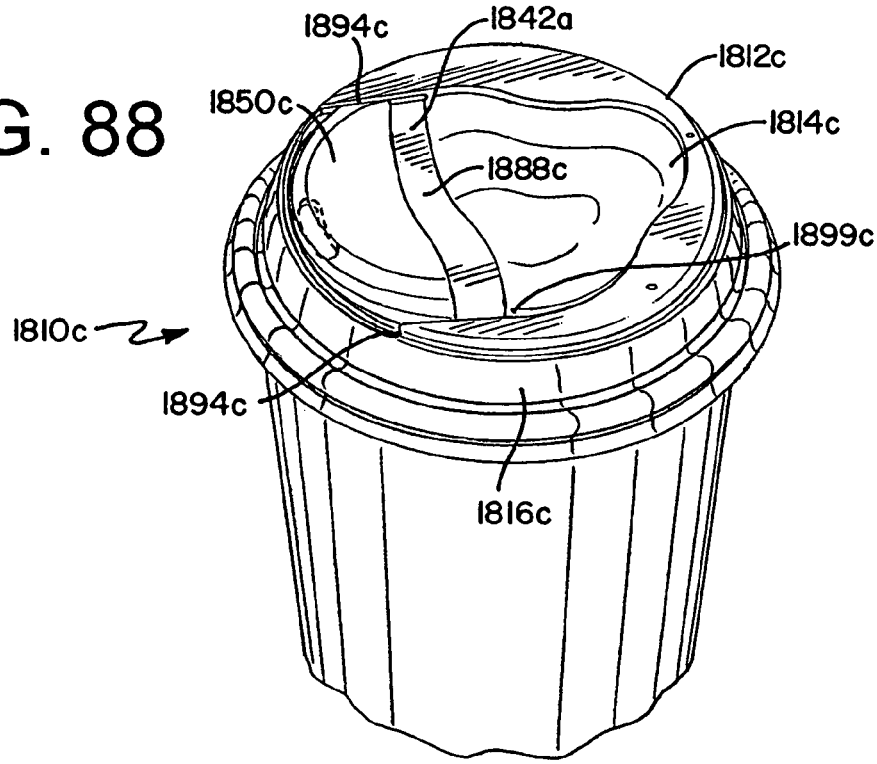
FIG. 88 is a perspective view of an alternate embodiment of the lid of the present invention, the lid shown in a closed position.
Figure 89:
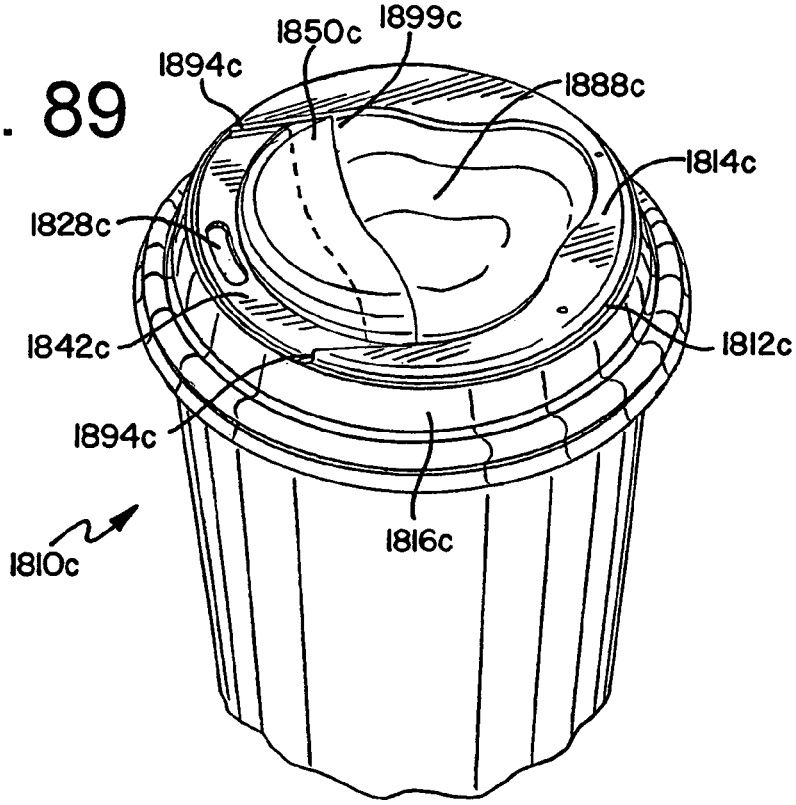
FIG. 89 is a perspective view of the lid of FIG. 88, the lid shown in an open position.

FIGS. 88-89 disclose another embodiment of the lid of the present invention designated with the reference numeral 1810*c*. The lid 1810*c* also utilizes a moveable element 1850*c* that slides along a track 1842*c*. The track 1842*c* is defined in the top wall 1814*c* wherein a raised portion defines a channel 1888*c*. The channel 1888*c* extends laterally across the top wall 1814*c*. The channel 1888*c* has a generally narrowing section 1899*c* as the channel 1888*c* extends towards a rear of the top wall 1814*c*.

The moveable element 1850*c* is generally almost semicircular in shape although several other shapes are possible. In this particular embodiment, the moveable element 1850*c* is not tethered to the cover 1812*c*. The moveable element 1850*c* has a peripheral edge that is annular. The moveable element 1850*c* is further dimensioned wherein a portion of the peripheral edges engage inner faces of the channel 1888*c*. There is generally an interference fit between the moveable element 1850*c* and the channel 1888*c* that maintains the moveable element 1850*c* connected to the channel 1888*c* but allows for sliding movement. The channel 1888*c* preferably contains retaining lips 1894*c* at each edge to retain the moveable element 1850*c* in the channel 1888*c*, while allowing for sliding movement. It is understood that the moveable element 1850*c* may be retained in the channel 1888*c* by a myriad of different means, and the track 1842*c* may take a different form than those described.

As shown in FIGS. 88 and 89, the moveable element 1850*c* is slideable within the track 1842*c* and channel 1888*c* between closed and open positions. FIG. 88 shows the lid 1810*b* in a closed position wherein the moveable element 1850*c* is slid forward wherein the moveable element 1850*c* covers the opening 1828*c*. In this position, the annular peripheral edge of the moveable element 1850*c* generally coincides with the annular edge of the top wall 1814*c*. FIG. 89 shows the lid 1810*c* in an open position wherein the moveable element 1850*c* is slid along the track 1842*c* towards the rear of the cover 1812*c* wherein the moveable element 1850*c* is spaced from the opening 1828*b*. The moveable element 1850*c* is guided in the track 1842*c* and the narrowing portion 1899*c* of the channel 1888*c* provides a stop for the moveable element 1850*c*.

Figure 90:
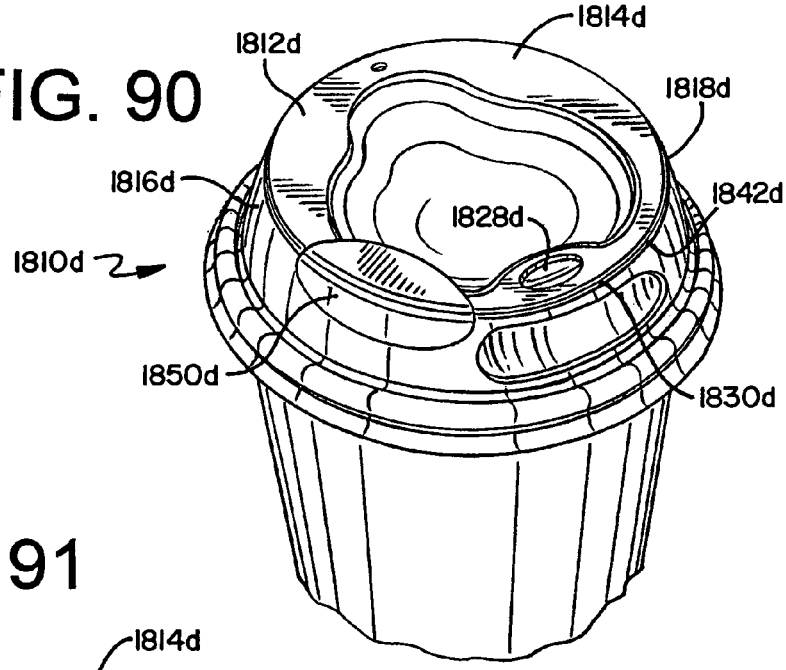
FIG. 90 is a perspective view of an alternate embodiment of the lid of the present invention, the lid shown in an open position.
Figure 91:
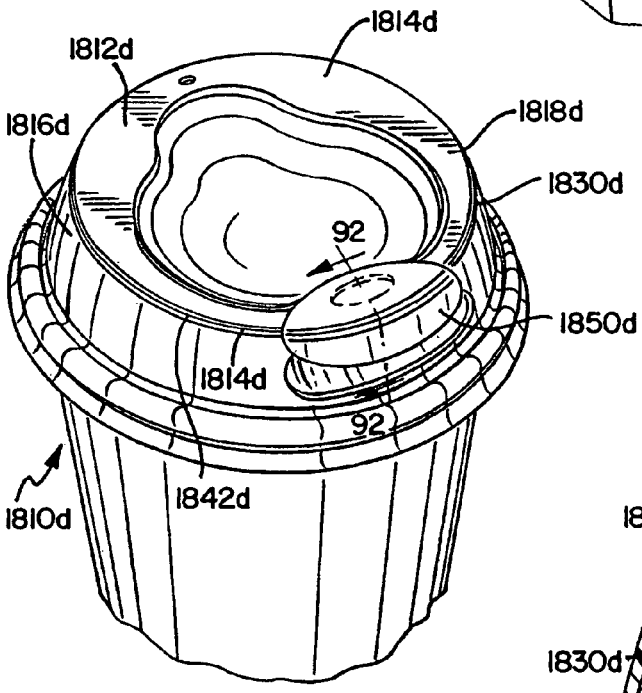
FIG. 91 is a perspective view of the lid of FIG. 90, the lid shown in a closed position.
Figure 92:
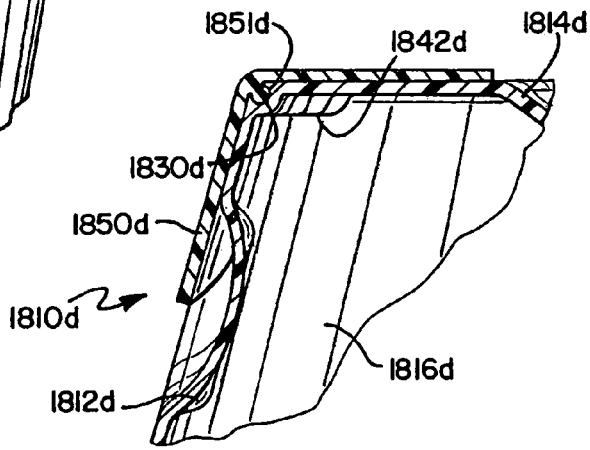
FIG. 92 is a partial cross-section view of the lid of FIG. 90, taken along lines 92-92 of FIG. 91.
Figure 97:
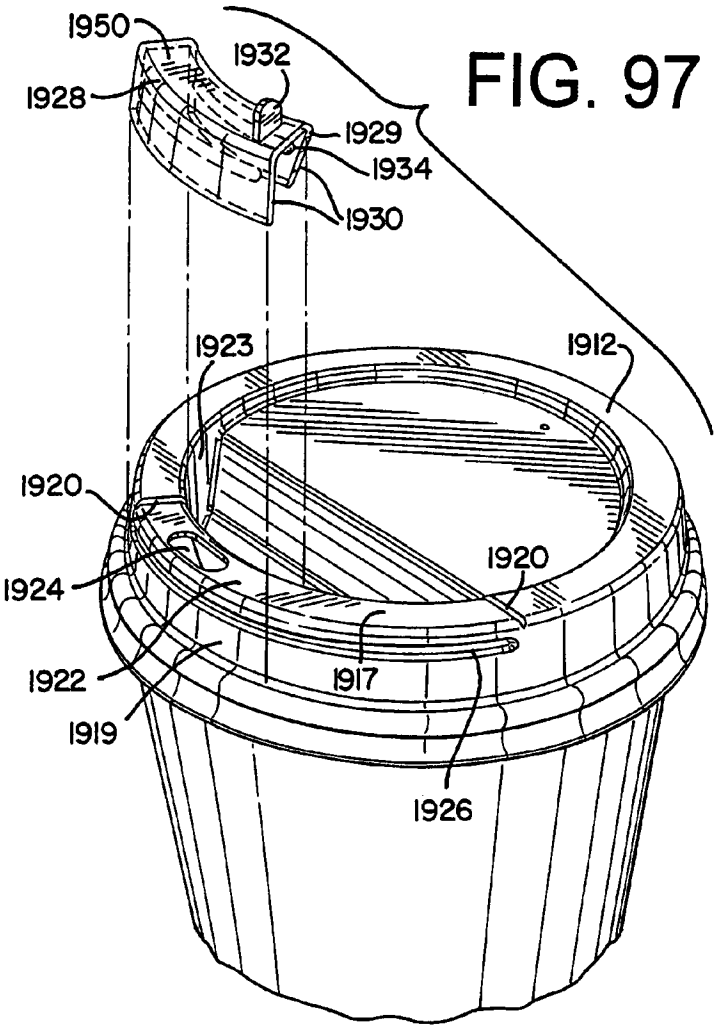
FIG. 97 is an exploded perspective view of the lid of FIG. 96.

FIGS. 90-92 disclose another embodiment of the lid, generally designated with the reference numeral 1810*d*. In this embodiment, the track 1842*d* is located on or near an outer peripheral edge 1818*d* of the cover 1812*d*, even extending circumferentially around the edge 1818*d* of the cover 1812*d*.

As further shown in FIGS. 90-92, the track 1842*d* is annular and is defined in the cover 1812*d* at the interface between the cover top wall 1814*d* and the cover side wall 1816*d*. In one preferred embodiment, the track 1842*d* has a slot 1830*d*. Although the slot 1830*d* extends generally around a full circumference of the cover 1812*d*, it is understood that the slot 1830*d* could only extend a portion of the circumference proximate the opening 1828*d*. Also, the slot 1830*d* does not extend completely through the cover 1812*d*, to avoid problems with spillage of the flowable substance through the slot 1830*d*.

The moveable element 1850*d* is generally a tab member having one portion that extends across the top wall 1814*d* of the cover 1812*d* and another portion that extends across the side wall 1816*d* of the cover 1812*d*. At an interface between the portions, the moveable element 1850*d* has a mount 1851*d* located on an inner surface of the moveable element 1850*d*. The mount 1851*d* is dimensioned to be received in the slot 1830*d* of the cover 1812*d*. The mount 1851*d* is preferably received in the slot 1830*d* in a snap-fit arrangement. As shown in FIG. 92, this cooperative structure secures the moveable element 1850*d* to the cover 1812*d* while permitting the moveable element 1850*d* to slide along the track 1842*d* between the open position and the closed position. This mount 1851*d* can comprise a lip, cusp, peg, or other protrusion that extends into the slot 1830*d*. Thus, the important aspect is that the cooperative structure maintains a sliding connection between the moveable element 1850*d* and the cover 1812*d*. It is understood that the moveable element 1850*d* can be retained to the cover 1812*d* in a variety of different ways, and the track 1842*d* could take one of many different forms. For example, cover 1812*d* could contain retaining lips or other retaining structure on the top wall 1814*d* and side wall 1816*d*, retaining the moveable element 1850*d* to the cover 1812*d*. In such case, the cooperative structure between the mount 1851*d* and the slot 1830*d* could be modified to primarily a guide structure rather than a retaining structure.

As shown in FIGS. 90-92, the moveable element 1850*d* is slideable along the outer peripheral track 1842*d* between closed and open positions. FIG. 91 shows the lid 1810*d* in a closed position wherein the moveable element 1850*d* is slid along the track 1842*d* wherein the moveable element 1850*d* covers the opening 1828*d*. FIG. 90 shows the lid 1810*d* in an open position wherein the moveable element 1850*c* is slid along the track 1842*d* to one side wherein the moveable element 1850*d* is spaced from the opening 1828*d*. The moveable element 1850*d* is guided in the track 1842*d* by the cooperative structure of the mount 1851*d* and slot 1830*d*. It is understood that the moveable element 1850*d* can be slid on either side of the opening 1828*d*.

FIGS. 93-95 disclose yet another variation of the lid, generally designated with the reference numeral 1810*e*. As shown in FIG. 95, the cooperative structure in this embodiment is a track 1842*e*, defining a slot 1830*e* in the top wall 1814*e*, that receives a mount 1851*e* located on an underside surface of the moveable element 1850*e*. The moveable member 1850*e* is generally a flat, disk shaped member. The top wall 1814*e* has a contoured edge 1847*e* that a peripheral edge of the moveable element 1850*e* engages between the open and closed positions. The contoured edge 1847*e* may also include a retaining lip 1894*e* (FIG. 95) that cooperates with another retaining lip 1895*e* (FIG. 94) on the peripheral edge 1818*e* of the top wall 1814*e* to secure the moveable element 1850*e* to the cover 1812*e*. Although not shown in FIGS. 93-95, the retaining lip 1895*e* may include a top overhang member if desired. FIG. 93 shows the lid 1810*e* in a closed position wherein the moveable member 1850*e* covers the opening 1828*e*. FIG. 94 shows the lid 1810*e* in an open position wherein the moveable member 1850 slides along the track 1842*e* and is spaced from the opening 1828*e*. It is understood that the slot 1830*e* could be modified to secure the moveable element 1850*e* to the cover 1812*e* without the need for the retaining lips 1894*e*, 1895*e*. For example, the mount 1851*e* and slot 1830*e* structures could be modified to resemble the mount 1851*d* and slot 1830*d* structures shown in FIGS. 90-92.

Yet an additional embodiment of a lid assembly 1910 according to the present invention is disclosed in FIGS. 96-99. The lid assembly 1910 generally includes a lid or cover 1912 and a movable element 1950 operably associated therewith.

Figure 96:
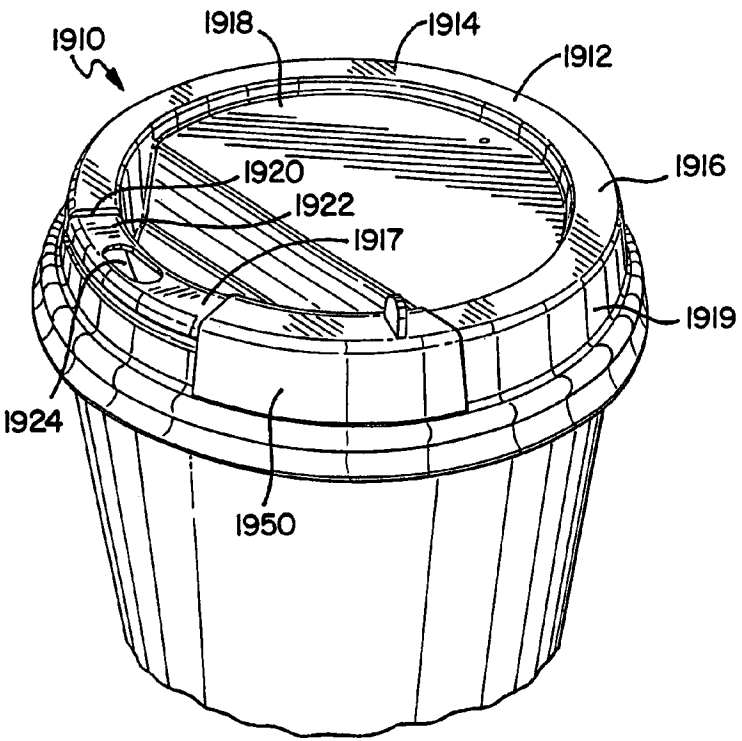
FIG. 96 is a perspective view of an alternate embodiment of the lid of the present invention, the lid shown in an open position.
Figure 99:
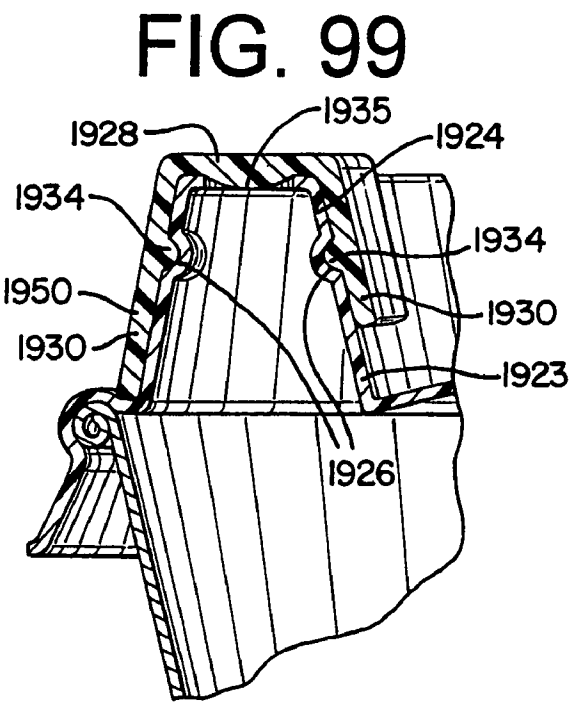
FIG. 99 is a partial cross-sectional view of the lid of FIG. 96, taken along lines 99-99 of FIG. 98.

The cover 1912 includes a top wall 1950 having in one preferred embodiment, an annular top wall 1916 and a central portion 1918. The central portion 1918 is generally recessed from the annular top wall 1916 and has a recessed area for receiving a lip of a user when drinking from the lid assembly 1910. The cover 1912 further has a side wall 1919 depending from the annular top wall 1916 and having a mounting portion adapted for mounting the cover 1912 to a cup as previously described and as shown in FIG. 96. The recessed area further defines an inner sidewall 1923. The annular top wall 1916 has an offset portion 1917 that defines a first stop 1920 and a second stop 1920. An annular rail 1922 is defined in the offset portion 1917 and specifically between the stops 1920. The annular rail 1922 may also include the portions of the side wall 1919 and the inner side wall 1923 between the stops 1920. The cover 1912 has a drink opening 1924 positioned in the annular top wall 1916 at the annular rail 1922. The annular rail 1922 has a pair of grooves or channels 1926 located on the side wall 1919 and inner side wall 1923. The channels 1926 are opposed to one another.

As further shown in FIGS. 96-99, the movable element 1950 includes a base 1928 and a skirt assembly 1929. The skirt assembly 1929 comprises a pair of opposed depending walls 1930 depending from the base 1928. A tab 1932 extends from the base 1928. Protruding from an inner surface of each depending wall 1930 is a ridge 1934. An underside of the base 1928 includes a slight bump 1935. The bump 1935 is generally shaped similar to the drink opening 1924.

To assemble the moveable element 1950 to the cover 1912, the moveable element 1950 is positioned slightly above the annular rail 1922 such that the annular rail 1922 is generally received between the pair of depending walls 1930. The moveable element 1950 is then pressed against the lid 1912 such that each ridge 1934 is received by a respective channel 1926. There is some flexibility in the pair of depending walls 1930 to permit them to expand slightly to allow the ridges 1934 to be received by a respective channel 1926.

Figure 98:
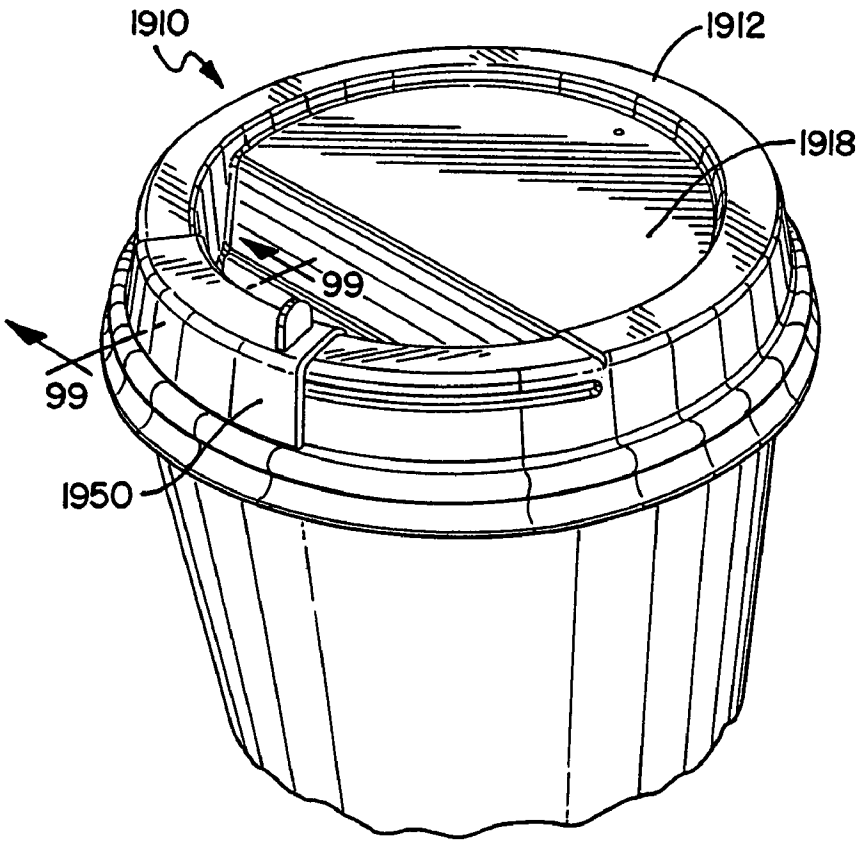
FIG. 98 is a perspective view of the lid of FIG. 96, the lid shown in a closed position.

In operation, the moveable element 1950 slides or moves along the annular rail 1922 between a first, closed position as shown in FIG. 98 to a second, open position as shown in FIG. 96. More specifically, each ridge 1934 slides along and within its respective channel 1926 between the open and closed positions. In the closed position shown in FIGS. 98 and 99, the base 1928 substantially seals or closes the drink opening 1924 and the bump 1935 is received by the drink opening 1924. The bump 1935 and drink opening 1924 cooperate to act as a detent and provide the user with a tactile indication that the moveable element 1914 is in the closed position. Also, the bump 1935 and drink opening 1924 cooperate to maintain the moveable element 1950 in the closed position in the event of any vibration or unintended forces being exerted on the moveable element 1950 thereby tending to prevent any unintended spillage of the cup contents. As further shown, the movable element abuts one of the stops 1920. In the second, or open position, the base 1928 is moved away from the drink opening 1924 to expose the drink opening 1924 to allow access to the cup contents. In the open position, the movable element 1950 abuts the other stop 1920. To move the moveable element 1950 between open and closed positions, a user engages the tab 1932 with a finger or thumb to exert a force on the tab 1932 consistent with the direction of intended travel of the moveable element 1950.

Additionally, the cooperation between the bump 1935 and the drink opening 1924 may also provide a tactile indication that the moveable element 1950 is in the closed position as well as the cooperation between the bump 1935 and the annular rail 1922 may also provide a tactile indication that the moveable element 1950 is in the open position. Frictional engagement between the bump 1935 and annular rail 1922, as well as the movable element 1950 in general, may assist to retain the moveable element 1950 in the open position.

It is noted that the drink opening 1924 may alternatively have a slight bump and the underside of the base 1928 may have a slight recess to provide a similar, but reversed structure as shown in the figures.

As shown in FIGS. 96-99, the moveable element 1950 is movable generally to one side of the drink opening 1924. It is understood that the annular rail 1922 could be positioned about the drink opening 1924 such that the moveable element 1950 is movable to generally the opposite side as shown in the figures. It is further understood that the annular rail 1922 could extend to both sides of the drink opening 1924 wherein a user could move the moveable element 1950 to either side of the drink opening 1924 for the open position.

In one preferred embodiment, the lid 1912 is thermoformed and the movable element 1950 is an injected-molded part. It is understood, however, that the components of the lid assembly 1910 could be formed from a variety of known manufacturing processes.

Still other embodiments are contemplated, incorporating different combinations of the features described herein.

The lids of the present invention provide several benefits. The lid provides a means by which to allow a consumer to seal the contents of the beverage inside the container to prevent leakage, spillage, contamination, and heat loss or gain, while retaining the ability to quickly and easily reopen the container for beverage consumption. The lid of the present invention has a construction providing for simple and effective operation and is easy to assemble. The lid can be easily mass-produced and is disposable and recyclable.

The lids of the present invention can be manufactured using a variety of different processes, including thermoforming, vacuum forming, pressure forming, injection molding, blow molding, and any other suitable process. Additionally, separate components of the same lid can be made using different manufacturing processes. For example, the cover of a particular lid may be thermoformed, while the moveable element is injection molded.

Finally, several preferred embodiments of the lid of the present invention have been described herein. It is understood that the different features of the several different embodiments can be utilized in various combinations as desired.

The dimensions of the lids 10, 210, 310, 510, 610, 710, 810, 1010, 1110, 1210, 1310, 1410, 1510, 1610, 1710, 1810, 1910 can vary with design parameters. For example, the outer diameter of the aforementioned lids as measured from opposed points in the mounting portion can vary. As another example, the overall height of the lids as measured from the lower edge of the mounting portion to the top wall can vary. One of ordinary skill recognizes that the dimensions can be adjusted without departing from the spirit of the invention.

While specific embodiments have been illustrated and described, numerous modifications come to mind without significantly departing from the spirit of the invention and the scope of protection is only limited by the scope of the accompanying claims.

What is claimed is:

1. A lid assembly for use with a cup, the assembly comprising:

a lid having a mounting portion with a skirt configured to mount to the cup, a top wall, and a side wall extending downward from the top wall to the mounting portion, the top wall having a recessed central portion, a raised edge portion having a curvilinear rail defined at least partially therein, an inner side wall extending downward from the raised edge portion to the recessed central portion, and a drink opening in the raised edge portion, wherein the curvilinear rail comprises a top surface having the drink opening defined therein, a curvilinear outer edge connected to the side wall, a curvilinear inner edge connected to the inner side wall and a pair of opposed channels including a first curvilinear channel located in the side wall and a second curvilinear channel located in the inner side wall; and a moveable element slidingly mounted to the curvilinear rail, the moveable element moveable between a first position obstructing the drink opening to define a closed position and a second position spaced from the drink opening to define an open position, the moveable element comprising a base having a curvilinear inner edge and a curvilinear outer edge, a first leg depending from the outer edge of the base and having a first ridge, and a second leg depending from the inner edge of the base and having a second ridge, wherein the moveable element is mounted to the curvilinear rail so that the base confronts the top surface of the curvilinear rail, the first leg confronts the side wall of the lid so that the first ridge is received within the first channel, and the second leg confronts the inner side wall of the lid so that the second ridge is received in the second channel, and wherein the base has a length that is smaller than a length of the curvilinear rail, the inner edge of the base is curved similarly to the inner edge of the curvilinear rail, the outer edge of the base is curved similarly to the outer edge of the curvilinear rail, the first leg is contoured similarly to the side wall of the lid, and the second leg is contoured similarly to the inner side wall of the lid, to allow the moveable element to slide along the curvilinear rail between the first position and the second position.

2. The lid assembly of claim 1 wherein the raised edge portion of the top wall has an offset portion to define the curvilinear rail such that the curvilinear rail is recessed with respect to adjacent portions of the raised edge portion, and wherein the curvilinear rail has a first stop and a second stop at opposed ends thereof.

3. The lid assembly of claim 2 wherein a first end of the base of the movable element abuts the first stop when in the first position and a second, opposed end of the base of the moveable element abuts the second stop when in the second position.

4. The lid assembly of claim 1 wherein the movable element has a bump, the bump received by the drink opening when in the first position.

5. The lid assembly of claim 1 wherein the moveable element has a tab extending from the base.

6. The lid assembly of claim 1 wherein the curvilinear rail extends around a portion of a periphery of the lid.

7. The lid assembly of claim 6 wherein the curvilinear rail is defined by a first stop at a first end of the curvilinear rail and a second stop at a second end of the curvilinear rail.

8. A lid assembly for use with a cup, the assembly comprising:

a lid having a mounting portion configured to mount to the cup, a top wall, and a side wall extending downward from an outer edge of the top wall to the mounting portion, the top wall having a raised edge portion, a recessed central portion, and an inner side wall extending downward from an inner edge of the raised edge portion to the recessed central portion, the having a curvilinear rail extending around a portion of a periphery of the raised edge portion, and a drink opening in a top surface of the curvilinear rail, wherein the top surface of the curvilinear rail is recessed with respect to adjacent portions of the raised edge portion, such that the curvilinear rail is defined by a first end wall extending upward from the top surface to a first adjacent portion of the raised edge portion at a first end of the curvilinear rail and a second end wall extending upward from the top surface to a second adjacent portion of the raised edge portion at a second, opposed end of the curvilinear rail, the first end wall forming a first stop at the first end of the curvilinear rail and the second end wall forming a second stop at the second end of the curvilinear rail, the curvilinear rail further including a channel in one of the side wall and the inner side wall; and a moveable element comprising a base having a curvilinear inner edge and a curvilinear outer edge, a first leg depending from the outer edge of the base, a second leg depending from the inner edge of the base, and a ridge located on one of the first leg and the second leg, the moveable element slidingly mounted to the curvilinear rail, such that the base confronts the top surface of the curvilinear rail, the first leg is positioned along the side wall, the second leg is positioned along the inner side wall, and the ridge is received in the channel, wherein the moveable element is moveable between a first position obstructing the drink opening to define a closed position and a second position spaced from the drink opening to define an open position, wherein the moveable element abuts one of the first end wall and the second end wall when the moveable element is in the first position, and the ridge slides along the channel as the moveable element is moved from the first position to the second position.

9. The lid assembly of claim 8 wherein a first end of the base of the movable element abuts the first stop when in the first position and a second, opposed end of the base of the moveable element abuts the second stop when in the second position.

10. The lid assembly of claim 8 wherein the curvilinear rail further comprises a second channel located in the other of the side wall and the inner side wall and the moveable element has a second ridge located in the other of the first leg and the second leg, wherein the second ridge is received by the second channel and slides along the channel as the moveable element is moved between the first and second positions.

11. A lid assembly for use with a cup, the assembly comprising:

a lid having a top wall having a raised edge portion defined by a curvilinear outer edge and a curvilinear inner edge, an outer side wall depending from an outer periphery of the top wall and having a first channel therein, an inner side wall depending from the inner edge of the raised edge portion and having a second channel therein, and a mounting portion connected to the outer side wall and configured to mount to the cup, the lid further having a drink opening in the raised edge portion; and a moveable element having a base, a first leg and a second leg depending from opposite sides of the base, a first ridge located on the first leg, and a second ridge located on the second leg, the moveable element being slidingly mounted to the lid wherein the first ridge is received in the first channel, the second ridge is received in the second channel, and the moveable element contacts an outer surface of the raised edge portion of the top wall, the inner side wall, and the outer side wall of the lid, the moveable element being moveable between a first position obstructing the drink opening to define a closed position and a second position spaced from the drink opening to define an open position, wherein the base is defined by a first end, a second end, an inner curvilinear edge, and an outer curvilinear edge, and the first leg and the second leg each have a curvilinear contour, giving the moveable element a partially annular shape.

12. The lid assembly of claim 11 wherein the raised edge portion is annular and extends around an entire periphery of the lid.

13. The lid assembly of claim 11 wherein the raised edge portion further comprises a partially annular recessed surface defined by a first stop defined by a first end wall at a first end of the recessed surface and a second stop defined by a second end wall at a second end of the recessed surface, and wherein the moveable element contacts the recessed surface throughout a range of motion of the moveable element.

14. The lid assembly of claim 11 wherein the lid has a first stop and a second stop defining a range of movement of the moveable element between the first position and the second position.

15. A lid assembly for use with a cup, the assembly comprising:

a lid having a mounting portion configured to mount to the cup, a top wall, and a side wall extending downward from an outer edge of the top wall to the mounting portion, the top wall having a raised edge portion, a recessed central portion, and an inner side wall extending downward from an inner edge of the raised edge portion to the recessed central portion, the lid having a curvilinear rail comprising a recessed surface on the raised edge portion, the recessed surface defined between the inner edge of the raised edge portion, the outer edge of the top wall, a first end wall extending upward from a first end of the recessed surface to a first adjacent area of the raised edge portion, and a second end wall extending upward from a second, opposed end of the recessed surface to a second adjacent area of the raised edge portion, wherein the outer edge of the top wall and the inner edge of the raised edge portion are curvilinear to give the recessed surface a partially annular shape, the curvilinear rail further comprising a channel defined in one of the inner side wall and the outer side wall, the lid further comprising a drink opening in the recessed surface; and a moveable element comprising a base having a curvilinear inner edge and a curvilinear outer edge, a first leg depending from the outer edge of the base, a second leg depending from the inner edge of the base, and a ridge located on one of the first leg and the second leg, the moveable element slidingly mounted to the curvilinear rail, such that the base confronts the top surface of the curvilinear rail, the first leg is positioned along the side wall, the second leg is positioned along the inner side wall, and the ridge is received in the channel, wherein the moveable element is moveable within a range of movement between a first position obstructing the drink opening to define a closed position and a second position spaced from the drink opening to define an open position, and wherein the range of movement of the moveable element is limited such that no portion of the moveable element extends circumferentially beyond the first end wall or the second end wall of the recessed surface at any point within the range of movement.

16. The lid assembly of claim 15, wherein the recessed central portion of the lid further comprises a lip recess.

17. The lid assembly of claim 15 wherein the curvilinear rail extends around a portion of a periphery of the top wall.

18. The lid assembly of claim 17 wherein the curvilinear rail is defined by a first stop defined by the first end wall and a second stop defined by the second end wall.

19. The lid assembly of claim 15, wherein the curvilinear rail further comprises a second channel, and the moveable element has a second ridge, wherein the second ridge is received in the second channel when the moveable element is mounted to the lid.

20. The lid assembly of claim 15 wherein the lid has a first stop and a second stop defining the range of movement of the moveable element between the first position and the second position.

* * * * *